US007128126B2

(12) United States Patent
Smith et al.

(10) Patent No.: US 7,128,126 B2
(45) Date of Patent: Oct. 31, 2006

(54) CONTROL SYSTEM FOR ARCHITECTURAL COVERINGS WITH REVERSIBLE DRIVE AND SINGLE OPERATING ELEMENT

(75) Inventors: Stephen P. Smith, Denver, CO (US); Wendell B. Colson, Weston, MA (US); James L. Miller, Thornton, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 39 days.

(21) Appl. No.: 10/791,645

(22) Filed: Mar. 1, 2004

(65) Prior Publication Data

US 2004/0226663 A1 Nov. 18, 2004

Related U.S. Application Data

(60) Provisional application No. 60/452,222, filed on Mar. 4, 2003.

(51) Int. Cl.
*A47G 5/02* (2006.01)

(52) U.S. Cl. ..... 160/319; 160/121.1; 160/84.05

(58) Field of Classification Search ..... 160/84.05, 160/121.1, 319, 320, 168.1 R, 178.1 R, 173 R, 160/170

See application file for complete search history.

(56) References Cited

U.S. PATENT DOCUMENTS

| | | | |
|---|---|---|---|
| 803,696 | A | 11/1905 | Lang |
| 2,579,144 | A | 12/1951 | Griesser |
| 2,732,010 | A | 1/1956 | Griesser |
| 2,758,527 | A | 8/1956 | McFadden |
| 3,135,369 | A | 6/1964 | Nisenson et al. |
| 3,181,595 | A | 5/1965 | Pender |
| 4,126,366 | A | 11/1978 | Handler et al. |
| 4,224,973 | A | 9/1980 | Hugin |
| 4,372,432 | A | 2/1983 | Waine et al. |
| 4,433,765 | A | 2/1984 | Rude et al. |
| 4,466,475 | A | 8/1984 | Saito et al. |
| 4,492,261 | A | 1/1985 | Chong |
| 4,657,060 | A | 4/1987 | Kaucic |
| 4,662,423 | A | 5/1987 | Ishii |
| 4,681,279 | A | 7/1987 | Nakamura |
| 4,712,599 | A | 12/1987 | Komaki |
| 4,830,081 | A | 5/1989 | Morris |
| 4,919,186 | A | 4/1990 | Uecker et al. |
| 5,099,906 | A | 3/1992 | Chigusa et al. |

(Continued)

FOREIGN PATENT DOCUMENTS

| | | |
|---|---|---|
| GB | 955899 | 4/1964 |

(Continued)

*Primary Examiner*—Blair M. Johnson
(74) *Attorney, Agent, or Firm*—Dorsey & Whitney LLP

(57) ABSTRACT

The present invention provides for retractable coverings for architectural openings utilizing a control system having a single operating element allowing a user to move a retractable covering between extended and retracted positions by imparting a repetitive motion to the operating element. The control system may include an input assembly, a transmission, and an output assembly cooperatively engaging to convert linear movement of the operating element into rotational movement of a head roller in the required direction to provide movement of the covering in the desired direction and distance. The input assembly may convert linear movement of the operating element into rotational movement imparted to the transmission. The input assembly may also engage the transmission to effect the direction of rotational output from the transmission. The transmission imparts rotational movement to the output assembly, which interfaces with the head roller to rotate the head roller and to provide a braking feature.

82 Claims, 53 Drawing Sheets

U.S. PATENT DOCUMENTS

| | | | | |
|---|---|---|---|---|
| 5,137,073 | A | | 8/1992 | Huang |
| 5,266,068 | A | | 11/1993 | Benthin |
| 5,375,643 | A | | 12/1994 | Rude |
| 5,566,741 | A | | 10/1996 | Ogawara et al. |
| 5,586,631 | A | | 12/1996 | Benthin |
| 5,634,244 | A | * | 6/1997 | Fetsch et al. ..... 24/115 F |
| 5,641,046 | A | | 6/1997 | Levenberg |
| 5,791,393 | A | | 8/1998 | Judkins |
| 5,803,148 | A | | 9/1998 | Madsen |
| 5,890,529 | A | | 4/1999 | Haarer |
| 5,909,791 | A | | 6/1999 | DiStefano |
| 6,123,140 | A | | 9/2000 | Bergamaschi |
| 6,129,131 | A | * | 10/2000 | Colson ..... 160/84.02 |
| 6,148,893 | A | | 11/2000 | Cadorette |
| 6,158,563 | A | | 12/2000 | Welfonder et al. |
| 6,173,825 | B1 | | 1/2001 | Liu |
| 6,305,456 | B1 | | 10/2001 | Sanchez |
| 6,379,276 | B1 | | 4/2002 | Cheng |
| 6,685,592 | B1 | * | 2/2004 | Fraczek et al. ..... 475/14 |

FOREIGN PATENT DOCUMENTS

| | | |
|---|---|---|
| GB | 955900 | 4/1964 |
| JP | 57-164973 | 10/1982 |
| JP | 63-46224 B | 9/1988 |
| JP | 5-9890 Y | 3/1993 |
| JP | 7-324572 A | 12/1995 |
| JP | 8-232559 | 9/1996 |
| WO | WO 92/09779 | 6/1992 |

* cited by examiner

Fig. 6BBB

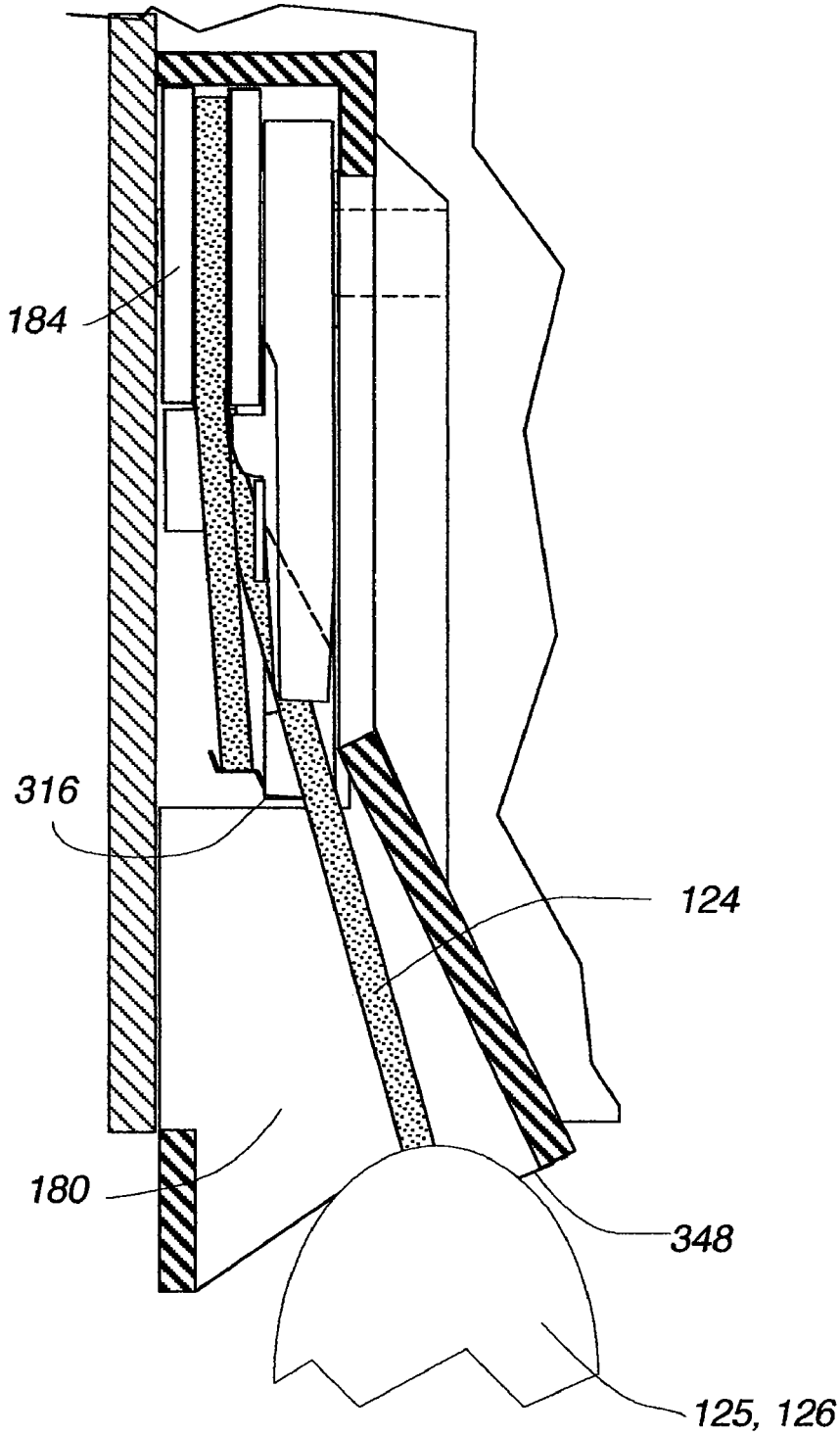
Fig. 6BBBB

Fig. 7AAA

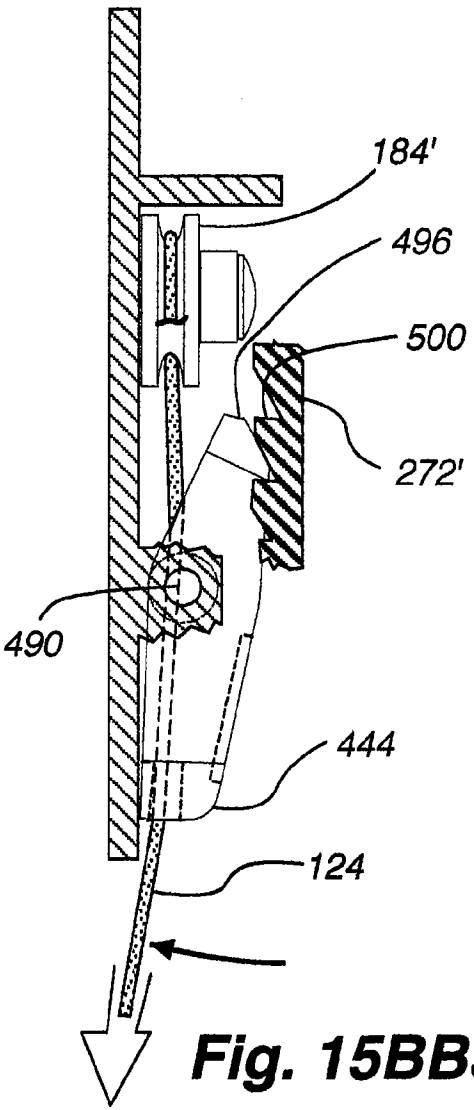
Fig. 15BB3
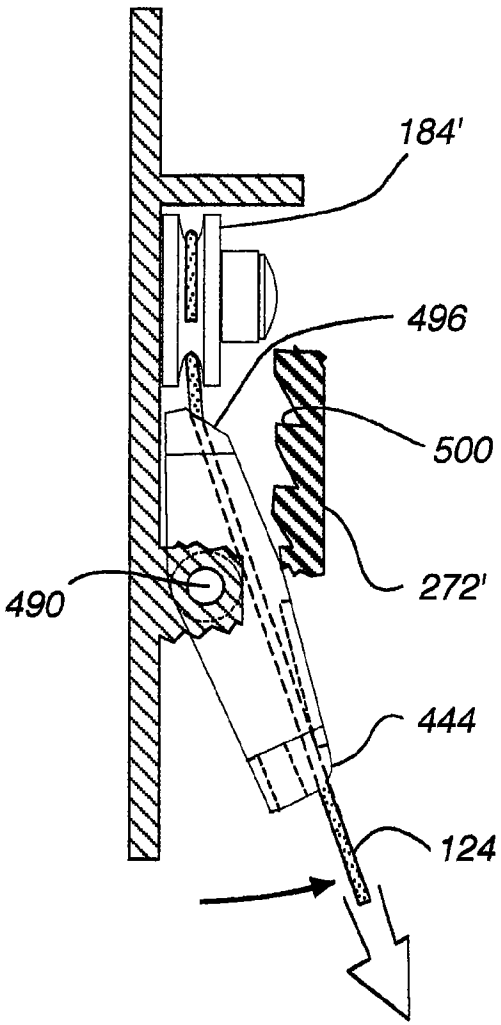
Fig. 15BB2
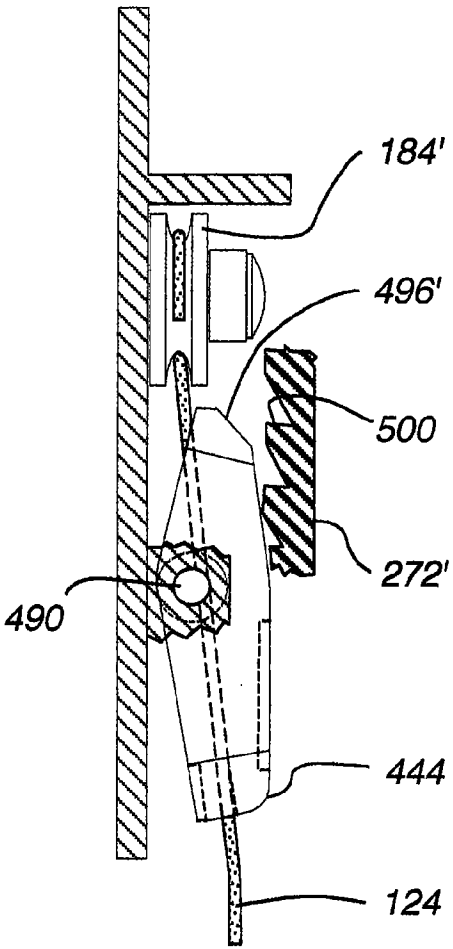
Fig. 15BB1

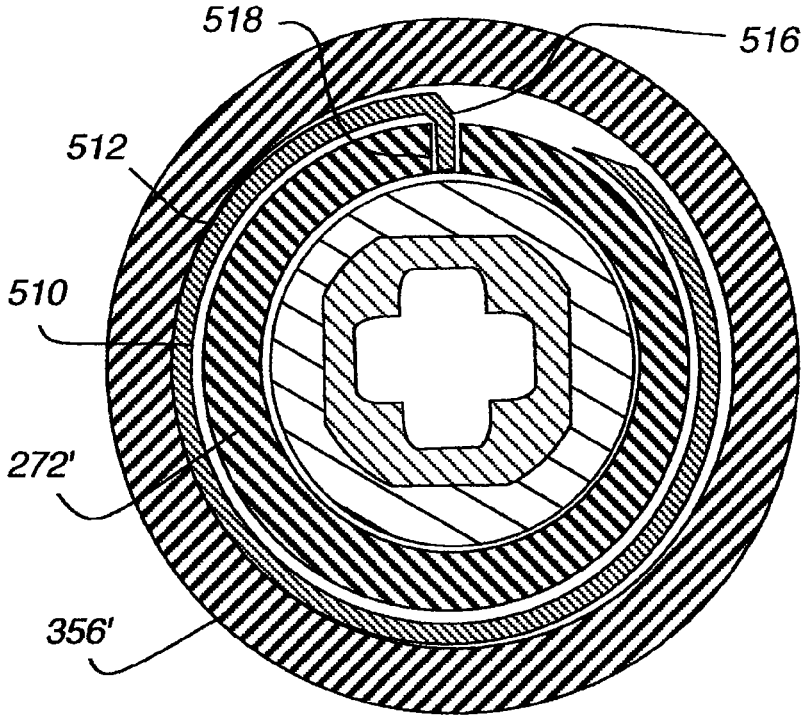
Fig. 15D2
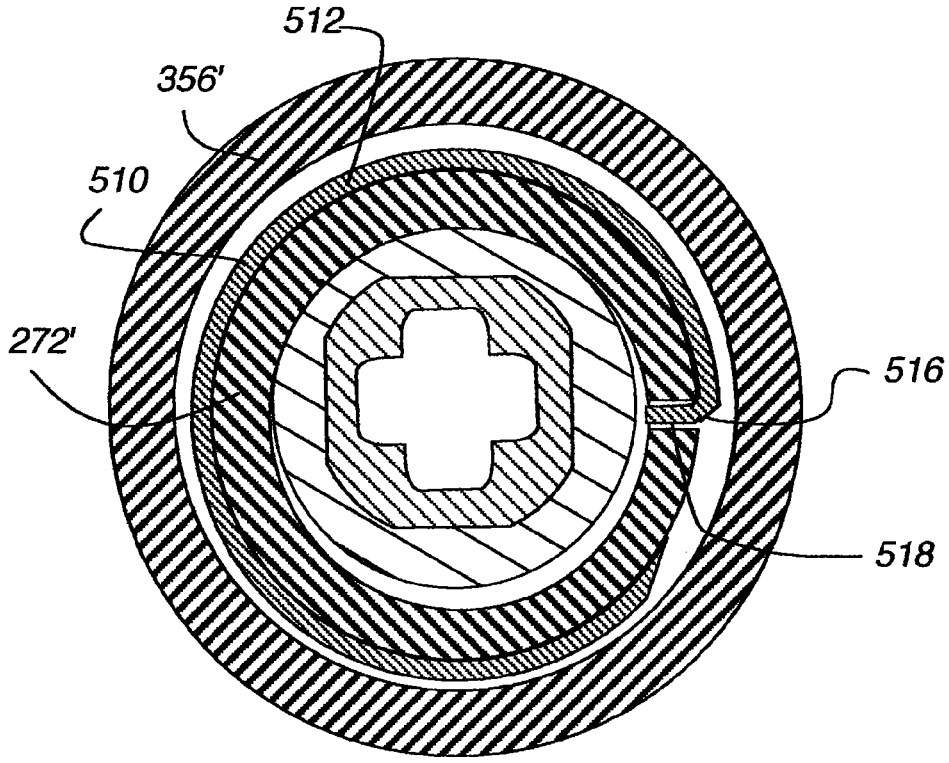
Fig. 15D1

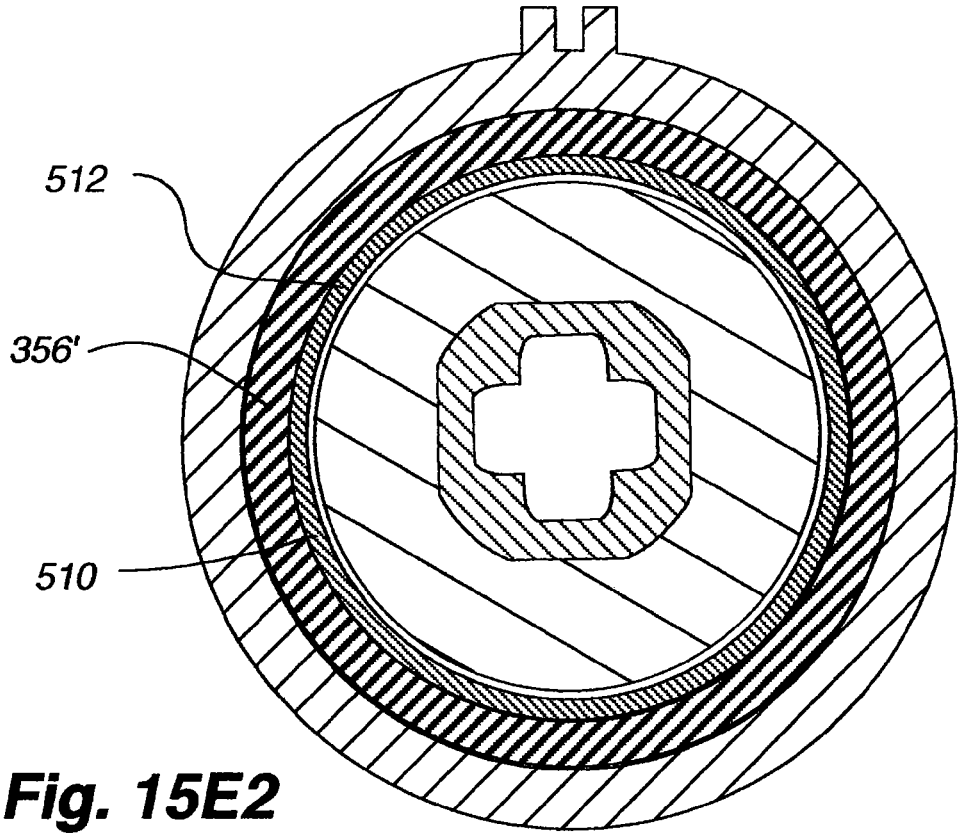
Fig. 15E2
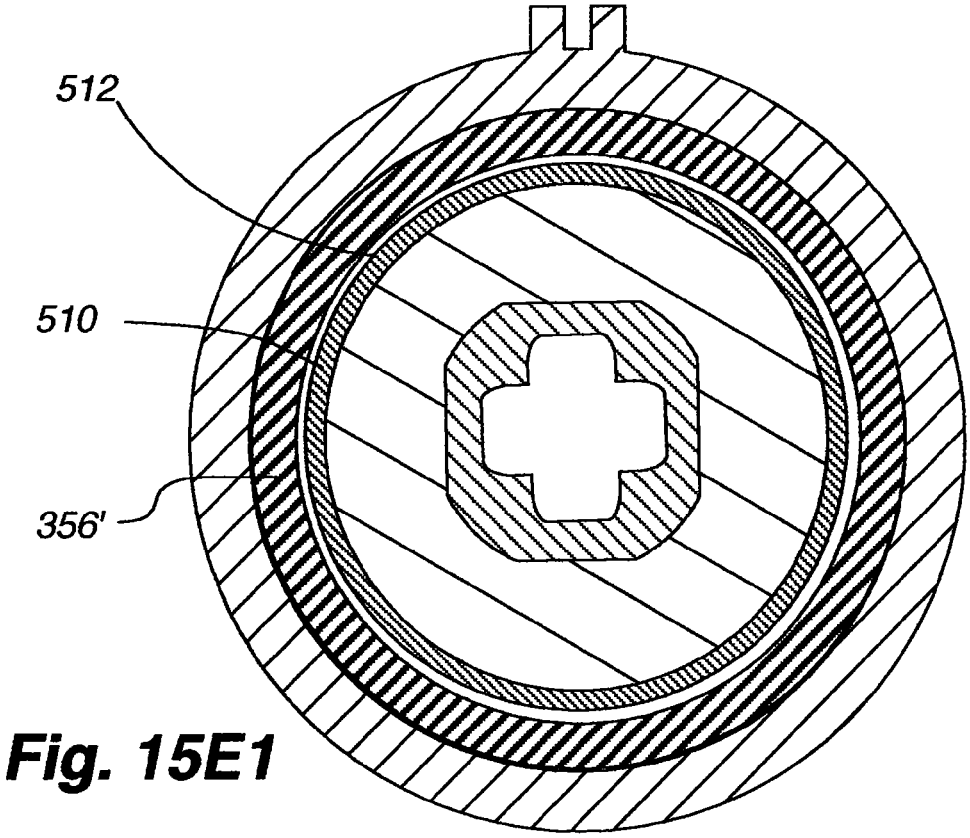
Fig. 15E1

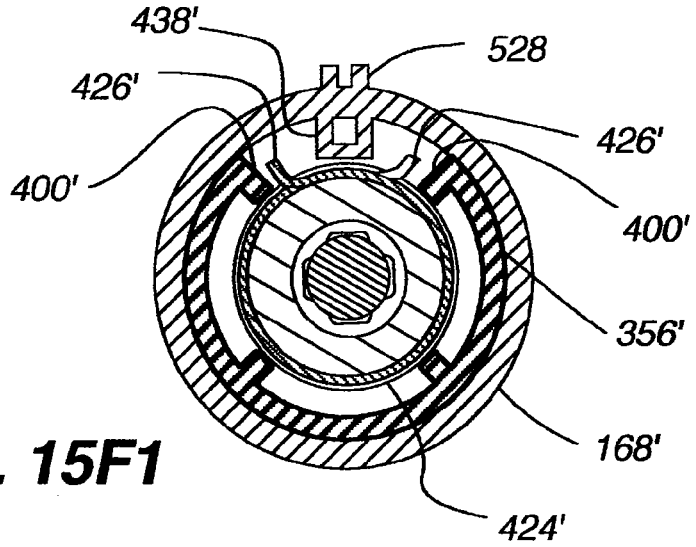
Fig. 15F1
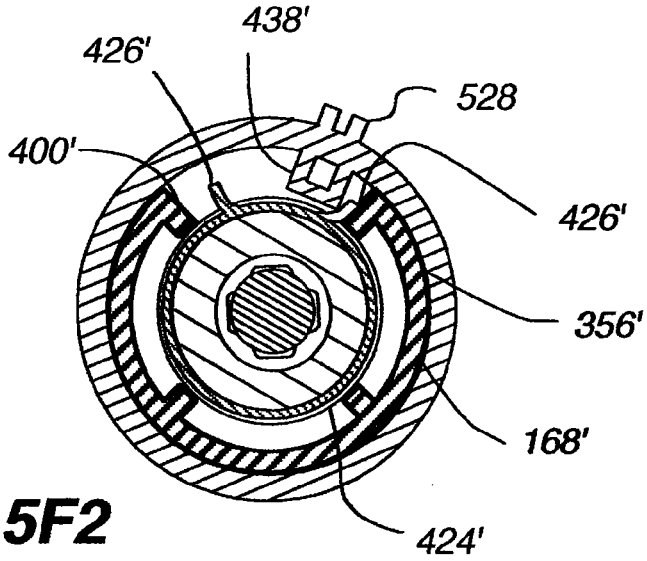
Fig. 15F2
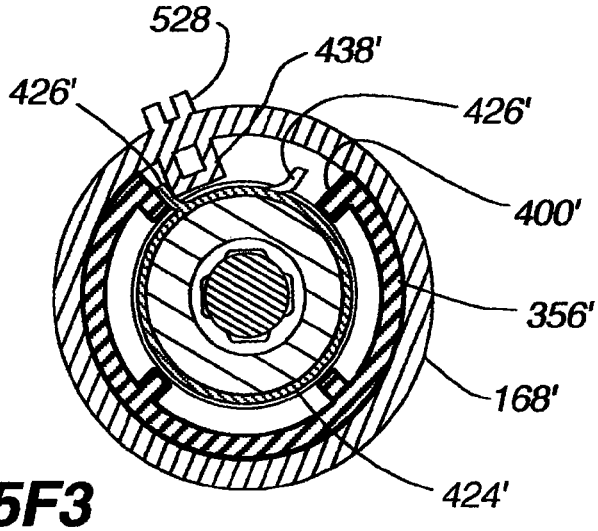
Fig. 15F3

CONTROL SYSTEM FOR ARCHITECTURAL COVERINGS WITH REVERSIBLE DRIVE AND SINGLE OPERATING ELEMENT

CROSS-REFERENCE TO RELATED APPLICATIONS

This application claims priority to U.S. Provisional Application No. 60/452,222, filed Mar. 4, 2003, hereby incorporated by reference in its entirety as though fully set forth herein.

BACKGROUND OF THE INVENTION a. Field of the Invention

This invention relates to retractable coverings for architectural openings, and more particularly, an operating system for controlling retractable coverings for architectural openings using a single operating element.

b. Background Art

Operating systems utilized in window coverings for architectural openings, such as shade and blind assemblies are commonly used. Conventional shade and blind assemblies typically comprise a head rail, bottom rail, and slats or a covering disposed therebetween. Generally, a control system for raising and lowering such blinds or shades are installed in the head rail and may include an operating element, such as a cord, for lowering or raising the blinds or shades. The operating element is typically connected to pulleys or drums within the head rail, which when activated by a user, lift the bottom rail or lower the bottom rail via cords attached to the bottom rail. The operating element may be a continuous loop so as to present to the user a convenient method for operating the shade or blind. Other control systems may have a plurality of operating elements that are not in a loop so as to present the user a choice of one of the operating elements to raise or lower the blind.

Whether the control system utilizes a single looped type operating element or a plurality of operating elements, the operator must choose which direction to pull the loop or which operating element to activate in order to move the architectural covering in a desired direction. This can be especially confusing if the operating elements are tangled. Inherent in the loop operating element system is the problem of having a very long operating element with which to operate the system. Often, a greater length of operating element is necessary to raise or lower the shade or blind due to the longer drop of the shade or blind. A greater length of the operating element or the use of a looped cord present a strangulation hazard to children who may become entangled in the operating element.

BRIEF SUMMARY OF THE INVENTION

The present invention provides for retractable coverings for architectural openings utilizing a control system having a single operating element allowing a user to move a retractable covering for architectural openings between extended and retracted positions by imparting a repetitive motion to the operating element. When the retractable covering is vertically disposed, a user can raise or lower the retractable covering by imparting a repetitive up and down motion to the pull cord.

In one aspect of the present invention, a covering for an architectural opening includes a head rail assembly, at least one sheet of fabric, and a head roller rotatably supported by the head rail assembly and adapted to extend or retract the at least one sheet upon rotation of the head roller in a first direction or a second direction. A control system is connected with the head rail assembly and is adapted to rotate the head roller in the first direction and the second direction. The control system includes an input assembly, a transmission, and an output assembly. The input assembly includes a single operating element and is operative to convert linear motion of the operating element into rotational motion of a first motion transfer element. The transmission is operative to translate rotation of the first motion transfer element into rotation of a second motion transfer element. The output assembly is operatively engaged with the second motion transfer element to rotate the head roller. A pull force applied in a first pull direction imparted on the single operating element causes the head roller to rotate in the first direction, and the pull force applied in a second pull direction imparted on the single operating element causes the head roller to rotate in the second direction.

In another form of the present invention, the input assembly includes a single operating element and is operative to convert linear motion of the operating element into rotational motion of a first motion transfer element. The transmission is operative to translate rotation of the first motion transfer element in the first direction into rotation of a second motion transfer element through at least one planet gear rotatably connected with a planet carrier. The output assembly is operatively engaged with the second motion transfer element to rotate the head roller. The input assembly includes a braking element adapted to brake the planet carrier to cause rotation of the second motion transfer element in the second direction, and the input assembly is adapted to release the planet carrier to cause rotation of the second motion transfer element in the first direction.

In yet another form of the present invention, the input assembly includes a single operating element and is operative to convert linear motion of the operating element into rotational motion of a first motion transfer element. The transmission is operative to translate rotation of the first motion transfer element in the first direction into rotation of a second motion transfer element though a planetary gear set configured to selectively operate in a first configuration and a second configuration. The output assembly is operatively engaged with the second motion transfer element to rotate the head roller. The first configuration provides a first mechanical advantage and causes the second motion transfer element to rotate at a first speed. The second configuration provides a second mechanical advantage and causes the second motion transfer element to rotate at a second speed.

In still another form of the present invention, the input assembly includes a single operating element and is operative to convert linear motion of the operating element into rotational motion of a first motion transfer element. The transmission is operative to translate rotation of the first motion transfer element into rotation of a second motion transfer element through a clutch and at least one third gear. The output assembly operatively engaged with the second motion transfer element to rotate the head roller. Rotation of the first motion transfer element in the first direction engages the least one third gear to activate the clutch to cause rotation of the second motion transfer element in the first direction. The clutch is configured to allow rotation of the second motion transfer element in the first direction and second direction when the clutch is deactivated.

In still another form of the present invention, the input assembly includes a single operating element and is operative to convert linear motion of the operating element into rotational motion of a first motion transfer element. The transmission operative to translate rotation of the first motion transfer element into rotation of a second motion transfer element. The output assembly is operatively engaged with the second motion transfer element to rotate the head roller. The input assembly is configured to engage the transmission to cause the head roller to rotate in the first direction when the operating element travels in a first path through the input assembly, and is configured to engage the transmission to cause the head roller to rotate in a the second direction when the operating element travels in a second path through the input assembly.

In still another form of the present invention, the input assembly includes a single operating element and is operative to convert linear motion of the operating element into rotational motion of a first motion transfer element. The transmission is operative to translate rotation of the first motion transfer element into rotation of a second motion transfer element. The output assembly operatively engaged with the second motion transfer element to rotate the head roller. A pull force applied in a first pull direction imparted on the single operating element causes the head roller to rotate in the first direction. The input assembly is operative to allow a change in direction of the pull force on the single operating element while the head roller is rotating in the first direction without reversing rotation of the head roller.

In still another form of the present invention, the input assembly is operative to convert linear motion of an operating element into rotational motion of a first motion transfer element. The transmission operative to translate rotation of the first motion transfer element into rotation of a second motion transfer element through at least a third gear rotatably connected with a planet carrier. The output assembly operatively engaged with the second motion transfer element to rotate the head roller. The input assembly includes a shift arm having a pawl adapted to engage ratchet teeth on the planet carrier when a pull force in a first pull direction is imparted on the single operating element. The input assembly is also configured to automatically retract the single operating element into the head rail assembly and disengage the pawl from the ratchet teeth when no pull force is applied to the single operating element.

The features, utilities, and advantages of various embodiments of the invention will be apparent from the following more particular description of embodiments of the invention as illustrated in the accompanying drawings and defined in the appended claims.

BRIEF DESCRIPTION OF THE DRAWINGS

FIG. 6AA is the view shown in FIG. 6A without an operating cord and clock spring.

FIG. 6BB is a cross-sectional view of the control system depicted in FIG. 6B, taken along line 6BB—6BB.

FIG. 6BBB is a cross-sectional view of the control system depicted in FIG. 6B, taken along line 6BBB—6BBB.

FIG. 6BBBB is a view of the control system depicted in FIG. 6BB showing an operating cord placed in a neutral position.

FIG. 7AA is a cross-sectional view of the control system depicted in FIG. 6B, taken along line 7AA—7AA.

FIG. 7AAA is a cross-sectional view of the control system depicted in FIG. 6B, taken along line 7AAA—7AAA.

FIG. 15BB1–15BB3 are a cross-sectional views of the control system depicted in FIG. 15B, taken along line 15BB—15BB.

FIGS. 15D1 and 15D2 are a cross-sectional views of the control system depicted in FIG. 15, taken along line 15D—15D.

FIGS. 15E1 and 15E2 are a cross-sectional views of the control system depicted in FIG. 15, taken along line 15E—15E.

FIG. 15F1–15F3 are a cross-sectional views of the control system depicted in FIG. 15, taken along line 15F—15F.

DETAILED DESCRIPTION OF THE INVENTION

General Overview

Retractable coverings for architectural openings are well known in the art. Such retractable coverings are generally movable between extended and retracted positions. When such coverings are vertically oriented, they are moveable between raised and lowered positions. Retractable coverings may also include vanes or slats, which are typically movable or tiltable between open and closed positions. A head rail typically houses a control system to allow a user to move the retractable covering between retracted and extended positions. As such, the retractable covering may be suspended from the head rail, and may include a bottom rail with vanes or slats disposed between the head rail and the bottom rail. The control system may include an operating element, such as a pull cord, to allow a user to operate to the control system. Operation of the control system causes the retractable covering to move. The present invention provides for a control system having a single operating element allowing a user to move the retractable covering between extended and retracted positions by imparting a repetitive motion to the operating element. For example, when the retractable covering is vertically disposed, a user can raise or lower the retractable covering by imparting a repetitive up and down motion to the pull cord. While the present invention is described below in connection with a covering of the type shown in FIG. 1, it is to be appreciated that the present invention is applicable to other types of devices for covering architectural openings.

Covering

Figure 1:
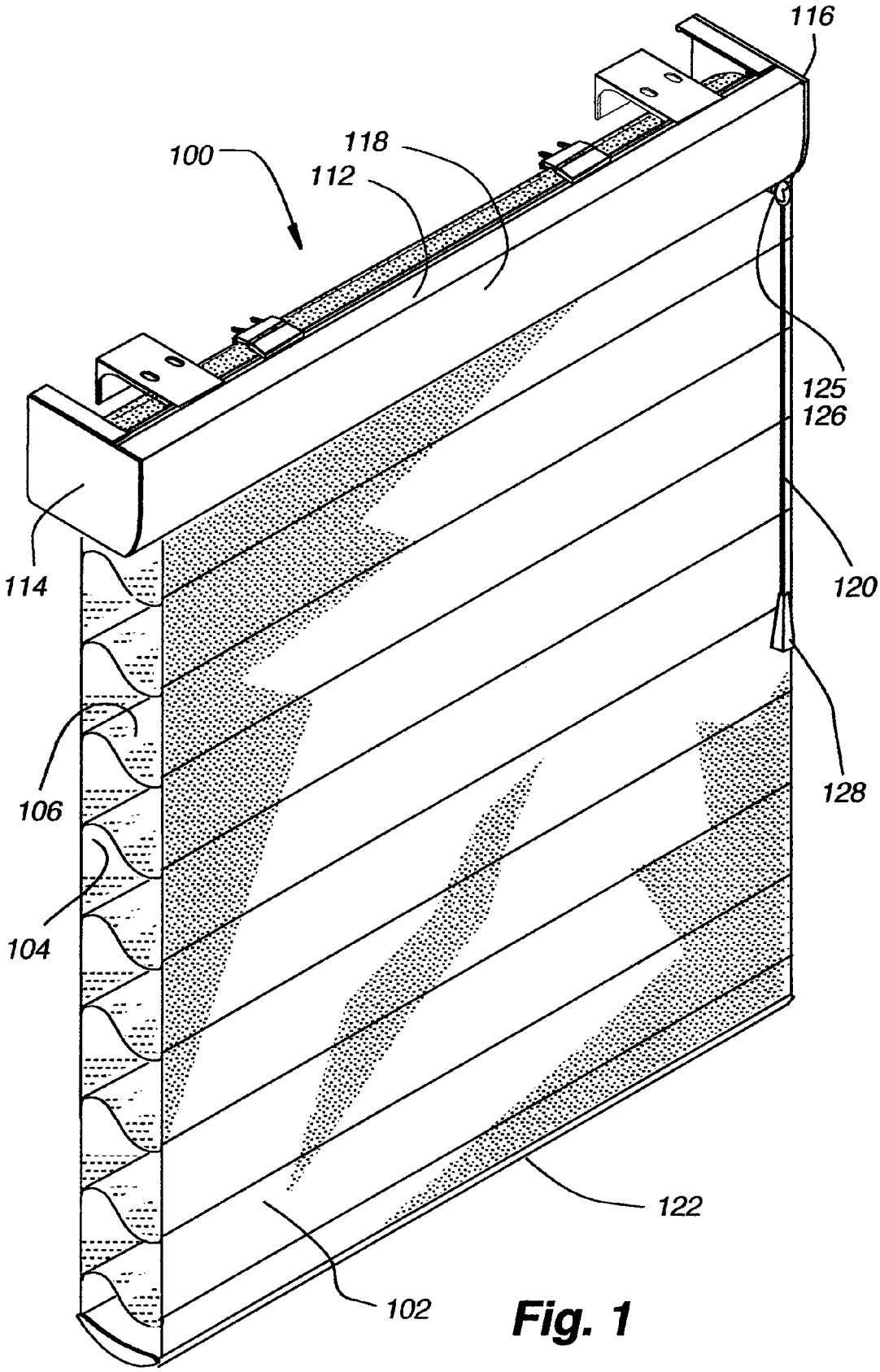
FIG. 1 is an isometric view of a covering for an architectural opening utilizing the present invention.
Figure 6:
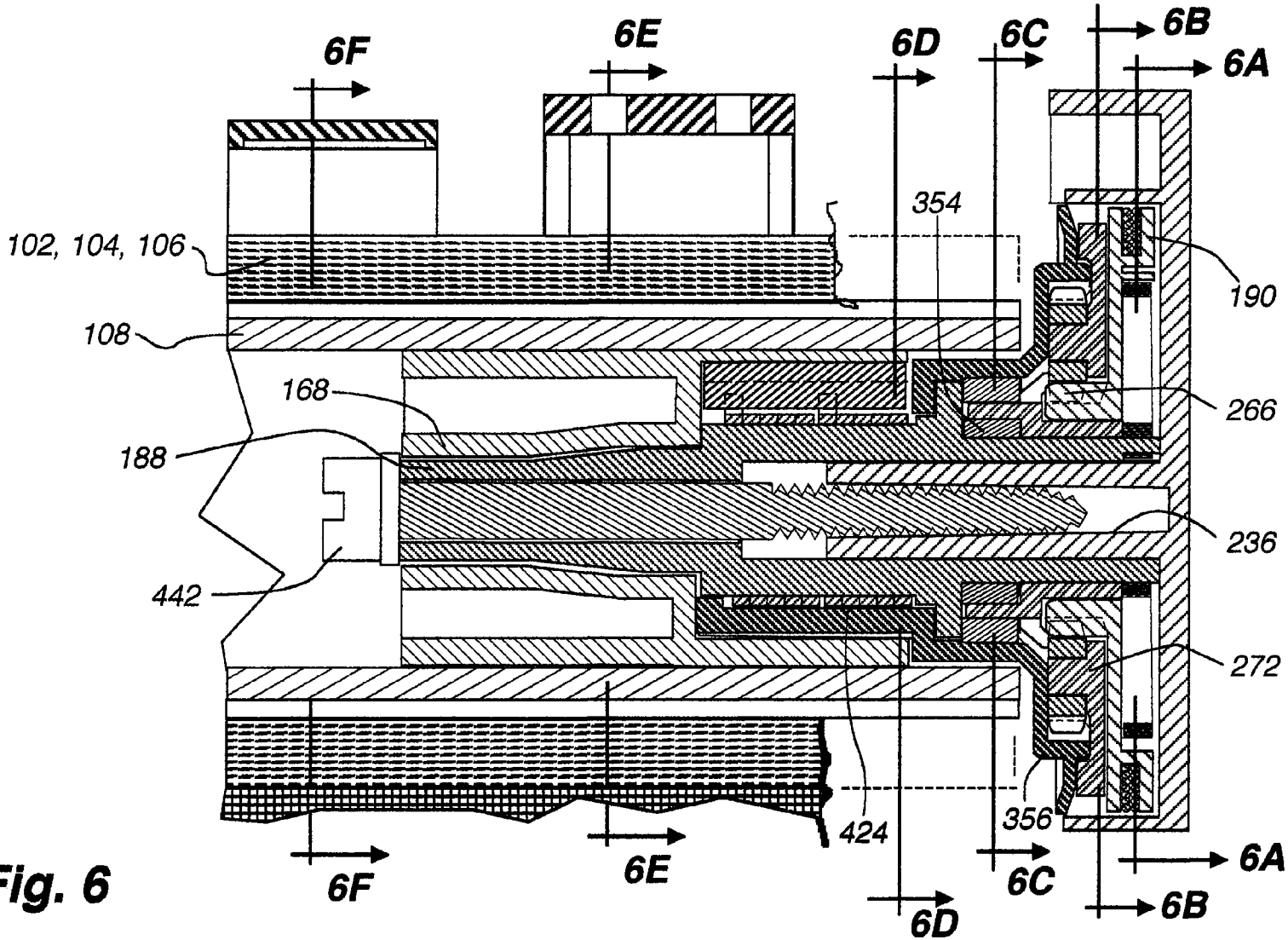
FIG. 6 is a cross-sectional view of the control system depicted in FIG. 4 engaged to lower the covering, taken along line 6—6.
Figure 6A:
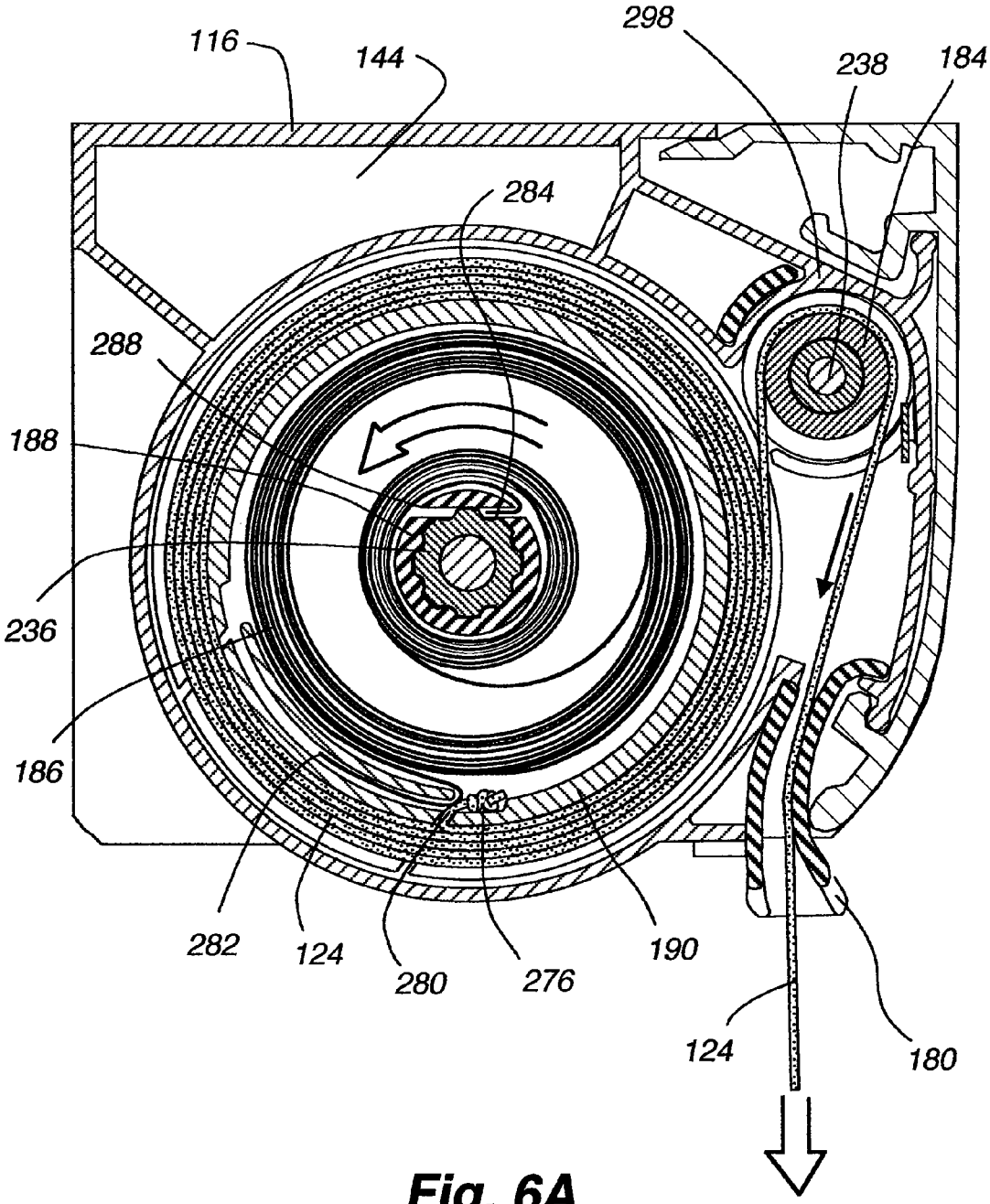
FIG. 6A is a cross-sectional view of the control system depicted in FIG. 6, taken along line 6A—6A.
Figure 6A:
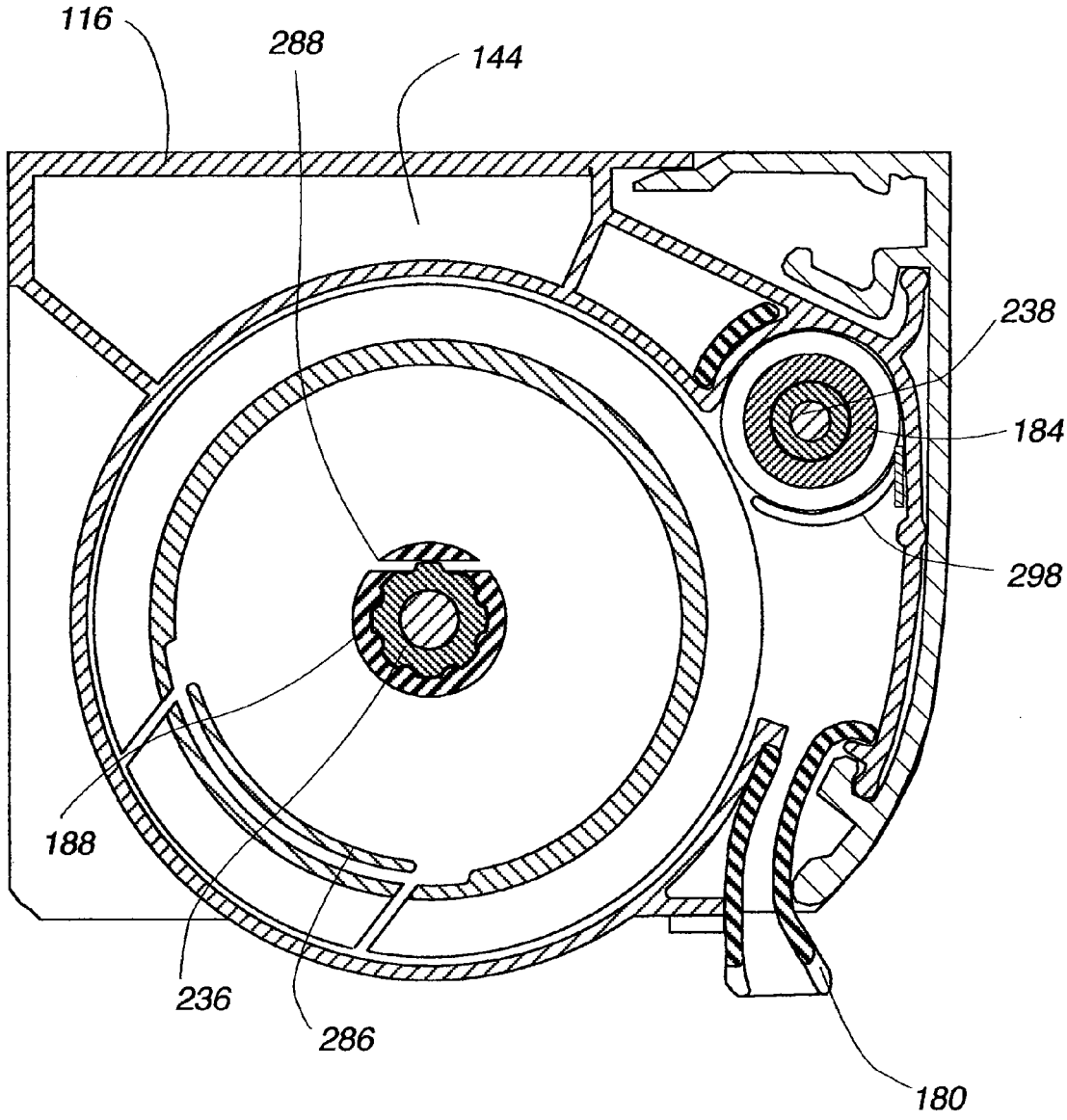
Figure 6B:
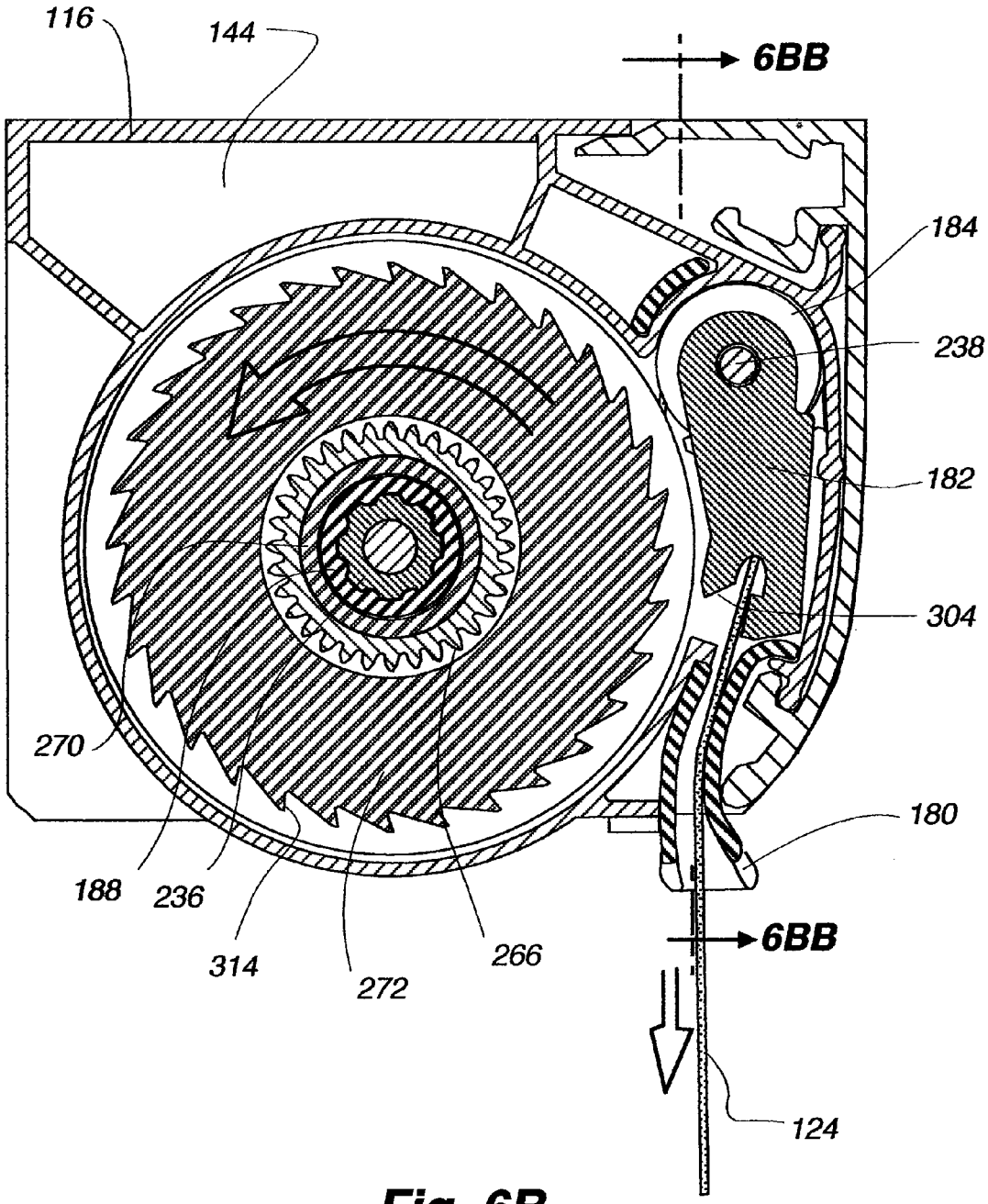
FIG. 6B is a cross-sectional view of the control system depicted in FIG. 6, taken along line 6B—6B.
Figure 6B:
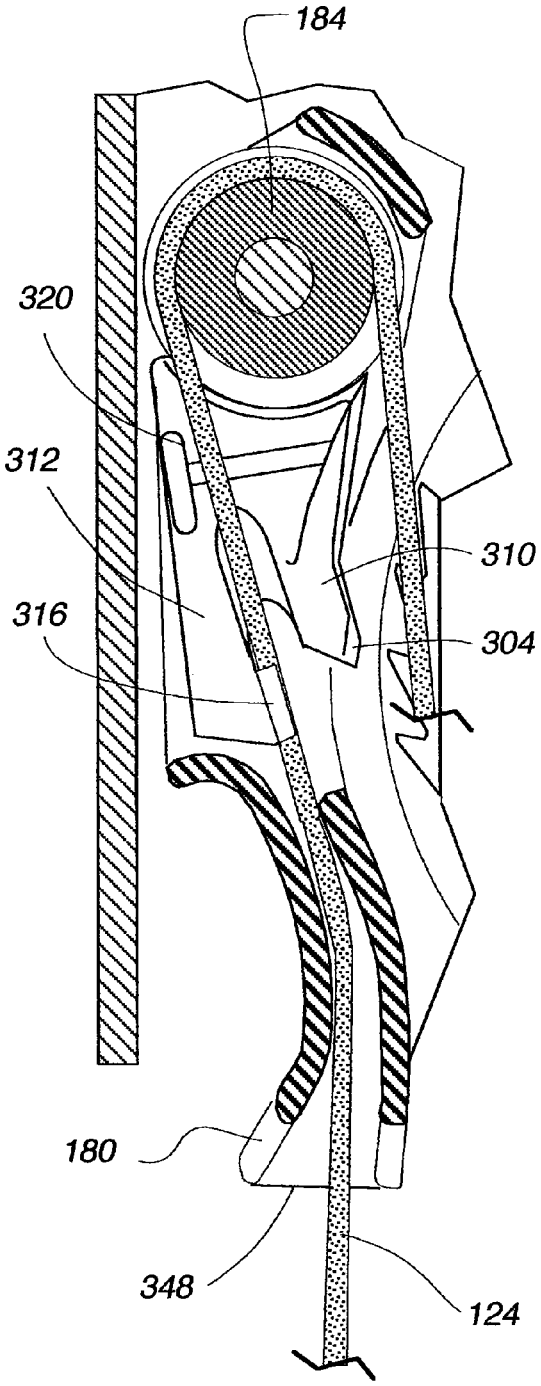
Figure 6B:
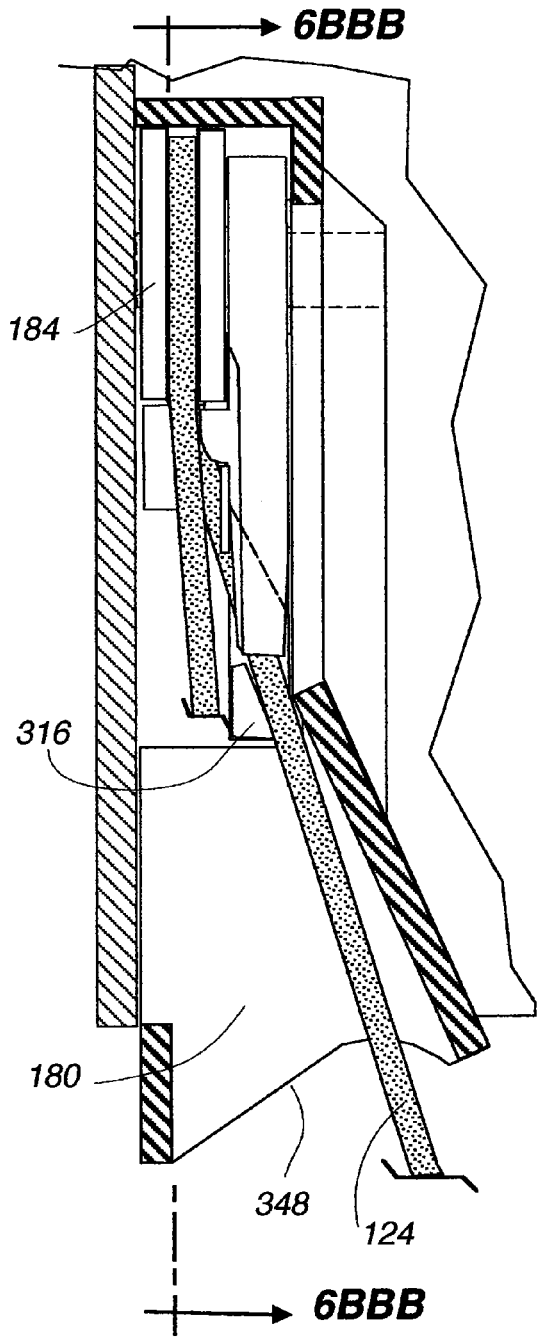

As shown in FIG. 1, the covering 100 includes a vertical first fabric sheet 102 parallel to a vertical second fabric sheet 104 which are interconnected by a plurality of horizontal spaced flexible fabric vanes 106. The covering 100 shown in FIG. 1 is also provided with a light control feature. The light control feature is affected through motion of the first sheet 102 relative to the second sheet 104 in a direction perpendicular to the fabric vanes 106. Relative motion between the first sheet and the second sheet changes the angle of the vanes, which in turn, controls the amount of light admitted through the covering. The covering may be configured to react in different ways in response to being lowered or raised. For example, the covering 100 shown in FIG. 1 opens (i.e. vanes are orthogonal to the first sheet and the second sheet) only when the covering is in a fully extended or lowered position, as shown in FIG. 6F. At any position, other than the fully extended position, the covering 100 is in a closed condition with the first fabric sheet 102 and the second fabric sheet 104 being movable vertically together and in close proximity being separated only by the vanes 106 which are disposed in flat substantially coplanar relationship between the sheets, as shown in FIG. 6E.

Figure 3:
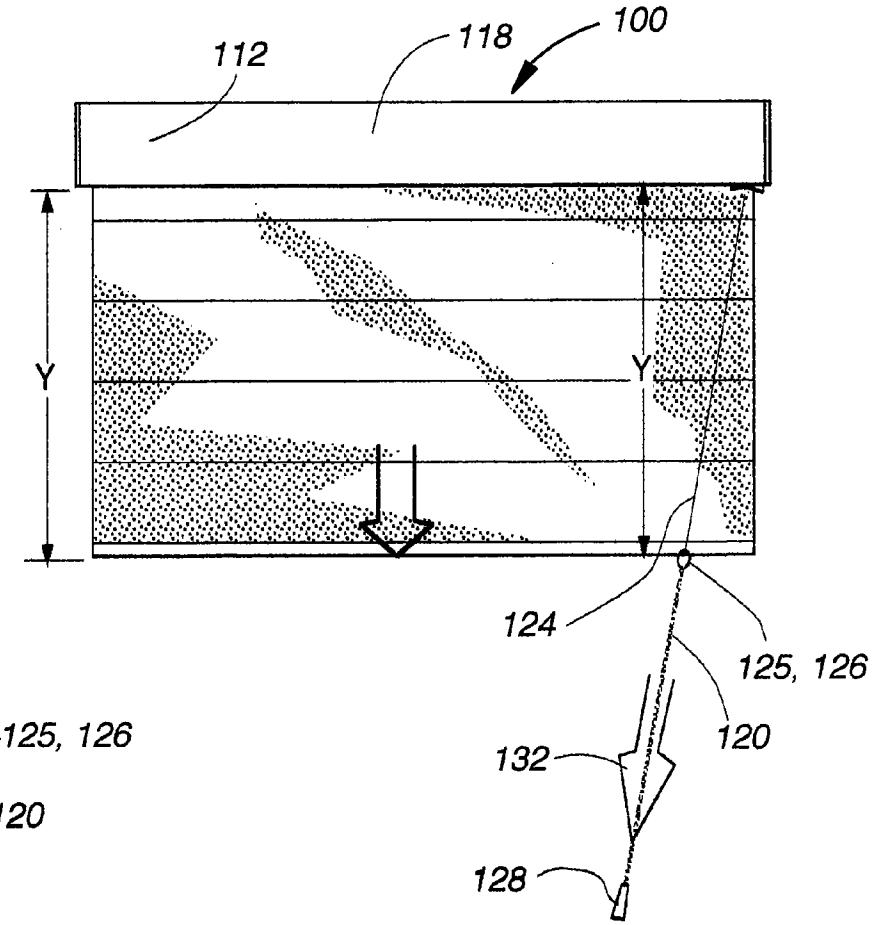
FIG. 3 is a front elevation view of the covering illustrating operation of the present invention to lower the covering.
Figure 2:
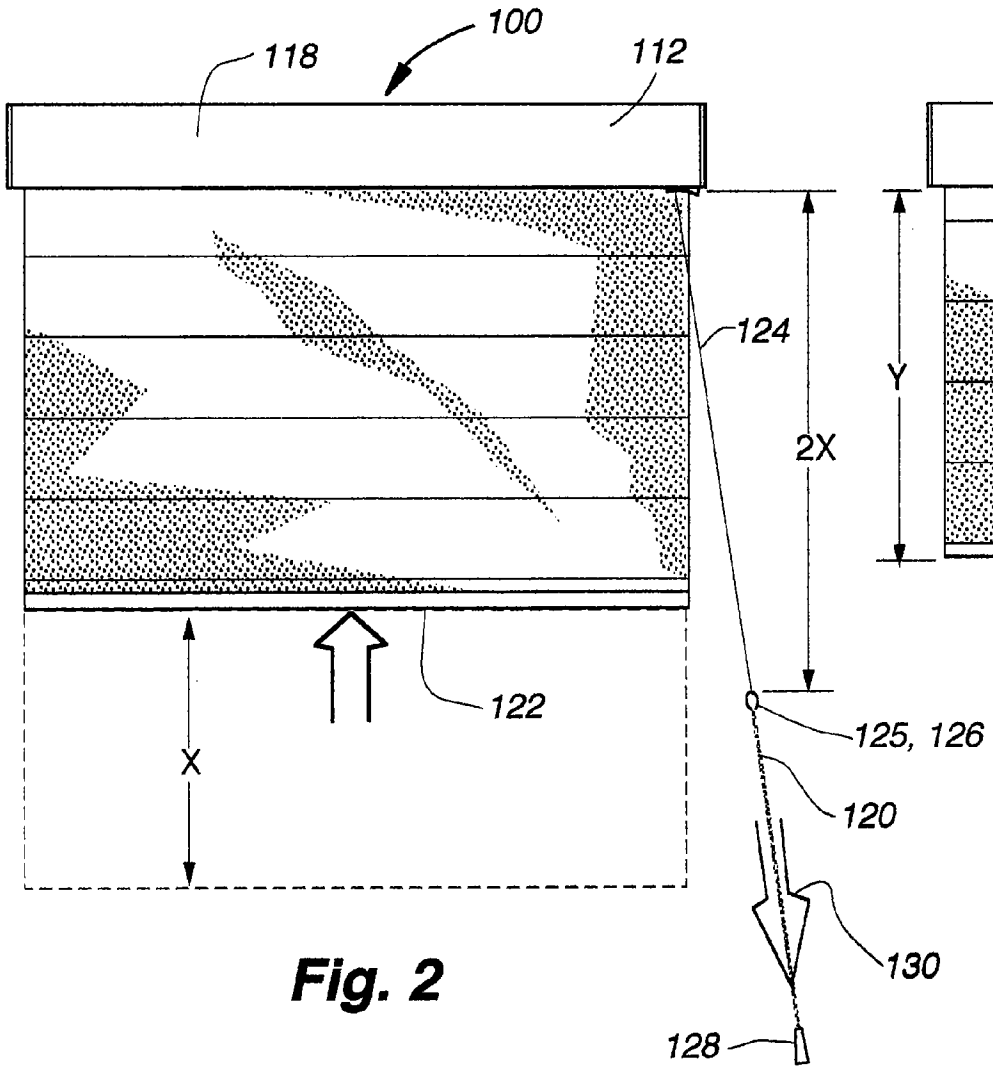
FIG. 2 is a front elevation view of the covering illustrating operation of the present invention to raise the covering.

The first fabric sheet 102 and the second fabric sheet 104 are suspended from a head roller 108 connected with a control system 110 and rotatably supported inside a head rail assembly 112. The head rail assembly 112 includes a left end cap 114 and a right end cap 116 connected with a front rail 118. A pull cord 120 is provided to allow a user to operate the control system 110 in order to raise or lower a bottom rail 122 of the covering 100. Operation of the control system 110 imparts rotational motion to the head roller 108, which in turn wraps the covering 100 onto the head roller 108 or unwraps the covering from the head roller, causing the bottom rail 122 to move up or down, respectively. As explained in more detail below, the pull cord 120 is connected to an operating cord 124 (see in FIGS. 2 and 3) through a stopper or coupler 125. Various types of stoppers or couplers 125 may be utilized. For example, the stopper or coupler 125 shown in FIGS. 2 and 3 is in the form of a releasable clasp 126. In another form, the stopper or coupler may be configured as knot in the operating element. When the control system is not in use, the operating cord 124 is retracted inside the head rail assembly 112. A tassel 128 may be also provided to allow a user to more easily grasp the pull cord 120 when operating the control system 110.

Control System

FIGS. 2, 3, 6E, 6F, 7E, and 7F illustrate how the control system 110 is operated to raise and lower the covering 100, respectively. Direction of movement of the covering, either upward or downward, is dictated by the generally downward direction in which the user pulls on the pull cord 120. More particularly, the downward direction in which the user pulls on the pull cord 120, which can be selectively angled, causes the control system 110 to engage and rotate the head roller 108 to either wrap or unwrap the covering 100, which causes the bottom rail 122 to move up or down, respectively. In addition, the control system 100 allows a user to repeatedly pull on the pull cord 120 in the same downward direction to place the covering in a desired position.

Figure 7:
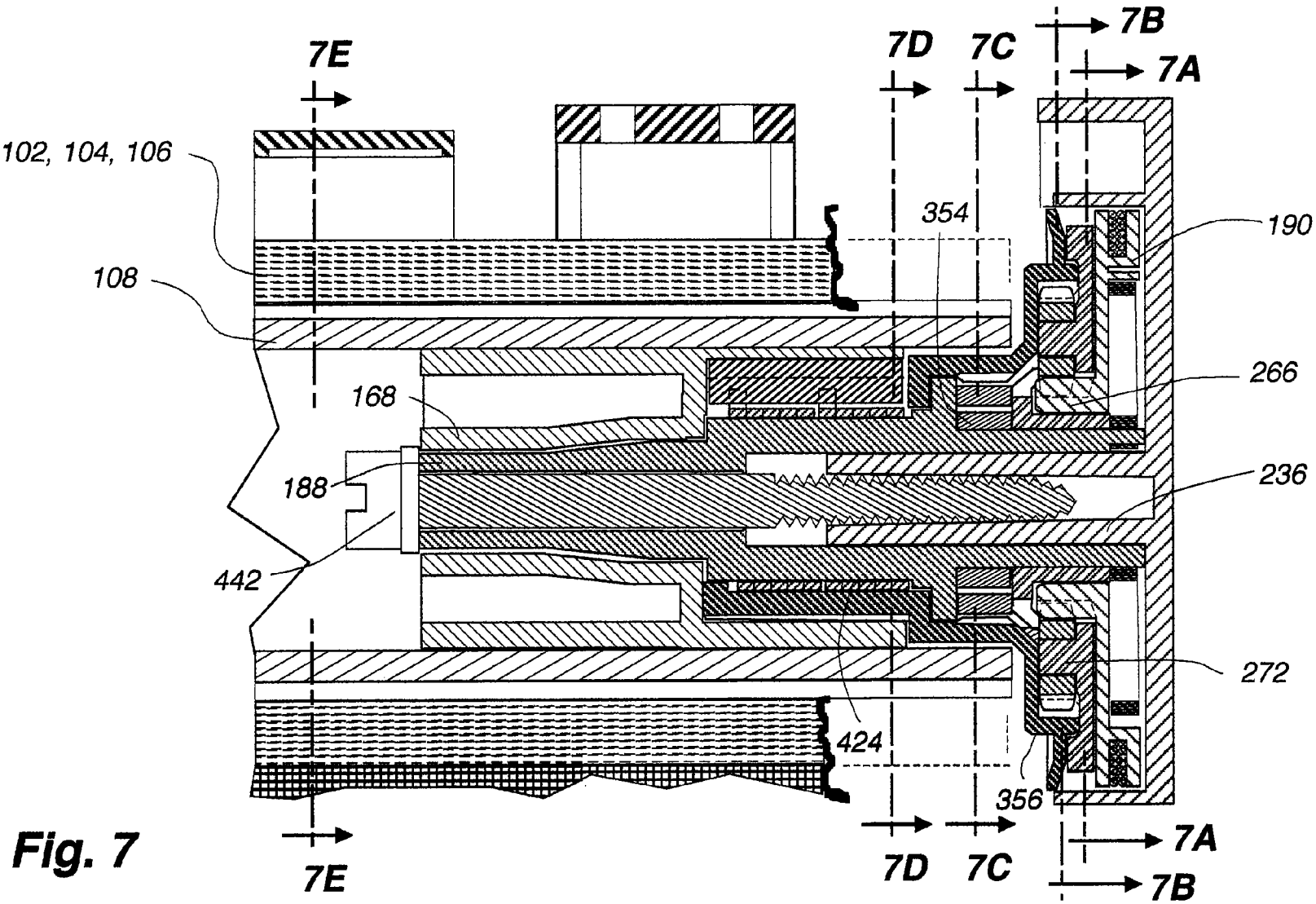
FIG. 7 is a cross-sectional view of the control system depicted in FIG. 4 engaged to raise the window covering, taken along line 7—7.
Figure 7A:
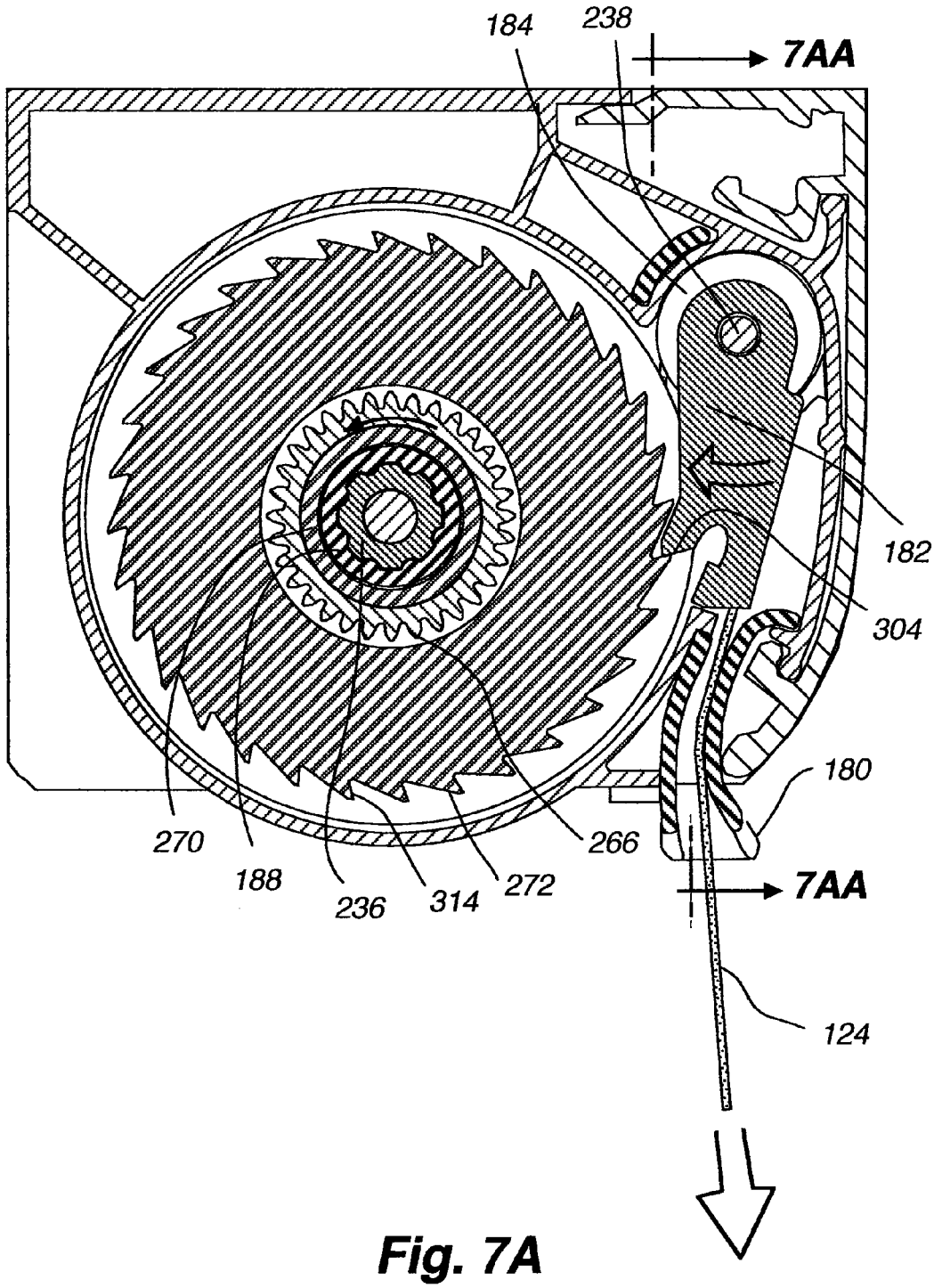
FIG. 7A is a cross-sectional view of the control system depicted in FIG. 7, taken along line 7A—7A.
Figure 7A:
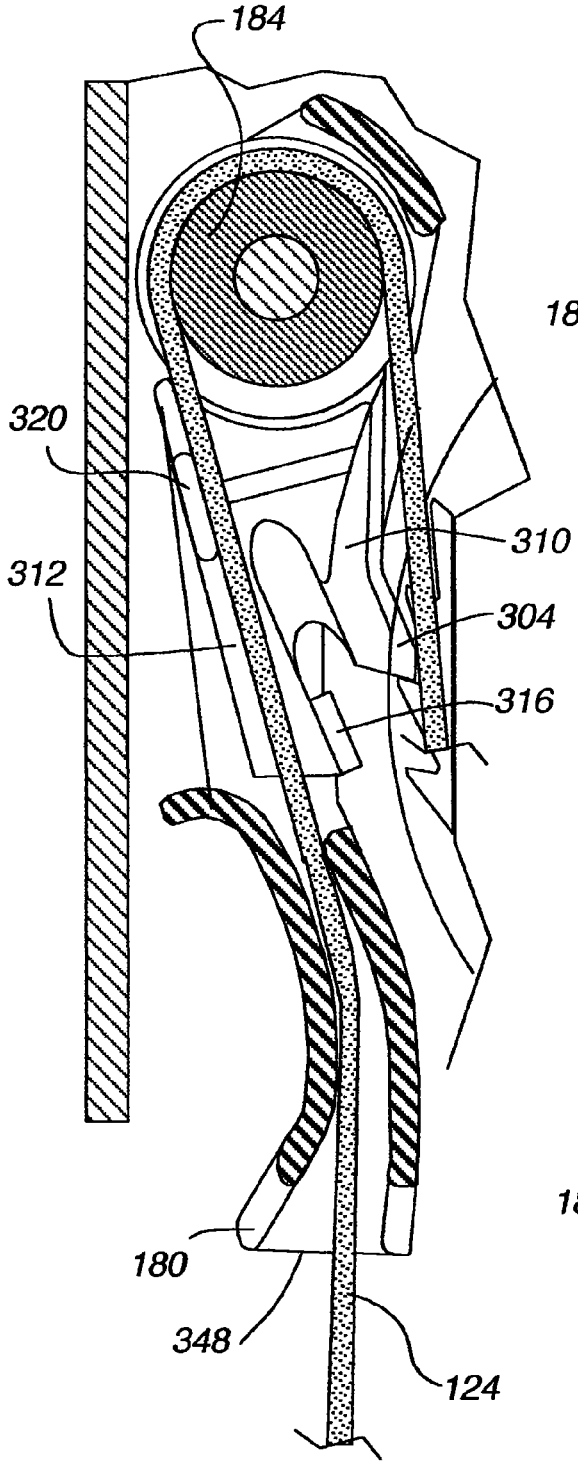
Figure 7A:
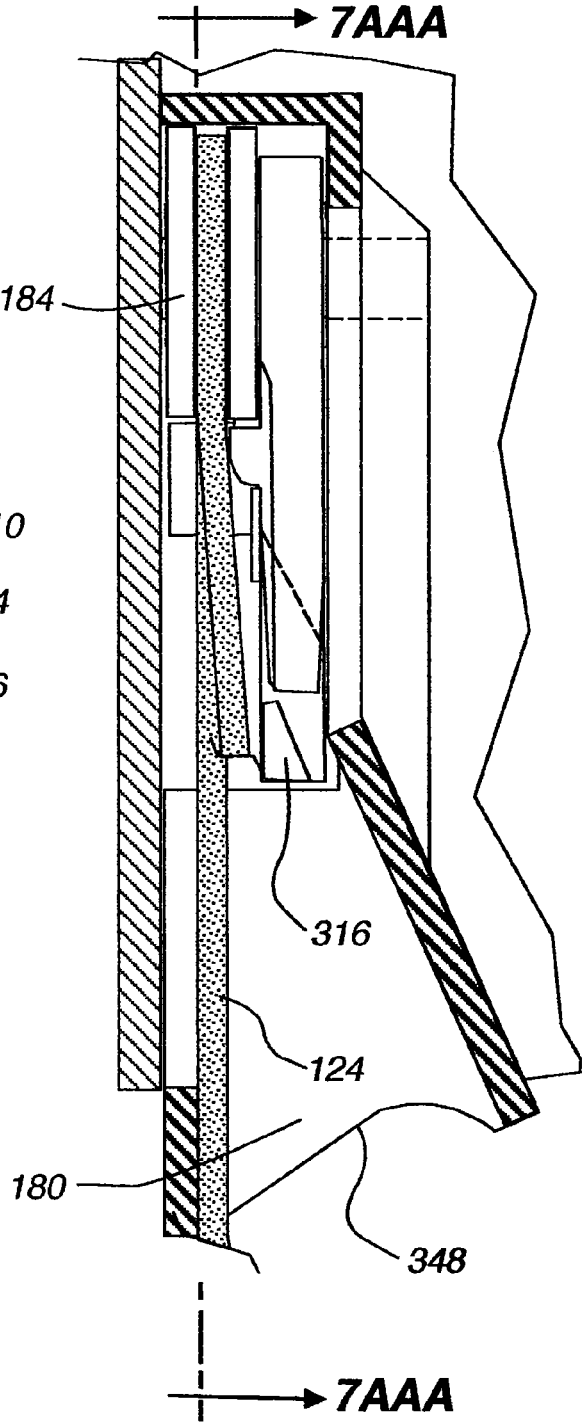
Figure 7B:
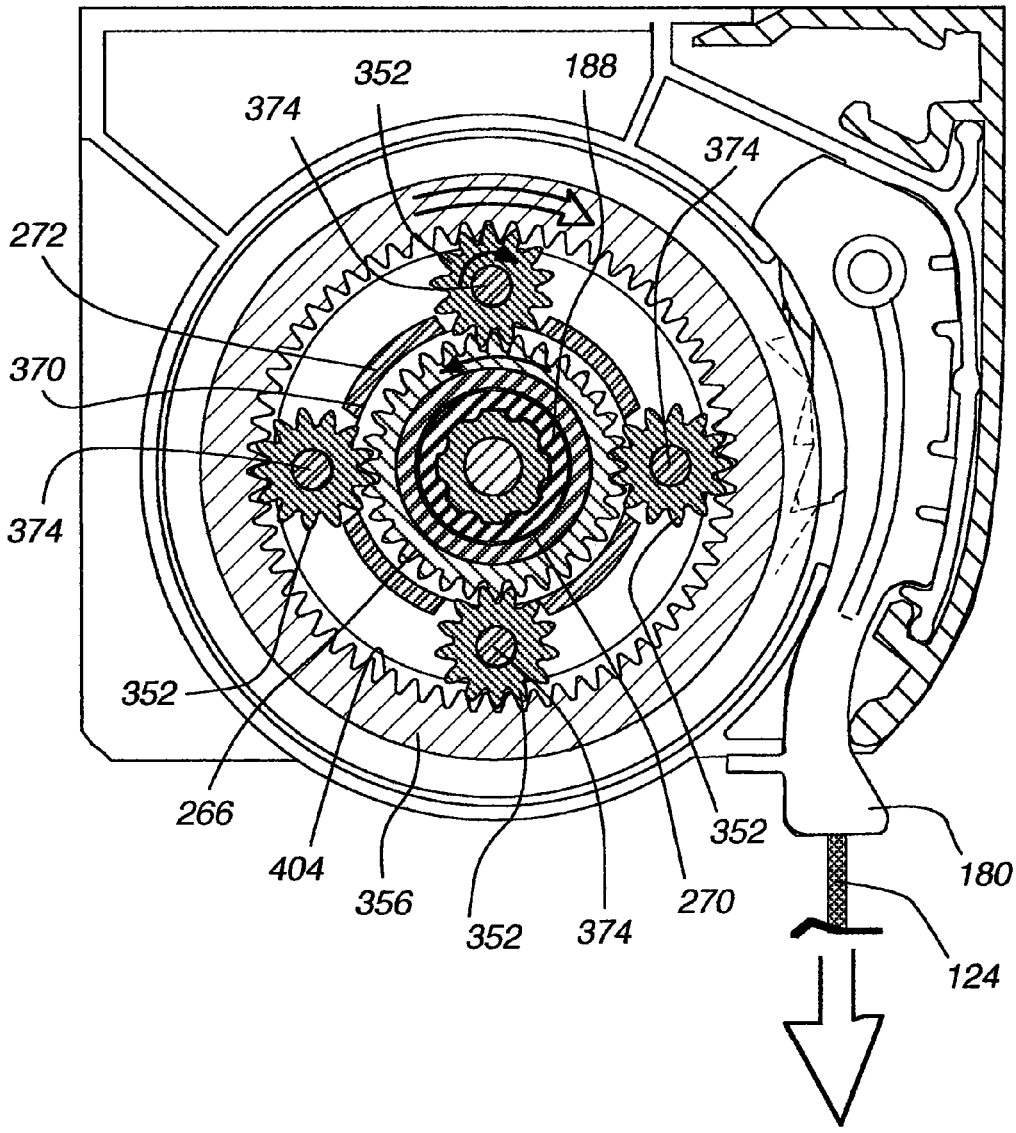
FIG. 7B is a cross-sectional view of the control system depicted in FIG. 7, taken along line 7B—7B.
Figure 7C:
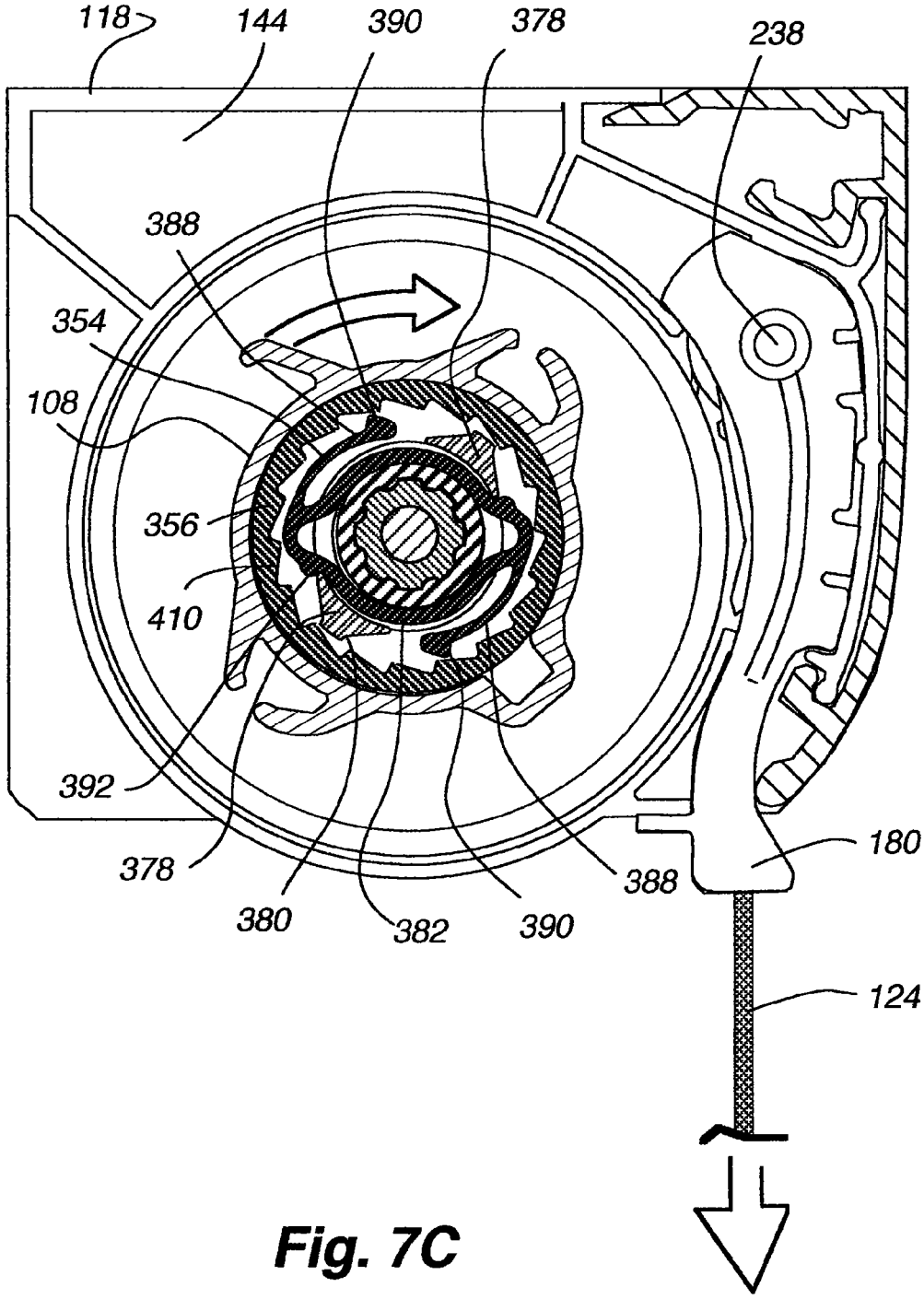
FIG. 7C is a cross-sectional view of the control system depicted in FIG. 7, taken along line 7C—7C.
Figure 7D:
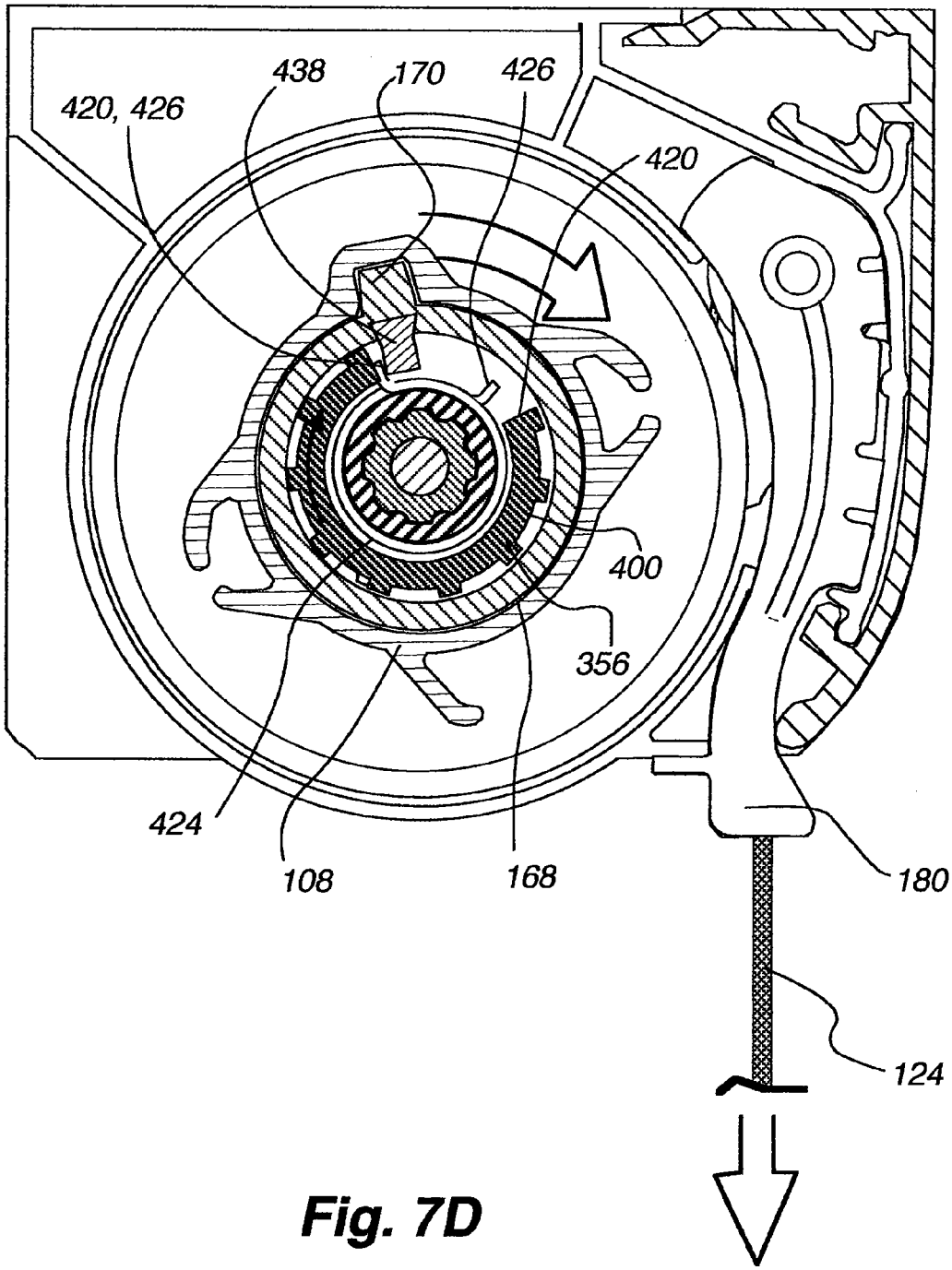
FIG. 7D is a cross-sectional view of the control system depicted in FIG. 7, taken along line 7D—7D.
Figure 7E:
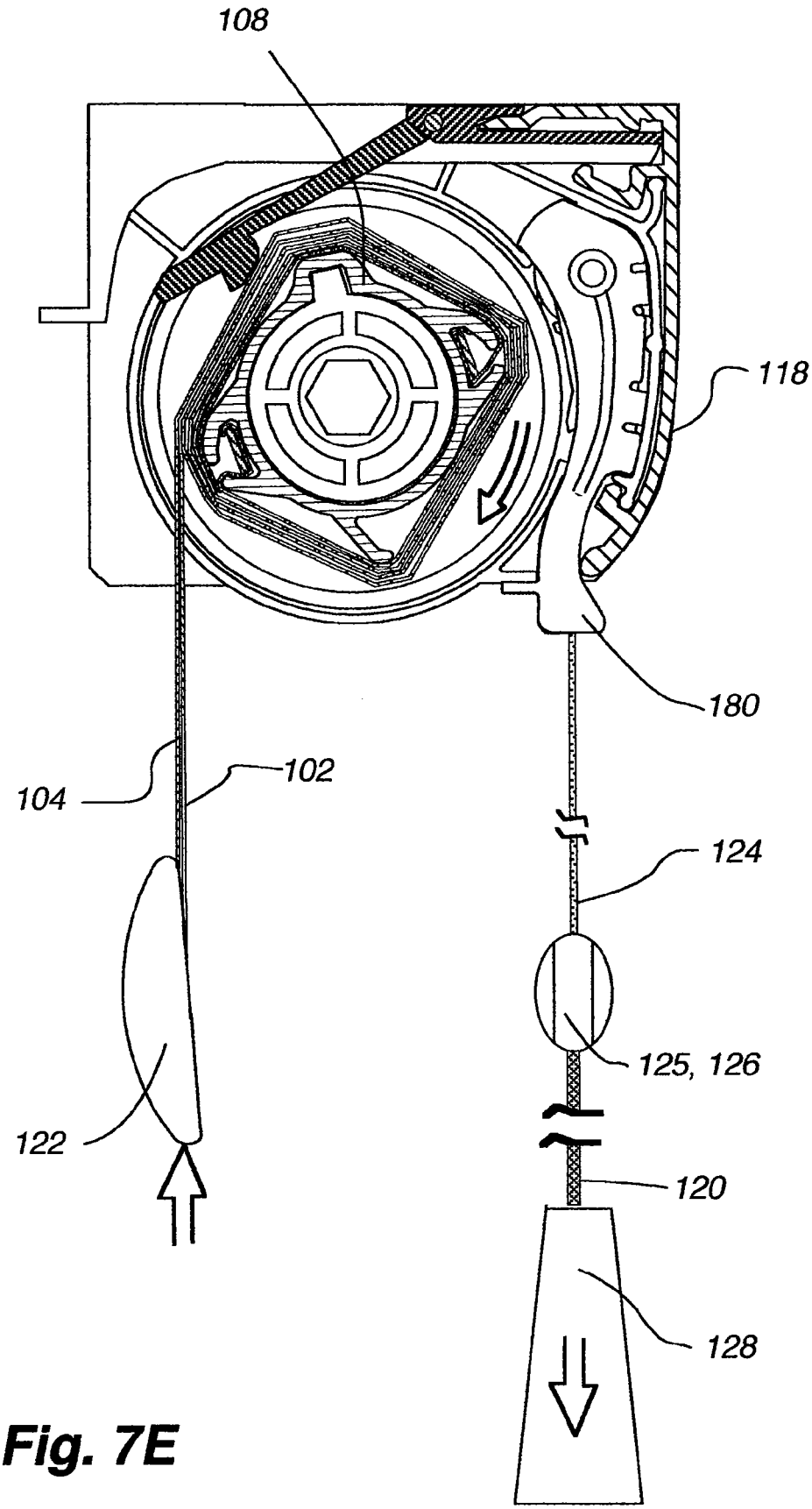
FIG. 7E is a cross-sectional view of the control system depicted in FIG. 7, taken along line 7E—7E illustrating operation of raising the covering.
Figure 7F:
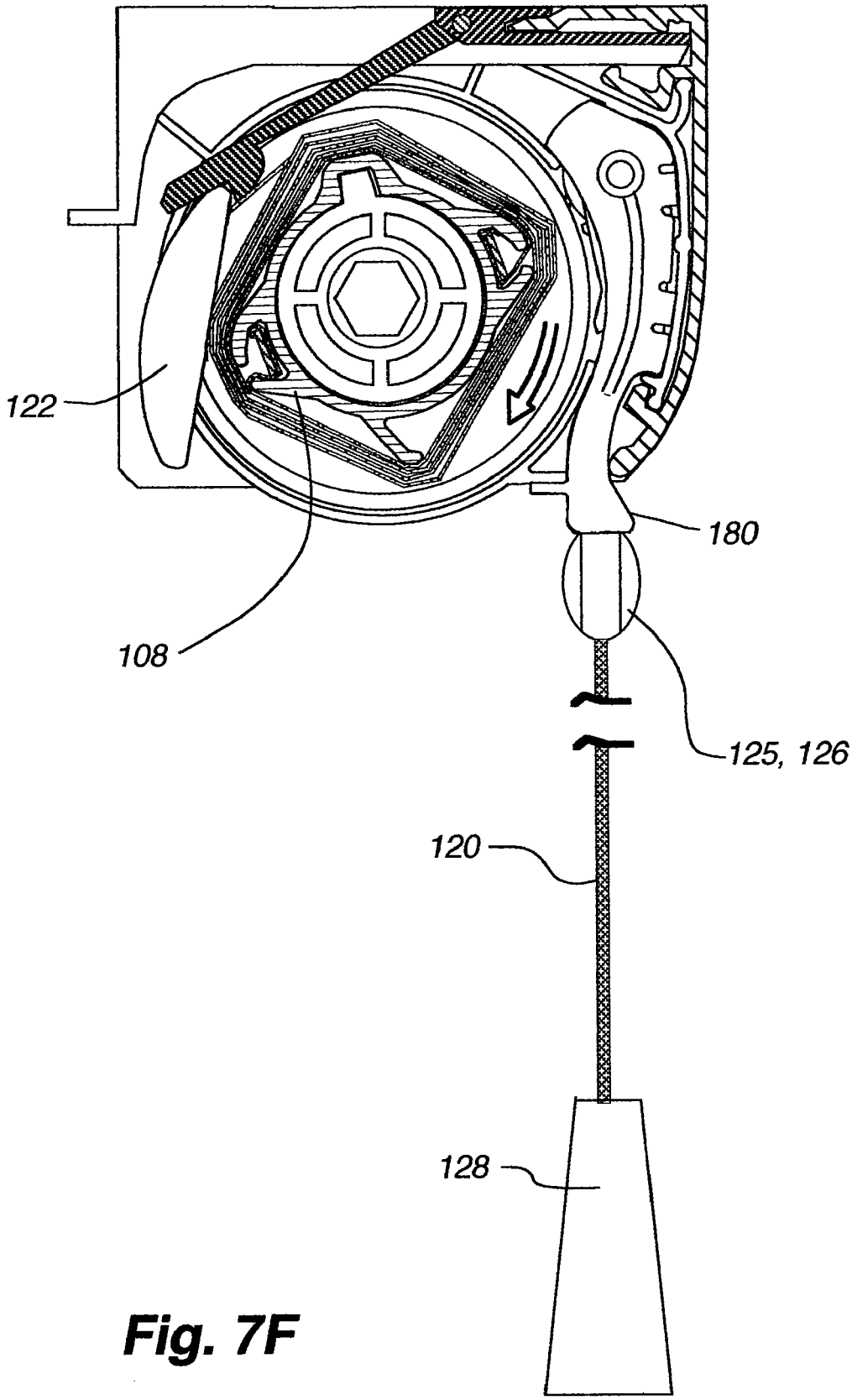
FIG. 7F is a view of the control system and covering depicted in FIG. 7E showing the covering in a fully retracted position.

In order to raise the covering 100, as shown in FIGS. 2, 7E, and 7F, a user grasps the pull cord 120 and pulls downwardly in a vertical direction with respect to the head rail assembly 112. The user may also pull downwardly in a slightly right angled diagonal direction to move the covering in the upward direction. As discussed in more detail below, by pulling downwardly either vertically or in the slightly right angled diagonal direction, both referred to as an upward operating pull direction 130, the control system 110 engages to rotate the head roller 108 in a direction to raise the covering 100. As the user pulls on the pull cord 120 in the upward operating pull direction 130, the operating cord 124 is pulled from the control system 110 housed in the head rail assembly 112. The distance a user may pull the pull cord 120 and operating cord 124 is limited by the length of the operating cord. Once the user releases the pull cord, the control system automatically retracts the operating cord back into the head rail assembly until the stopper or coupler 125 abuts the head rail assembly.

As shown in FIGS. 2, 7E, and 7F, the upward distance which the bottom rail 122 moves is dictated by the distance which the pull cord 120 and operating cord 124 are pulled along with a mechanical advantage provided by the control system 110. The control system 110 may be mechanically configured in different ways so as to vary a first upward distance the covering moves in response to a second distance which the operating cord is pulled. As such, the control system may be configured with increased mechanical advantage and reduced speed when raising the covering, and with increased speed in the downward direction when operating force requirements are less. For example, as shown in FIG. 2, the control system 110 can be configured with a 2:1 mechanical advantage such that in order to move the covering a first upward distance of "X," the operating cord 124 must be pulled a second distance of"2X."

Once the bottom rail 122 is raised to the desired position, the user may release the pull cord 120. Upon release of the pull cord, the operating cord is automatically retracted into the head rail assembly 112 by the control system 110. The control system also includes a braking feature to hold the covering in position once the user releases tension from the pull cord. If the user pulls the pull cord such that the operating cord is extended to its full length, and the bottom rail does not move the desired distance upward, the user can allow the operating cord to retract into the head rail and then pull again on the pull cord to continue raising the bottom rail 122. This process can be repeated until the bottom rail 122 has reached the desired position.

In order to lower the covering, as shown in FIGS. 3, 6E, and 6F, a user grasps the pull cord 120 and pulls downward in a slightly left angular diagonal direction to move the covering in the downward direction, also referred to as the downward operating pull direction 132. As discussed in more detail below, by pulling in the downward operating pull direction 132, the control system 110 engages to rotate the head roller 108 in a direction to lower the covering. As the user pulls on the pull cord in the downward operating pull direction 132, the operating cord 124 is pulled in unison from the control system 110 housed in the head rail assembly 112. The distance a user may pull the pull cord 120 and operating cord 124 is limited by the length of the operating cord, and the control system automatically retracts the operating cord back into the head rail assembly until the stopper or coupler 125 abuts the head rail assembly once the user releases the pull cord.

As shown in FIGS. 3, 6E, and 6F, the downward distance which the bottom rail 122 moves is dictated by the distance which the pull cord 120 and operating cord 124 are pulled along with the mechanical advantage provided by the control system. As similarly described above with reference to upward movement of the covering, the control system 110 may be mechanically configured in different ways so as to vary a first downward distance the covering moves in response to a second distance which the operating cord is pulled. For example, as shown in FIG. 3, the control system 110 can be configured with a 1:1 mechanical advantage such that in order to move the covering a first downward distance of "Y," the operating cord 124 must be pulled a distance of "Y." The present invention can be configured to provide identical or different mechanical advantages in the control system for upward and downward movement of the covering 100.

Once the bottom rail 122 is lowered to the desired position, the user may release the pull cord 120. Upon release of the pull cord, the operating cord 124 is automatically retracted into the head rail assembly 112 by the control system 110. The control system's braking feature mentioned above holds the covering in position once the user releases tension from the pull cord. If the user pulls the pull cord such that the operating cord is extended to its full length, and the bottom rail does not move the desired distance downward, the user can allow the operating cord to retract into the head rail and then pull again on the pull cord to continue lowering the bottom rail. This process can be repeated until the bottom rail has reached a desired position.

Head Roller and Covering Connected Thereto

Figure 4:
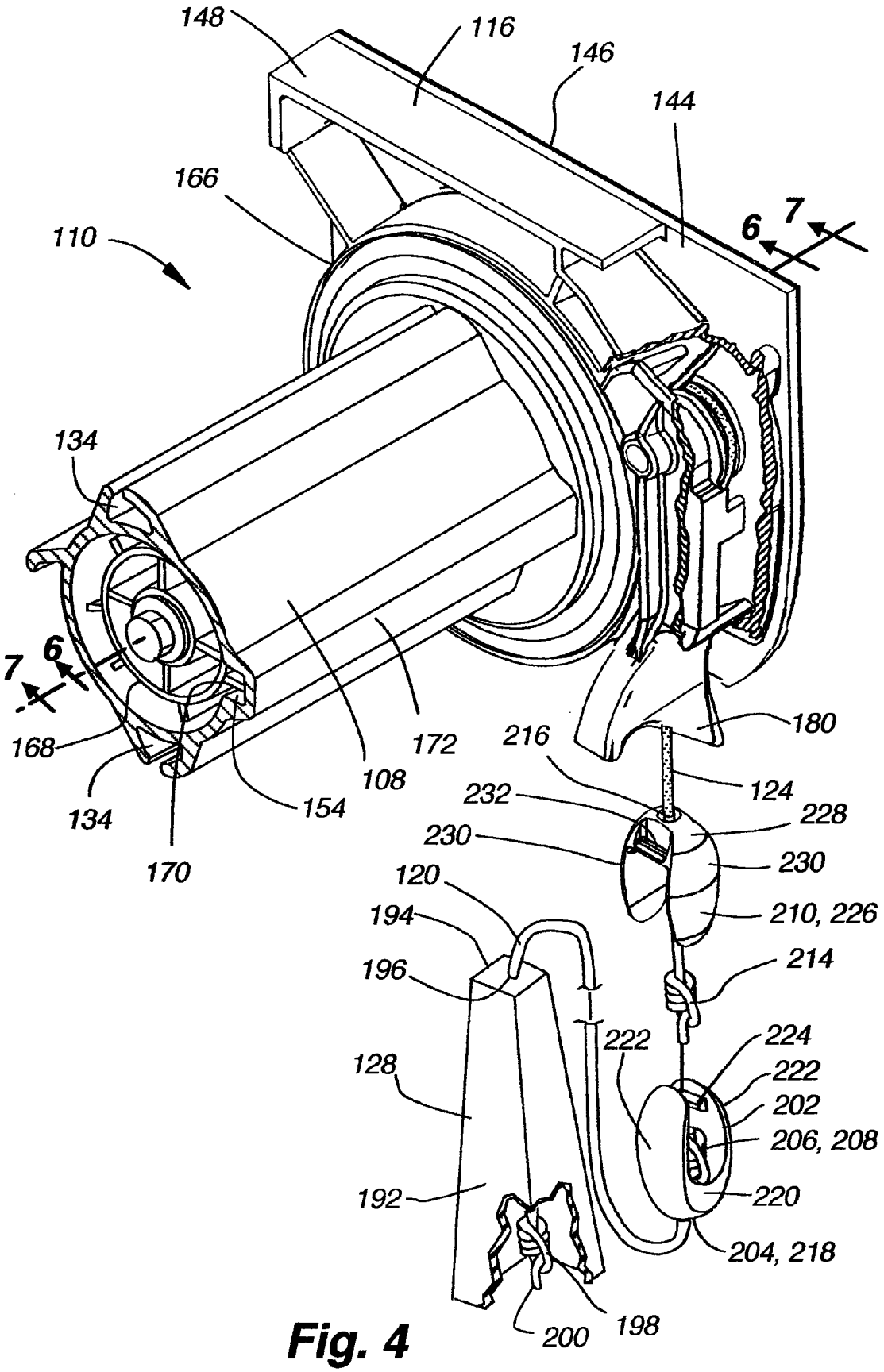
FIG. 4 is an isometric view of a control system for the covering according to one embodiment of the present invention mounted on a right end cap and connected with a head roller of the covering.
Figure 5A:
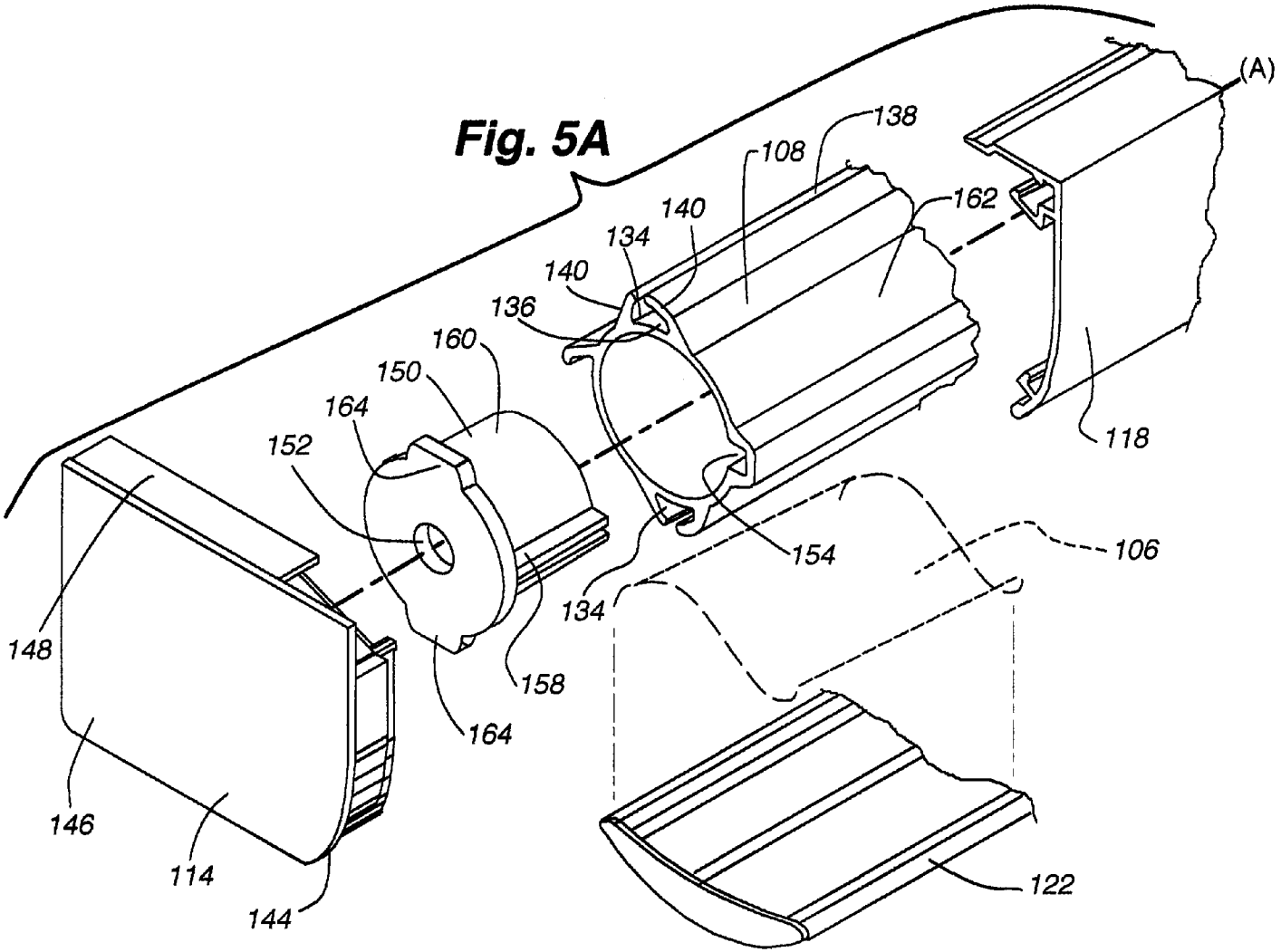
FIG. 5A is an exploded isometric view of a left end portion of a head rail assembly.

As previously mentioned, the covering 100 is connected with the head roller 108, and depending upon which direction the head roller rotates, the covering 100 is either wrapped onto the head roller 108 or unwrapped from the head roller 108. As shown in FIGS. 4, 5A, and 6F, the head roller 108 is hollow and generally tubular-shaped. The head roller is provided with two exterior channels 134 each having a wide inner space 136 and a narrow opening 138 defined by opposing walls 140 on the outer surface of the head roller 108 extending longitudinally along the entire length of the head roller 108. The first fabric sheet 102 and the second fabric sheet 104 of the covering 100 are provided with flat strips 142 adapted to fit inside the wide inner spaces 136 of the exterior channels 134 and held in position by walls 140 of the exterior channels 134. The flat strips 142 can be made from stiff material, such as metal or plastic. The first fabric sheet 102 and the second fabric sheet 104 are connected with the head roller 108 by sliding the flat strips 142 into the exterior channels 134 from either end of the head roller 108, such that the first fabric sheet 102 and the second fabric sheet 104 exit the exterior channels 134 through the narrow opening 138. It is to be appreciated that the head roller 108 and the covering 100 may utilize various configurations to connect the head roller with the covering. For example, other such configurations are described in U.S. Pat. No. 5,320,154, which is hereby incorporated in its entirety as if fully disclosed herein.

Head Rail Assembly

As shown in FIGS. 4 and 5A, the left end cap 114 and the right end cap 116 fasten to cut edges of the front rail 118. The left end cap 114 and the right end cap 116 also have an inner side 144 and outer side 146. Extended edges 148 extend perpendicularly from the inner sides 144 of the left end cap 114 and the right end cap 116 and are adapted to be press fit into slots located on the front rail 118. It is to be appreciated that extended edges may be configured differently for various shaped front rails. The head roller 108 is supported from the head rail assembly 112 by the control system 110 connected with the right end cap 116 and a cylindrical extension 150 rotatably connected with the left end cap 114. Although the present invention is depicted and described with the control system connected with the right end cap, it is to be appreciated that the control system may also be connected with the left end cap in other arrangements of the invention.

Head Roller Support

Referring to FIG. 5A, the cylindrical extension 150 is supported on a rotatable left end cap shaft (not seen) extending from the inner side 144 of the left end cap 114 through an extension aperture 152 located in the cylindrical extension 150. A fastener (not shown) passing into the extension aperture 152 may be used to secure the cylindrical extension 150 to the left end cap shaft. As such, the cylindrical extension 150 can freely rotate either clockwise or counterclockwise. A longitudinal inner groove 154 is located on the inner wall 156 of the head roller 108 and extends the entire length of the head roller. Two longitudinal spaced ridges 158 on the exterior surface 160 of the cylindrical extension 150 are adapted to be received in the longitudinal inner groove 154 on a left end portion 162 of the head roller 108. As such, the cylindrical extension 150 rotates along with the head roller 108. The cylindrical extension 150 is also provided with two radially extending tabs 164 to prevent the flat strips 142 from moving longitudinally inside the exterior channels 134 on the head roller 108.

Figure 5B:
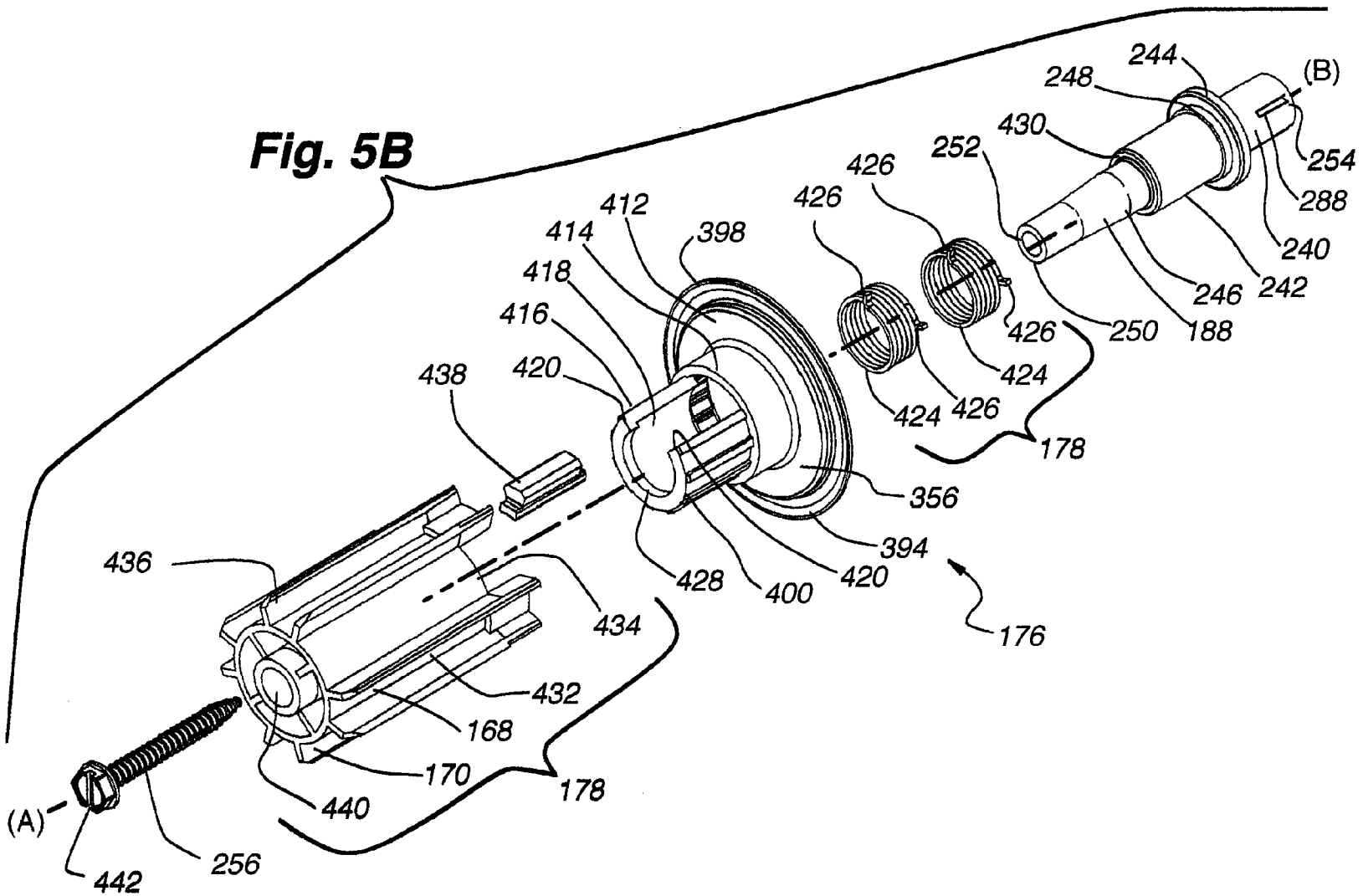
FIGS. 5B and 5C are an exploded isometric view of the control system according to one embodiment of the present invention.
Figure 5C:
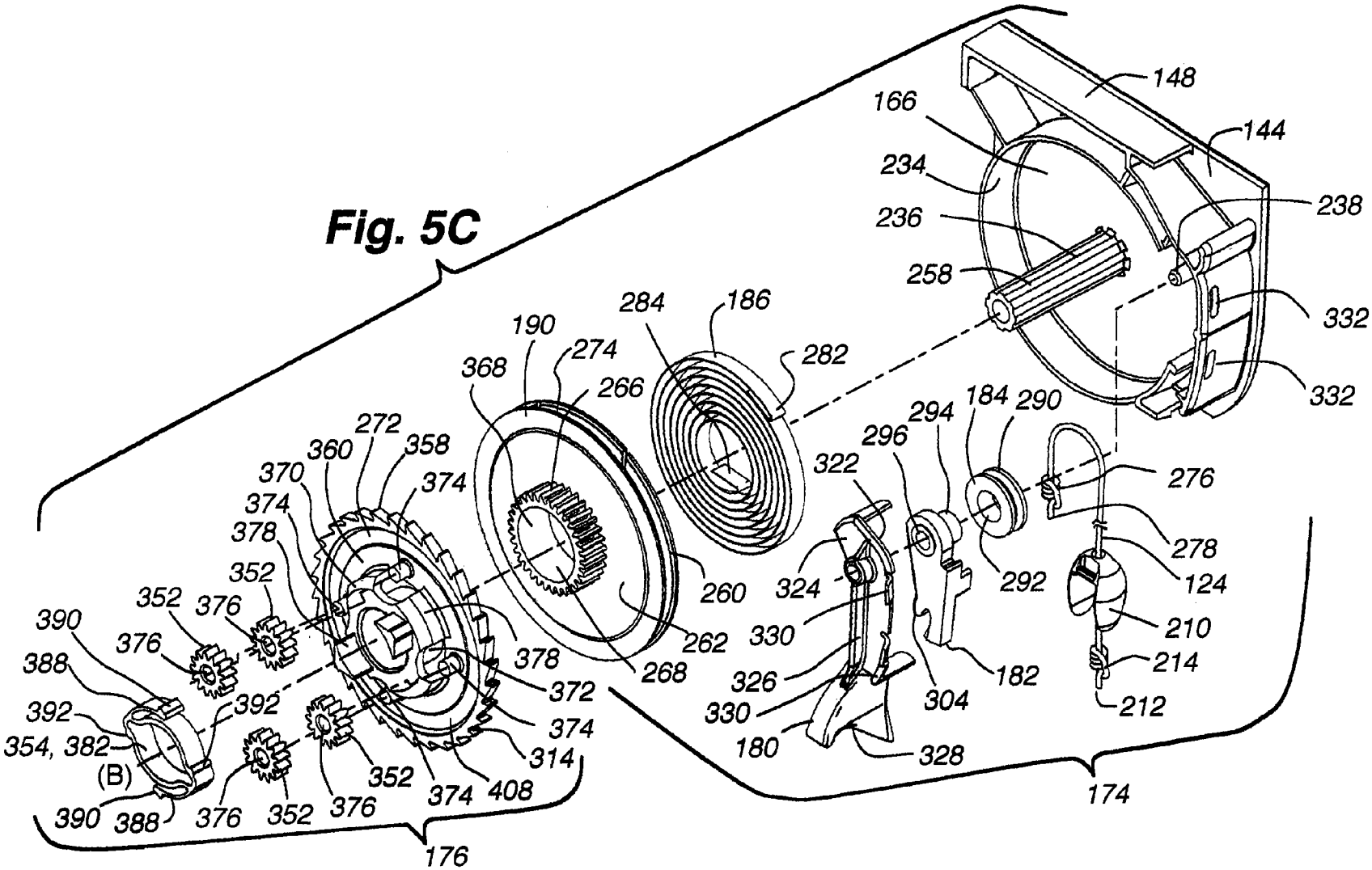

As shown in FIGS. 4 and 5C, and discussed in more detail below, a circular recess 166 is located on the inner side 144 of the right end cap 116 for receiving a portion of the control system 110. A rotator spool 168 (FIGS. 4 and 5B), as will be described in more detail later, whose rotation is controlled by the control system 110, includes a longitudinal fin 170 located on its exterior adapted to cooperatively engage the longitudinal inner groove 154 at a right end portion 172 of the head roller 108. As such, rotation of the rotator spool 168 causes the head roller 108 to rotate.

Control System Assembly Structure Overview

The control system 110 includes an input assembly 174, a transmission 176, and an output assembly 178 cooperatively engaging to convert linear movement of the pull cord 120 imparted by a user into rotational movement of the head roller 108 in the required direction to provide movement of the covering 100 in the desired direction and distance. The input assembly 174 converts linear movement of the pull cord 120 into rotational movement, which is imparted to the transmission 176. The input assembly 174 also engages the transmission 176 to effect the direction of rotational output from the transmission 176. The transmission 176, in turn, imparts rotational movement to the output assembly 178. The output assembly 178 interfaces with the head roller 108 to rotate the head roller in the direction dictated by the transmission 176 and to provide the braking feature that holds the head roller in position. It is to be appreciated that rotational movement transferred between the input assembly, the transmission, and output assembly may accomplished with any suitable motion transfer elements, such as a gears and couplings. It is to be appreciated that the components described herein may be constructed from various materials. For example, some embodiments of the present invention utilize materials having the low flexible modulus characteristics of a thermoplastic elastomer polymer. Another embodiment utilizes high density polyethylene.

A detailed structural description of the input assembly 174 is provided below, followed by detailed descriptions of the transmission 176 and the output assembly 178. To assist in better understanding the structural details of the control system, reference is made throughout to the various figures depicting the control system in disassembled and assembled states. For instance, FIGS. 5B and 5C show an exploded isometric view of the control system. FIG. 6 is a cross-sectional view of the assembled control system depicted in FIG. 4 engaged to lower the window covering, taken along line 6—6. FIGS. 6A–6F depict various cross sectional views taken along the length of the control system depicted in FIG. 6. FIG. 7 is a cross-sectional view of the assembled control system depicted in FIG. 4 engaged to raise the covering, taken along line 7—7. FIGS. 7A–7F depict various cross sectional views taken along the length of the control system depicted in FIG. 7. Descriptions of the rotations of various components of the control system (i.e. clockwise or counterclockwise) are always based on the reference point of looking toward the inner side of the right end cap.

Input Assembly Overview

The structure and operation of the input assembly 174 will now be discussed in detail. As shown in FIGS. 4 and 5C, the input assembly 174 includes the pull cord 120 connected with the operating cord 124 through the stopper or coupler 125, a cord guide arm 180, a shift arm 182, a cord pulley 184, a clock spring 186, an axle 188, and a cord spool 190, all cooperatively engaging to convert linear movement of the pull cord 120 into a rotational movement of the cord spool 190, which is imparted to the transmission 176. As discussed in more detail below, the operating cord 124 extends from the stopper or coupler 125 and passes through the cord guide arm 180, the shift arm 182, and the pulley 184 from where it is wrapped around the cord spool 190. As a user pulls on the pull cord 120 to move the covering 100 in the desired direction, the operating cord 124 is unwound from the cord spool 190. As will be described in detail later, after the user releases tension from the pull cord 120 and operating cord 124, the clock spring 186, cord spool 190, and axle 188 cooperatively engage to automatically wind the operating cord 124 back onto the cord spool 190. The operating cord 124 is automatically retracted to a point where the stopper or coupler 125 abuts the cord guide arm 180. Depending on whether the user pulls the pull cord in the upward operating pull direction 130 or the downward operating pull direction 132, the shift arm 182 pivots to engage the transmission 176, which in turn, dictates the direction in which the head roller 108 is rotated.

Tassel

As shown in FIG. 4, a tassel 128 may be connected with the pull cord 120 to allow a user to more easily grasp the pull cord when operating the control system 110. Various tassel configurations may be utilized. For example, the tassel 128 shown in FIG. 4 has four sides 192 sloping toward each other and connecting with a flat top surface 194 having a tassel cord aperture 196 located therein. The pull cord 120 extends from a first knot 198 located at a first end 200 of the pull cord 120 and from the inside of the tassel 128 through the tassel cord aperture 196. The first knot 198 is tied such that it is too large to pass through the tassel cord aperture 196. As such, the first knot 198 engages the flat top surface 194 from inside the tassel 128 in order to connect the tassel with the pull cord. The tassel 128 can be constructed from various type of materials, such as plastic or rubber. Depending on how much force the control system imparts on the pull cord when automatically retracting the operating cord, it may or may not be desirable to construct the tassel from a light weight material. It is to be appreciated that the position of the tassel can be adjusted by simply moving the location of the first knot on the pull cord.

Releasable Clasp

As shown in FIG. 4, the stopper or coupler 125 may be in the form of the releasable clasp 126. As such, the pull cord 120 extends from the tassel 128 and connects with a first portion 202 of the releasable clasp 126. The pull cord passes 120 through a first clasp cord aperture 204 located in the bottom of the first portion 202 of the releasable clasp 126. A second knot 206 tied in a second end 208 of the pull cord 120 prevents the pull cord from passing back through the first clasp cord aperture 204, which acts to connect the pull cord to the first portion 202 of the releasable clasp 126. The first portion 202 of the releasable clasp releasably connects with a second portion 210 of the releasable clasp 126. A first end 212 of the operating cord 124 is connected with the second portion 210 of the releasable clasp 126 by having a first knot 214 tied in the first end 212 of the operating cord 124 that is too large to pass through a second clasp cord aperture 216 located in the second portion 210 of the releasable clasp 126.

The first portion 202 of the releasable clasp 126 can be configured to separate from the second portion 210 of the releasable clasp 126 when excessive tension is applied to the pull cord 120. As such, the releasable clasp 126 can act to reduce strangulation hazards as well as protect the control system 110 from damage caused by pulling too hard on the pull cord 120. As shown in FIG. 4, the first portion 202 of the releasable clasp 126 is defined by a first U-shaped member 218 having a base 220 with two arms 222 extending upward therefrom. The arms 222 on the first U-shaped member 218 are configured such that the arms 222 can deflect inwardly toward each other and outwardly away from each other. An inwardly extending tab 224 is located toward the end of each arm 222 on the first U-shaped member 218. The second portion 210 of the releasable clasp 126 is defined by a second U-shaped member 226 having a base 228 with two arms 230 extending downwardly therefrom. Ledges 232 are also located on opposing sides of the base 228 of the second U-shaped member 226. The tabs 224 located on the arms 222 of the first U-shaped member 218 are adapted to cooperatively engage the ledges 232 on the base 228 of the second U-shaped member 226 to releasably connect the first portion 202 of the releasable clasp 126 with the second portion 210 of the releasable clasp 126.

In one form, the releasable clasp is configured such that the tabs 224 slope downward as they extend inwardly toward each other from the arms 220. The ledges 232 can also be configured to receive the downward sloping tabs 224. In this configuration, the tabs 224 interacting with the ledges 232 act to pull the arms 222 together in response to tension in the pull cord 120. As such, the releasable clasp acts to resist separation of the first portion 202 from the second portion 210 as the tension in the pull cord increases. The releasable clasp can further be constructed such that the first portion 202 will break at a predetermined tension in the pull cord. For example, in one embodiment, the first portion of the releasable clasp is constructed to break when the tension in the pull cord reaches 30 pounds.

In another form, the releasable clasp 126 is configured such that when excessive tension is applied to the pull cord 120, forces resulting from the tension exerted between the tabs 224 and the ledges 232 will cause the arms 222 of the first U-shaped member 218 to move outwardly away from each other until the tabs 224 disengage from the ledges 232, causing the first portion 202 to separate from the second portion 210 of the releasable clasp 126.

Spool/Input Assembly

The various elements of the input assembly 174 are supported by the right end cap 116. As shown in FIG. 5C, the circular recess 166 is defined by a partially circular wall 234 extending from the inner side 144 of the right end cap 116. A first end cap shaft 236 and a second end cap shaft 238 are integrally connected with and extend perpendicularly from the inner side 144 of the right end cap 116. As such, the first end cap shaft 236 and the second end cap shaft 238 do not rotate. As discussed in more detail below, the cord spool 190, the clock spring 186, and the axle 188 (see FIG. 5B) are supported by the first end cap shaft 236, whereas the shift arm 182 and the pulley 184 are rotatably supported on the second end cap shaft 238. The cord guide arm 180 acts to provide outboard support for the second end cap shaft 238.

Although a detailed structural description of the axle 188 follows, it should be noted that the axle 188 interfaces with the input assembly 174, the transmission 176, and the output assembly 178. As such, additional descriptions of the various functions performed by the axle will be described below separately as part of the detailed descriptions of the input assembly, the transmission, and the output assembly. It is to be appreciated that the axle can be made from various suitable materials. For example, the axle in one embodiment of the present invention is made from a teflon-filled polycarbonate.

As shown in FIG. 5B, the axle 188 may include plurality of outer surfaces defined along its length by varying diameters. Each outer surface is directed to a function more particularly described below. The axle 188 shown in FIG. 5B includes a first surface 240 separated from a second surface 242 by a flange 244, and a third surface 246. In some embodiments of the present invention, the first surface 240 may have a slightly smaller diameter than the second surface 242. For example, in one particular embodiment, the first surface has a diameter that is 0.081 inches less than the second diameter. A second surface spacer 248 is located where the second surface 242 and the flange 244 join. The third surface 246 may have a smaller diameter than the first surface 240 and the second surface 242, and may also be configured to taper to yet a smaller diameter until reaching a second end 250 of the axle 188. As further illustrated in FIG. 5B, a passage 252 is located through the center of the axle 188. The passage opens through a first end 254 and the second end 250 of the axle 188. As shown in FIG. 6AA, the passage 252 is bevelled at the first end 254 and is adapted at the second end 250 to receive a fastener 256. As shown in FIGS. 5C and 6AA, the outer surface of the first end cap shaft 236 is bevelled to define a plurality of longitudinal ridges 258 extending radially from the circumference. The bevelled surface of the first end cap shaft 236 is adapted to cooperate with a correspondingly shaped bevelled female opening in the first end 254 of the axle 188. As such, the longitudinal ridges 258 prevent the axle 188 from rotating relative to the first end cap shaft 236.

Cord Spool & Clock Spring Connection

The structural and cooperative relationship between the cord spool 190, the clock spring 186, the axle 188, the pulley 184, the shift arm 182, the cord guide arm 180, and the operating cord 124 of the input assembly 174 will now be described. As shown in FIGS. 5C and 5G, the cord spool 190 is disc-shaped and includes a first side 260 and a second side 262. The first side 260 of the cord spool 190 includes a circular cavity 264 adapted to store the clock spring 186, and the second side 262 of the cord spool 190 includes a sun gear 266 integrally attached thereto. As such, the cord spool 190 and the sun gear 266 rotate together. An opening 268 is located in the center of the cord spool 190 adapted to accept a flange 270 integrally connected with a planet carrier 272 (see FIG. 5K), which is part of the transmission 176 discussed below. When assembled, the cord spool 190 is rotatably supported on the flange 270, which surrounds the first surface 240 of the axle 188.

As shown in FIGS. 5C and 5G, the cord spool 190 includes a groove 274 in the outer circumference adapted to receive the operating cord 124 wound thereupon. As shown in FIG. 6A and discussed in more detail below, the operating cord 124 is wound clockwise (as viewed by looking toward the inner side of the right end cap 116) onto the groove 274 of the cord spool 190. As such, when the operating cord 124 is unwound from the cord spool 190 (i.e. when a user pulls on the pull cord), the cord spool rotates counterclockwise. As shown in FIG. 6A, a second knot 276 tied in a second end 278 of the operating cord 124 is located in the circular cavity 264. The operating cord 124 extends from the second knot 276 and passes through a cord notch 280 and into the groove 274. The second knot 276 prevents the operating cord 124 from slipping through the cord notch 280, thus connecting the second end 278 of the operating cord 124 to the cord spool 190.

As shown in FIGS. 5C, 5G, and 6A, the clock spring 186 is stored inside the circular cavity 264 of the cord spool 190. The clock spring functions to automatically retract the operating cord 124 onto the cord spool when tension is released from the pull cord 120. The clock spring 186 includes a first tang 282 located in the outer winding of the clock spring 186, and a second tang 284 located in the inner winding of the clock spring 186. The first tang 282 engages a first clock spring recess 286 located on the cord spool 190 to connect the clock spring with the cord spool. The second tang 284 engages a second clock spring recess 288 on the first surface 240 of the axle 188 to connect the clock spring with the axle.

When a user pulls on the pull cord 120, which in turn unwinds the operating cord 124 from the cord spool 190, the cord spool rotates counterclockwise. Because the clock spring 186 is fixed at the second tang 284 by the axle 188, the clock spring contracts from an expanded state as the cord spool rotates counterclockwise. As such, rotation of cord spool coils the clock spring to the extent of the operating cord is wound thereupon. When tension is released from the pull cord and operating cord, the cord spool is rotated clockwise by the expanding clock spring to rewind the operating cord back onto the cord spool. It should also be noted that when the control system 110 is assembled with its components, the axle 188 is inserted into opening 268 of the cord spool 190 and wound slightly to place a pre-load on the clock spring 186. This pre-load on the clock spring assures that some tension is always maintained on the operating cord when the system is not in use.

Operating Cord Path from Spool to Clasp

As shown in FIGS. 5C and 6A, the operating cord 124 passes from the cord spool 190 to wrap clockwise partially around a groove 290 in the outer circumference of the pulley 184. From the pulley 184, the operating cord 124 exits the head rail assembly 112 through the cord guide arm 180. As previously mentioned, the shift arm 182 and the pulley 184 are supported on the second end cap shaft 238. The cord guide arm 180 acts to provide outboard support for the second end cap shaft 238. More particularly, the second end cap shaft is adapted to be received by the shift arm and the cord guide arm, and the pulley is coupled to the shift arm. As shown in FIG. 5C, the pulley 184 has a center opening 292 adapted to fit around a shift arm bearing surface 294. A shift arm opening 296 is adapted to receive the second end cap shaft 238. When assembled, the shift arm and the pulley cooperate with the second end cap shaft to enable the shift arm to freely pivot about the second end cap shaft. Thus, the second end cap shaft is a bearing surface for the shift arm opening, enabling the shift arm to freely pivot on the second end cap shaft. As mentioned above and as described in more detail below, the pivotal position of the shift arm determines whether the shift arm engages the transmission 176, which in turn, dictates the direction in which the head roller 108 is rotated.

As shown in FIG. 6A, the inner side 144 of the right end cap 116 includes a first cord barrier wall 298, which is a semicircular-shaped structure integral to the right end cap formed partially from the extended edges 148. The first cord barrier wall 298 extends from the inner side of the right end cap. It will be appreciated that one edge of the pulley 184 is closely proximate to the first cord barrier wall 298, but does not engage it. The closely meeting surfaces of the pulley and the first cord barrier wall is accomplished by the close tolerances between the placement of pulley, the bearing surface 294 of the shift arm 182, and the second end cap shaft 238. It is to be appreciated that the mating of pulley upon the bearing surface of the shift arm and the mounting of the pulley and the shift arm upon the second end cap shaft, places the one edge of the pulley closely proximate to the first cord barrier wall. In one embodiment of the present invention, the one edge of the pulley is placed proximate to the first cord barrier wall at a distance of less than 0.1 operating cord diameters. This close abutment prevents the operating cord from escaping to one side of the groove of the pulley and thereby becoming trapped under the pulley. Thus, as the operating cord 124 travels from the cord spool 190 over the pulley 184, the pulley is free to rotate, providing a low friction surface for the operating cord, but preventing the operating cord from becoming trapped between the remaining proximate elements.

Shift Arm

Figure 5D:
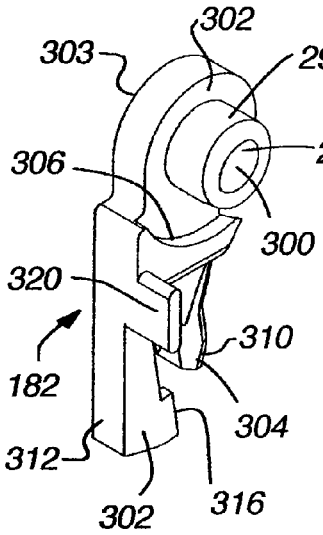
FIG. 5D is a front right-side isometric view of a shift arm used in the control system depicted in FIG. 5C.
Figure 5E:
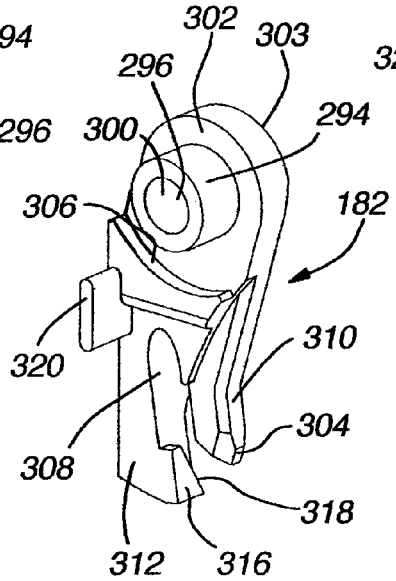
FIG. 5E is a rear right-side isometric view of the shift arm used in the control system depicted in FIG. 5C.

As shown in FIGS. 5C–5E, the shift arm 182 is an oblongate element having the circular opening 296 in the upper end thereof which extends through the shift arm to create an end cap shaft bearing surface 300 for the second end cap shaft 238. As mentioned above, the second end cap shaft 238 is adapted to be received within the circular opening 296 in the shift arm 182. The pulley bearing surface 294 extends outwardly from a right side 302 of the upper end of the shift arm 182 with the circular opening 296 passing therethrough. As mentioned above, the pulley bearing surface 294 is adapted to be received in the opening 292 located in the pulley 184. The purpose of having a separate end cap shaft and pulley bearing surfaces is to create friction between the shift arm and the pulley. Friction between the shift arm and the pulley causes a pivot action of the shift arm upon movement of the operating cord 124. The pivot action of the shift arm 182 causes a pawl tooth 304 located on the lower end of the shift arm to engage the transmission 176, which affects the direction in which the head roller 108 is rotated.

As shown in FIGS. 5D and 5E, a second cord barrier wall 306 is located on the right side 302 of the shift arm 182. The second cord barrier wall 306 is slightly raised from the right side of the shift arm and is somewhat triangularly shaped with one side of the triangle curved to accommodate the curvature of the pulley 184. It is to be appreciated that when assembled, the edge of the pulley is closely proximate to the second cord barrier wall, but does not engage it. The purpose of this configuration is to prevent the operating cord from being trapped between the pulley and the shift arm. Additionally, upon mounting the pulley upon the pulley bearing surface of the shift arm and upon mounting the shift arm on the second end cap shaft, the second cord barrier wall does not contact the inner side 144 of the right end cap 116.

As further shown in FIGS. 5D and 5E, a notch 308 is located at the lower end of the shift arm 182. The notch 308 separates a first leg structure 310 and a second leg structure 312. The pawl tooth 304 is located at a distal end of the first leg structure 310. The pawl tooth 304 is angled slightly away from the shift arm to allow the pawl tooth to more easily engage the transmission. As discussed below with reference to the transmission, the pawl tooth is adapted to engage ratchet teeth 314 on the planet carrier 272 (see FIG. 5K). The second leg structure 312 includes a notch boss 316 extending toward the first leg structure 310 opposite the pawl tooth 304. The notch boss 316 extends slightly into the notch and has the general form of a right triangle having a hypotenuse 318 facing the notch. The second leg structure 312 also includes a sweep 320 extending perpendicularly from the right side of the shift arm.

Cord Guide Arm

Figure 5H:
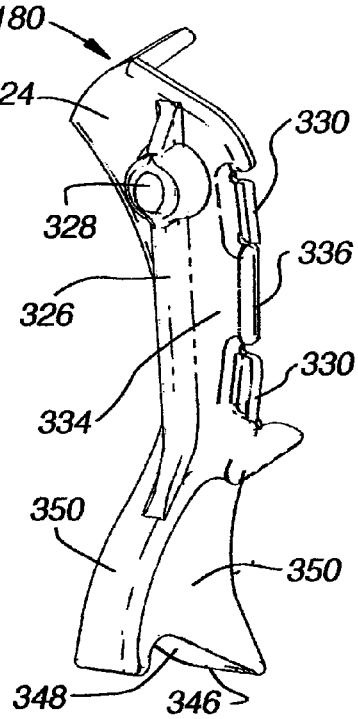
FIG. 5H is an isometric view of left side of a cord guide arm.
Figure 5F:
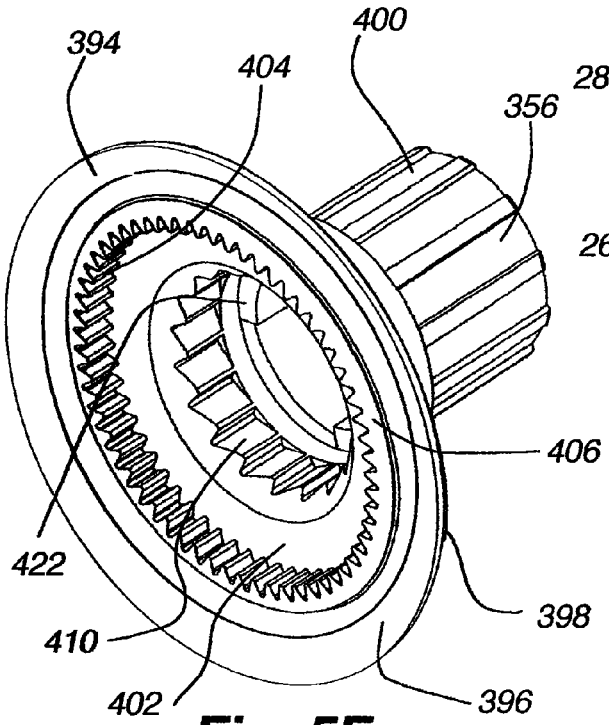
FIG. 5F is a rear right-side isometric view of a ring gear used in the control system depicted in FIG. 5B.
Figure 5G:
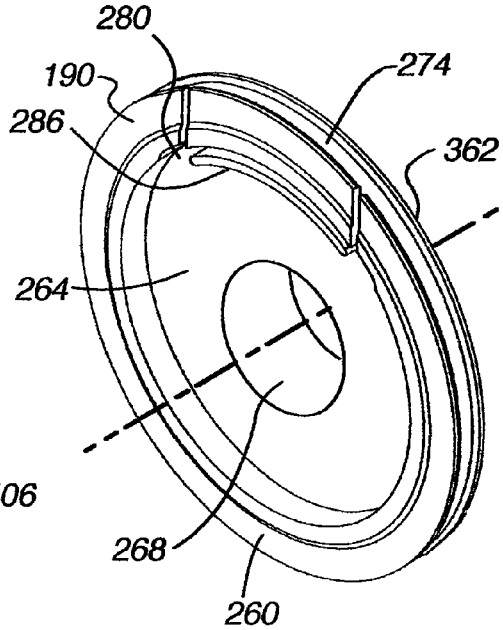
FIG. 5G is a rear right-side isometric view of a cord spool used in the control system depicted in FIG. 5C.
Figure 5J:
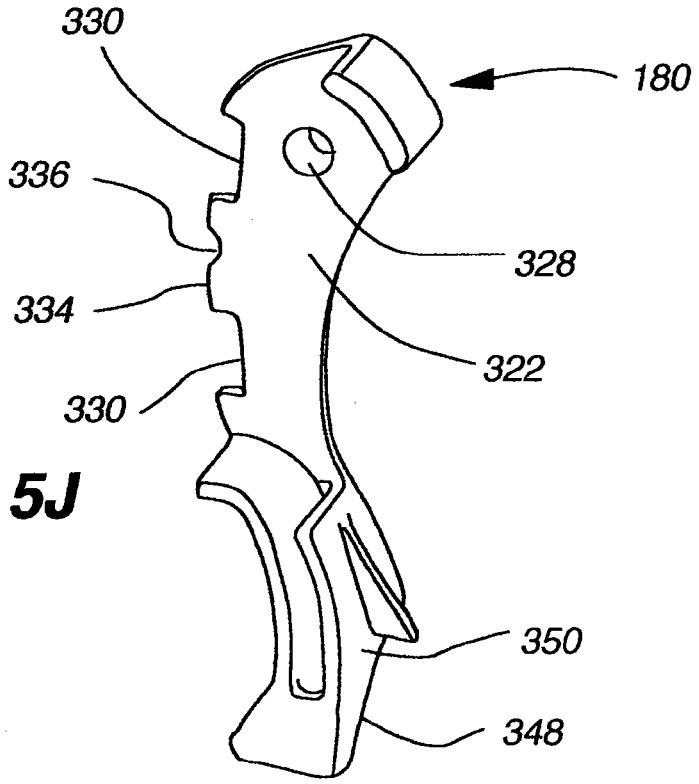
FIG. 5J is an isometric view of a right side of a cord guide arm.

As shown in FIGS. 5C, 5H, and 5J the cord guide arm 180 is an elongate element having a right side 322 and a left side 324. The left side 324 includes a rib 326 disposed longitudinally thereon to add structural strength along the length of the cord guide arm. Further, a cord guide opening 328 is located at the upper end of the cord guide arm. The cord guide opening 328 is adapted to receive the second end cap shaft 238 and provide outboard support therefor. As discussed below, when assembled, the cord guide arm is held in a fixed position relative to the first end cap 116.

Many points of engagement between the cord guide arm 180 and the first end cap 116 are provided to fix the cord guide arm in proper alignment with the shift arm 182. As shown in FIGS. 5C and 5H, the cord guide arm 180 includes two fingers 330 adapted to engage with corresponding slots 332 on the right end cap 116. The fingers 330 are configured to "snap fit" into the slots 332 for fixedly retaining the cord guide arm in a fixed position relative to the right end cap. A brace 334 is located between the fingers 330 on the cord guide arm. The brace helps to further retain the cord guide arm in a fixed relationship with respect to the right end cap upon assembly of the components. The brace includes a notch 336 for engagement with an extended edge rib (not shown) on the right end cap 116. A filler 338 and a snap 340 project from the right side 322. The filler and the snap also maintain the cord guide arm in a fixed relationship with right end cap. The filler 338 is adapted to substantially fit within a recess 342 on the right end cap 116, and the snap 340 is adapted to engage a ledge 344 on the right end cap 116. As will be appreciated, as the cord guide arm is assembled into its operational position, the snap is brought to a forced engagement with the ledge by sliding over the ledge and snapping into position.

Neutral Position

As shown in FIGS. 5C and 5H, a horn 346 is located at the lower end of the cord guide arm 180. A first horn opening 348 is located at the lower end of the horn 346. The first horn opening 348 is a curved and flared opening formed by horn walls 350, and is adapted to stop and retain the releasable clasp 126 in a "parked" position (see FIG. 7F). As mentioned above, the stopper or coupler 125 is drawn against the cord guide arm 180, or more particularly, the first horn opening 348, and is held in place by tension in the operating cord 124 generated by the clock spring 186. The parked position of the stopper or coupler 125 urges the operating cord to rest in a neutral position relative to the shift arm 182. In the neutral position, the operating cord directly overlays the notch boss 316, as shown in FIG. 6BBBB. When a user pulls on the pull cord 120, the notch boss 316 cooperates with the operating cord 124 such that the shift arm 182 is enabled to pivot and engage the pawl tooth 304 with the transmission, or the shift arm 182 is prevented from pivoting to engage the pawl tooth 304 with the transmission. As such, the flared opening 348 is diagonally biased to urge the user to pull on the pull cord and operating cord in either the upward operating pull direction 130 or the downward operating pull direction 132, shown in FIGS. 2 and 3.

As discussed above, the position of the stopper or coupler 125 in the first horn opening 348 places the operating cord 124 in a neutral position which overlays the notch boss 316. Thus, proper alignment between the shift arm 182 and the cord guide arm 180 is necessary to achieve this neutral position. To begin an operational sequence, a pull force upon the operating cord 124 causes the pulley 184 to rotate and imparts a pivoting action of the shift arm 182. As shown in FIG. 6A, the operating cord 124 is directed from the pulley 184 between the first cord barrier wall 298 and the second cord barrier wall 306 and through the notch 308 of the shift arm. When a user pulls on the pull cord, the operating cord is unwound from the cord spool 190, which turns the cord spool in a counterclockwise direction. As the operating cord passes over the pulley, the pulley is turned in a clockwise direction. As discussed above, the pulley frictionally engages the shift arm at the pulley bearing surface 294. Thus, as the operating cord travels in the groove on the pulley, causing the pulley to rotate in the clockwise direction, friction at the pulley bearing surface urges the shift arm to pivot in a clockwise direction.

Notch Boss Determines Pivot of Shift Arm

As discussed above, as the operating cord 124 travels over the shift arm 182, the position of the operating cord relative to the notch boss 316 determines whether the shift arm pivots to be engaged or disengaged with the transmission 176. The position of the operating cord relative to the notch boss is determined by the pull direction in which the user is placing force on the pull cord and operating cord. As such, if the pull direction is in the upward operating pull direction 130 (see FIG. 2), the operating cord 124 moves from the neutral position and translates off the notch boss 316 to a position closest to the sweep 320 or to the right of the notch boss, as shown in FIGS. 7A, 7AA, and 7AAA. When the operating cord 124 translates to the position to the right of the notch boss 316, the operating cord maintains minimal contact with the sweep 320. As such, the shift arm 182 pivots clockwise with the pulley 184, as shown in FIG. 7A. Alternatively, if the pull force is in the downward operating pull direction 132 (see FIG. 3), the operating cord 124 moves from the neutral position and translates off the notch boss 316 to a position inside the notch 308 and across the second leg 312 or to the left of the notch boss 316, as shown in FIGS. 6B, 6BB, and 6BBB. When the operating cord translates to the position left of the notch boss 316, the operating cord maintains contact with the second leg 312 of the shift arm at or above the hypotenuse of the notch boss, which restrains the shift arm from pivoting, as shown in FIG. 6B. It is to be appreciated that the shift arm may also act as an anti-shift device once a pull force is applied to the pull cord and operating cord. For example, once a user initiates a pull force on the pull cord and operating cord in the upward operating pull direction, a change in pull direction will not cause the shift arm to disengage from the planet carrier. Alternatively, once the user initiates a pull force on the pull cord and operating cord in the downward operating pull direction, a change in pull direction will not cause the shift arm to engage with the planet carrier. Therefore, the system must be "reset" back to the neutral position before a change in pull direction will have an effect on the operation of the control system.

Final Summary of Input Assembly

To summarize the operational description of the input assembly, as a user pulls on the pull cord 120 to move the covering 100 in the desired direction, the operating cord 124 is unwound from the cord spool 190, causing the cord spool to rotate in a counterclockwise direction. As the operating cord passes over the pulley 184, causing the pulley to rotate in a clockwise direction, friction between the pulley and the shift arm 182 urges the shift arm to pivot in a clockwise direction. If the user pulls the pull cord in the upward operating direction 130, the shift arm is allowed to pivot such that the pawl tooth 304 on the shift arm engages the transmission, causing the head roller 108 to rotate in a direction to wrap the covering 100 onto the head roller, as will be explained more fully later. Alternatively, if the user pulls the pull cord in the downward operating direction 132, the shift arm is prevented from pivoting to engage the pawl tooth with the transmission 176, causing the head roller to rotate in a direction to unwrap the covering from the head roller. Rotation of the cord spool 190 operates as an input to the transmission, which imparts rotational movement to the output assembly 178 and the head roller 108. After the user releases tension from the pull cord and operating cord, the clock spring 186 causes the cord spool to automatically wind the operating cord back onto the cord spool. As the operating cord winds back onto the cord spool, the pulley is caused to rotate in a counterclockwise direction. Friction between the pulley and the shift arm causes the shift arm to pivot counterclockwise to place the notch boss back into the neutral position. The operating cord is automatically retracted until the stopper or coupler 125 engages the first horn opening 348 of the cord guide arm 180, placing the operating cord back into the neutral position over the notch boss.

Transmission Overview

The structure and operation of the transmission 176 will now be discussed in detail. As shown in FIG. 5C, the transmission includes a sun gear 266 integrally connected with the second side 262 of the cord spool 190, a planet carrier 272, four planet gears 352, a spider 354, and a ring gear 356, all cooperatively engaging to convert rotational movement of the cord spool into rotational movement of the ring gear, which imparts rotational movement to the output assembly 178. As discussed in more detail below, a user pulling on the pull cord 120 causes the cord spool to rotate counterclockwise (see FIG. 6A). Because the sun gear is integral with the cord spool, the sun gear also rotates in a counterclockwise direction. If the user pulls the pull cord in the upward operating direction 130 (see FIG. 2), the shift arm 182 pivots until the pawl tooth 304 engages ratchet teeth 314 on the planet carrier 272, which prevents the planet carrier from rotating (see FIG. 7A). Counterclockwise rotation of the sun gear causes clockwise rotation of the four planet gears 352 (see FIG. 7B), which in turn, engage the ring gear 356 to turn the ring gear in a clockwise direction. Alternatively, if the user pulls the pull cord in the downward operating direction 132 (see FIG. 3), the shift arm 182 does not pivot to engage the pawl tooth 304 with the planet carrier 272 (see FIG. 6B), allowing the planet carrier to rotate. As such, counterclockwise rotation of the sun gear causes clockwise rotation of the four planet gears, which in turn, cause the planet carrier to rotate counterclockwise. As the planet carrier rotates counterclockwise, the planet carrier engages the spider 354 to turn the spider in a counterclockwise direction, which in turn, engages the ring gear 356 to turn in a counterclockwise direction (see FIG. 6C). As discussed in more detail below, the spider acts as a part time one-way clutch activated by the planet carrier to rotate the ring gear. As such, when the spider is deactivated, the spider would not interfere with rotation of the ring gear in either the clockwise or counterclockwise directions.

Sun Gear, Planet Carrier & Planet Gears

As mentioned above and as shown in FIGS. 5C and 7B, the sun gear 266 is integrally connected with the second side 262 of the cord spool 190 and is adapted to engage four planet gears 352 on the planet carrier 272. Although four planet gears are depicted and described with reference to the transmission, it is to be appreciated that the transmission can be configured to include more than or less than four planet gears. The planet carrier is disc-shaped and has a first side 358 and a second side 360 with a center circular opening 362 passing therethrough, as shown in FIGS. 5C and 5K. A series of ratchet teeth 314 are located on the periphery of the planet carrier, which are adapted to engage the pawl tooth 304 on the shift arm 182. The sun gear 266 is adapted to be received in the center circular opening 362 of the planet carrier 272 from the first side 358. The flange 270 inside the center circular opening includes an inner surface 364 adapted to receive the first surface 240 of the axle 188 and includes an outside surface 366 to act as a bearing surface for the sun gear 368. The length of the flange 270, the width of the sun gear 266, and the depth of the center circular opening 362 are substantially equal to allow the flange and the sun gear to fit together so as to enable the sun gear to engage the planet gears 352.

As shown in FIGS. 5C and 7B, the second side 360 of the planet carrier includes a circular shaped raised structure 370 adapted to accept the four planet gears 352. The raised structure 370 has four sun gear openings 372 spaced at ninety degree intervals therearound. Planet gear axles 374 extending from the second side 360 of the planet carrier 272 and are radially positioned to correspond with the location of the sun gear openings 372 in the raised structure 370. The planet gears are configured with center holes 376 adapted to receive the planet gear axles 374. As such, when the planet gears are positioned on the planet carrier axles, the planet gears project geared surfaces into the sun gear openings. Moreover, upon inserting the sun gear into center circular opening of the planet carrier, the sun gear engages the planet gears. Therefore, rotation of the cord spool 190, rotates the sun gear 266, which in turn, rotates the four planet gears 352.

Engagement of Planet Carrier and Spider

Figure 5L:
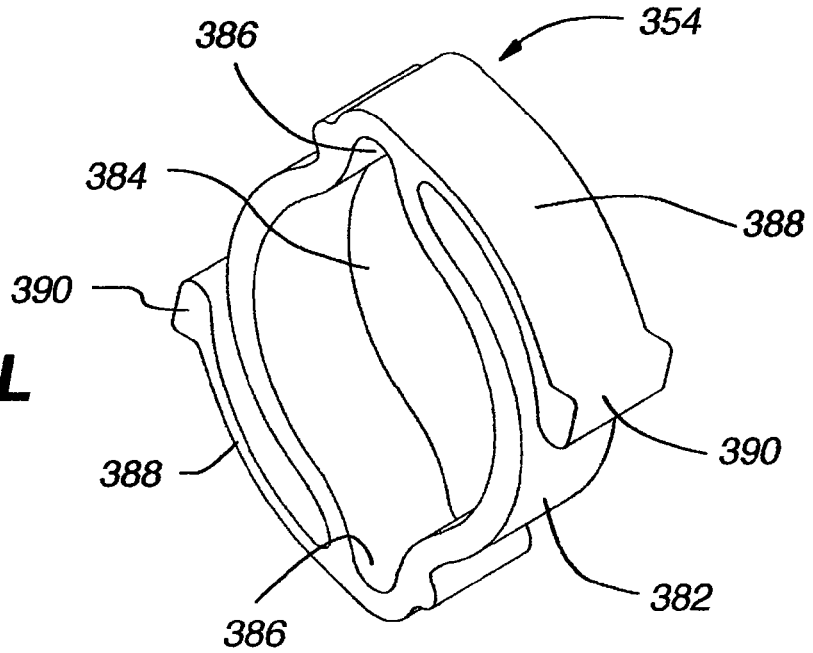
FIG. 5L is an isometric view of a spider.
Figure 5K:
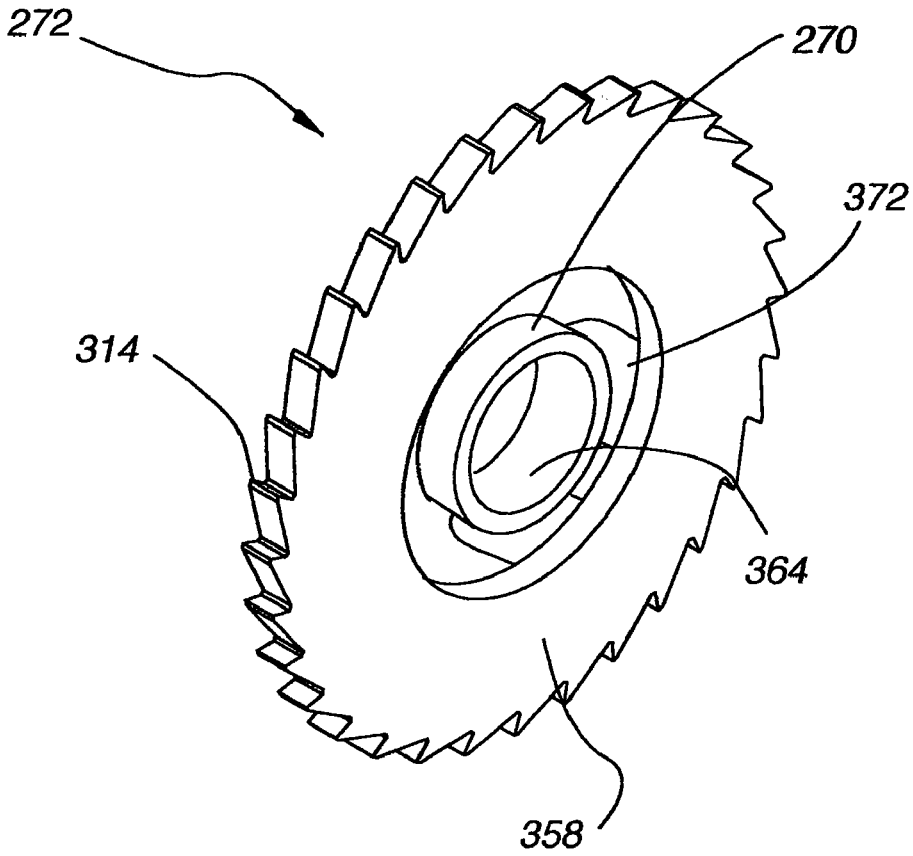
FIG. 5K is an isometric view showing a first side of a planet carrier.
Figure 6C:
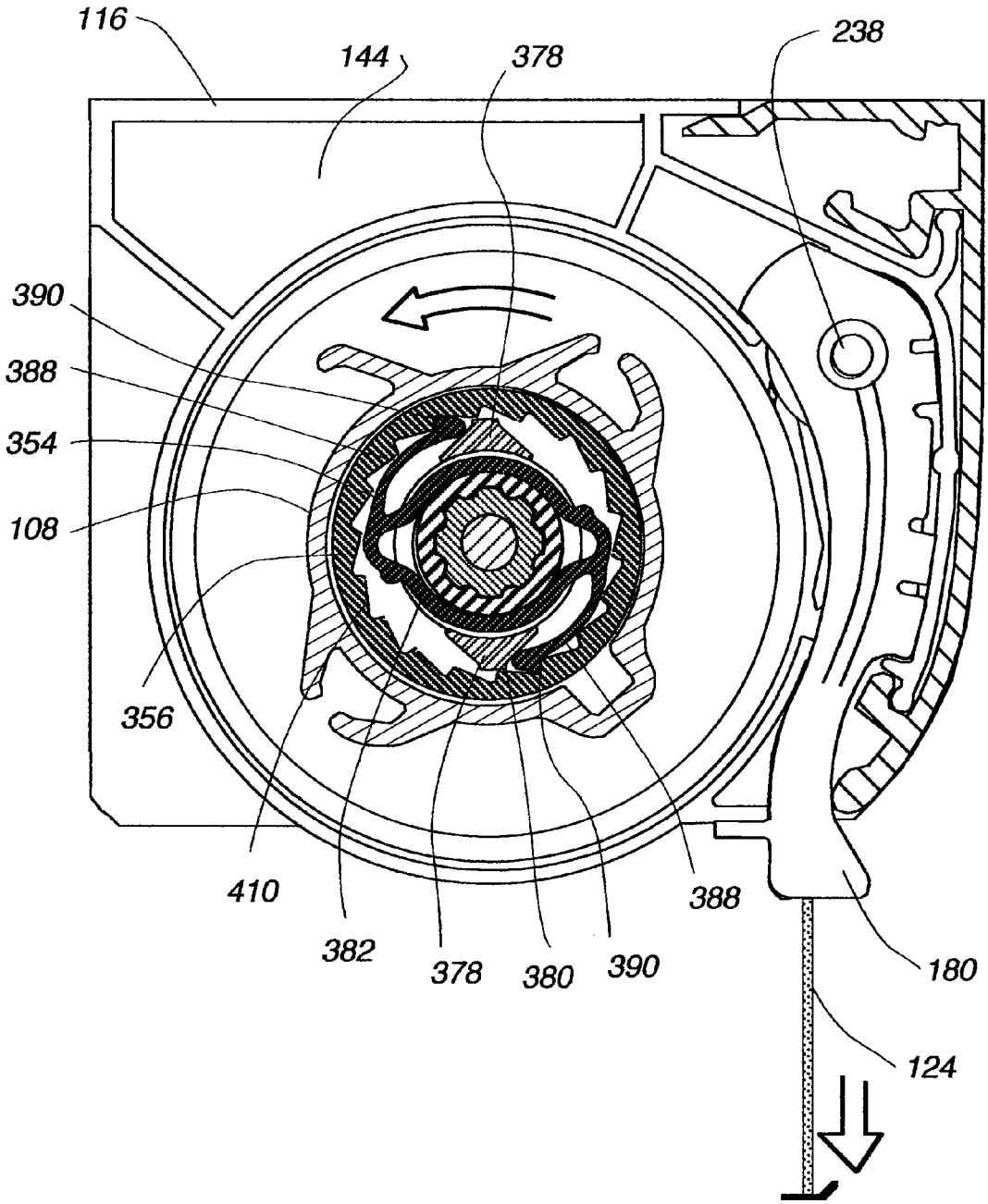
FIG. 6C is a cross-sectional view of the control system depicted in FIG. 6, taken along line 6C—6C.

As shown in FIGS. 5C, 5L, and 6C, two actuator tabs 378 extend from the circular raised structure 370 on the planet carrier 272. The actuator tabs 378 are trapezoidally shaped, each having a small notch 380 located thereon. The actuator tabs 378 are adapted to engage the spider 354 upon rotation of the planet carrier 272. The spider 354 includes a somewhat flexible and resilient body 382 generally oblong or "football" shape having an open center 384 with rounded ends 386. Arcuate legs 388 project from the rounded ends 386 in opposite directions with respect to each other. The legs 388 may also be flexible and resilient so as to be bendable outwardly or away from the body 382. Wedges 390 located at a distal end of each leg 388 are adapted to engage the small notches 380 on the actuator tabs 378 and the ring gear 356 upon counterclockwise rotation of the planet carrier 272, as discussed in more detail below. Opposite a point of attachment of each leg 388 is a small stop 392 adapted to engage the actuator tabs 378 upon clockwise rotation of the planet carrier 272. It is to be appreciated that the spider can be made from various suitable materials. For example, the spider in one embodiment of the present invention is made from a thermoplastic polyester elastomer, such as Hytrel® manufactured by DuPont.

The open center 384 of the spider 354 is adapted to received the first surface 240 of the axle 188. The engagement of the first surface of the axle and the open center of the spider is an interference fit. As such, the diameter of the open center 384 of the spider 354 is slightly smaller than the outside diameter of the first surface 240 of the axle 188. In one embodiment of the present invention, the diameter of the open center of the spider is 0.016 inches smaller than the outer diameter of the first surface of the axle. The interaction of the spider material with the axle material along with the interference fit create some friction between the spider and the first surface of the axle, but the spider can move around the first surface without binding. The friction between the body of the spider and the first surface of the axle enables engagement of the actuator tabs with the spider upon rotation of the planet carrier in a counterclockwise direction, and disengagement of the spider from the actuator tabs upon rotation of the planet carrier in a clockwise direction.

Ring Gear

As previously mentioned, depending upon which direction the user pulls on the pull cord, either the four planet gears 352 or the spider 354 engage the ring gear 356 to rotate the ring gear in either a clockwise direction or a counterclockwise direction, respectively. As shown in FIGS. 5B and 5F, the ring gear 356 is defined by a flanged portion 394 having a first side 396 and a second side 398 with a cylindrical portion 400 extending from the second side 398. A cylindrical opening 402 passes through the flanged portion 394 and the cylindrical portion 400. As shown in FIGS. 5F and 7B, the first side 396 of the flanged portion 394 is largely open ended having a first geared lip 404 adapted to engage the four planet gears 352 on the planet carrier 272. Moreover, the first geared lip is slightly raised from the first side of the flanged portion to form a flange bearing surface 406. The flange bearing surface 406 is adapted to cooperate with a circular groove 408 on the second side 360 of the planet carrier 272 to create a bearing surface as well as an axial support between the planet carrier and the ring gear.

As shown in FIGS. 5F and 6C, a second geared lip 410 is located interiorly of the first geared lip 404. The second geared lip 410 has a smaller diameter than the first geared lip 404 and is adapted to engage the spider wedges 390. As previously mentioned, the legs 388 of the spider 354 are flexible. As shown in FIG. 6C, counterclockwise rotation of the planet carrier 272 moves the two actuator tabs 378 into engagement with the two legs 388 on the spider 354. More particularly, the actuator tabs engage the spider such that the actuator tabs move between the wedges 390 and the body 382 of the spider 354 until the notches 380 on the actuator tabs 378 engage the wedges, causing the legs of the spider to flex and bend outwardly from the body of the spider. As the legs 388 flex and bend outwardly, the wedges 390 are driven to engage the second geared lip 410 of the ring gear 356. Friction between the body of the spider and the first surface of the axle holds the body of the spider in a fixed position relative to the axle until the actuator tabs adequately engage the legs of the spider. The engagement of the wedges with the second geared lip surface is compressional in that the wedges are driven to fit the second geared lip by outward force of the expanded leg against the actuator tab. Continued rotation of the planet carrier and ring gear in a counterclockwise direction, enables the wedges to remain in a continued compressional engagement with the second geared lip. When the planet carrier rotates in the clockwise direction, friction between the spider body and the first surface of the axle overcomes friction between the actuator tabs and the spider legs, allowing the actuator tabs to disengage from the spider legs, which disengages the spider from the ring gear.

As shown in FIG. 5B, the cylindrical portion 400 of the ring gear 356 is defined by three elevated sleeve extensions. A first sleeve extension 412 extends from the second side 398 of the flanged portion 394. A second sleeve extension 414 extends from the first sleeve extension 412 and has a diameter smaller than the first sleeve extension. A third sleeve extension 416 extends from the second sleeve extension 414 and has a diameter smaller than the second sleeve extension. Further, the third sleeve extension includes a U-shaped channel 418 formed therein with two side walls 420 extending from the second sleeve extension to the end of the third extension sleeve 416. As discussed below, the two side walls 420 function to cooperate with the braking system.

As shown in FIG. 5F, a shoulder 422 located near the second geared lip 410 is defined by the connection of the third sleeve extension 416 and the second sleeve extension 414. The shoulder 422 is adapted to cooperate with the flange 214 of the axle 188 to create a thrust bearing between the ring gear 356 and the axle 188. When the ring gear is mounted on the second surface 242 of the axle 188, the shoulder contacts the flange 244 at an area just outside the circumference of the second surface spacer 248. As such, the second surface spacer 248 helps to maintain the alignment of the axle 188 with the ring gear 356 by maintaining the shoulder 422 in an appropriate thrust bearing position.

Summary of Transmission

To summarize the operational description of the transmission 176, as a user pulls on the pull cord 120 to move the covering 100 in the desired direction, the operating cord 124 is unwound from the cord spool 190, causing the cord spool and the sun gear 266 to rotate in a counterclockwise direction (see FIGS. 6A, 6B, and 7A). If the user pulls the pull cord in the upward operating direction 130 (see FIGS. 2 and 7A), the shift arm 182 is allowed to pivot such that the pawl tooth 304 on the shift arm engages the ratchet teeth 314 on the planet carrier, which prevents the planet carrier from rotating. As such, the counterclockwise rotation of the sun gear causes the four planet gears 352 to rotate in a clockwise rotation (see FIG. 7B), which in turn, engage the first geared lip 404 of the ring gear 356 to cause the ring gear to rotate in a clockwise direction. Rotation of the ring gear, which engages the output assembly (see FIGS. 7C and 7D) in the clockwise direction causes the head roller 108 to rotate in a clockwise direction to wrap the covering 100 onto the head roller.

Alternatively, if the user pulls the pull cord in the downward operating direction 132 (see FIGS. 3 and 6A), the shift arm 182 is prevented from pivoting to engage the pawl tooth 304 with the ratchet teeth 314 on the planet carrier 272, which allows the planet carrier to rotate freely about the first surface 240 of the axle 188. As such, the counterclockwise rotation of the sun gear 266 causes the four planet gears 352 to rotate in a clockwise rotation about their respective planet gear axles 374, which in turn, engage the first geared lip 404 of the ring gear 356 to cause the planet carrier 272 to rotate in a counterclockwise direction (see FIG. 6C). As the planet carrier rotates in the counterclockwise direction, the two actuator tabs 378 move to engage the legs 388 on the spider 354. As the actuator tabs engage the legs on the spider, the legs bend outwardly away from the body 382 of the spider until the wedges 390 on the distal ends are compressed by the actuator tabs against the second geared lip 410 of the ring gear. Once the spider wedges 390 engage the second geared lip of the ring gear, the ring gear rotates in a counterclockwise direction along with the planet carrier. Rotation of the ring gear, which engages the output assembly 178 in the counterclockwise direction causes the head roller 108 to rotate in a counterclockwise direction to unwrap the covering 100 from the head roller (see FIGS. 6C and 6D).

Once the user releases tension from the pull cord 120, the clock spring 186 recoils the operating cord 124 onto the cord spool 190 in a clockwise direction. As the cord spool recoils, the planet carrier 272 moves in a clockwise direction. Rotation of the planet carrier in a clockwise direction disengages the wedges 390 on the spider legs 388 from the actuator tabs 378 on the planet carrier 272. As such, the legs contract to their original position relative to the spider body, which disengages the wedges from the second geared lip. Disengagement of the wedges from the second geared lip causes the rotation of the ring gear to cease.

Output Assembly Overview

The structure and operation of the output assembly 178 will now be discussed in detail. As shown in FIG. 5C, the output assembly includes the fastener 256, two wrap springs 424 rotatably supported on the second surface 242 of the axle 188, and the rotator spool 168 supported by the cylindrical portion 400 of the ring gear 356, all cooperatively engaging to convert rotational movement of the ring gear into rotational movement of the head roller 108. As discussed in more detail below, a user pulling on the pull cord in the upward operating direction (see FIGS. 2 and 7E), causes the ring gear to rotate in a clockwise direction, which causes the rotator spool 168 and the head roller 108 to rotate in a clockwise direction. Alternatively, a user pulling the pull cord in the downward operating direction (see FIGS. 3 and 6E), causes the ring gear to rotate in a counterclockwise direction, which causes the brake housing and the head roller to rotate in a counterclockwise direction.

Figure 6D:
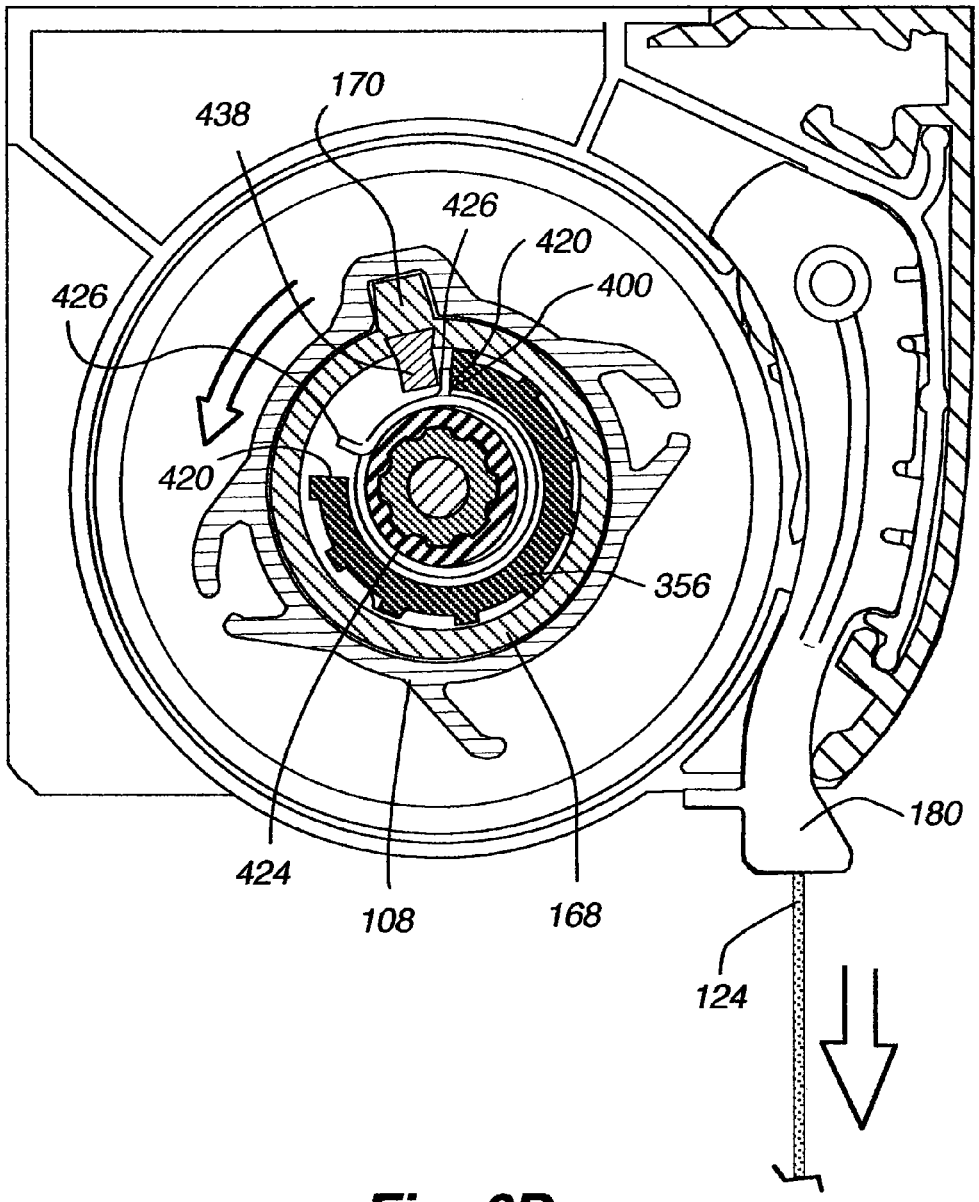
FIG. 6D is a cross-sectional view of the control system depicted in FIG. 6, taken along line 6D—6D.
Figure 6E:
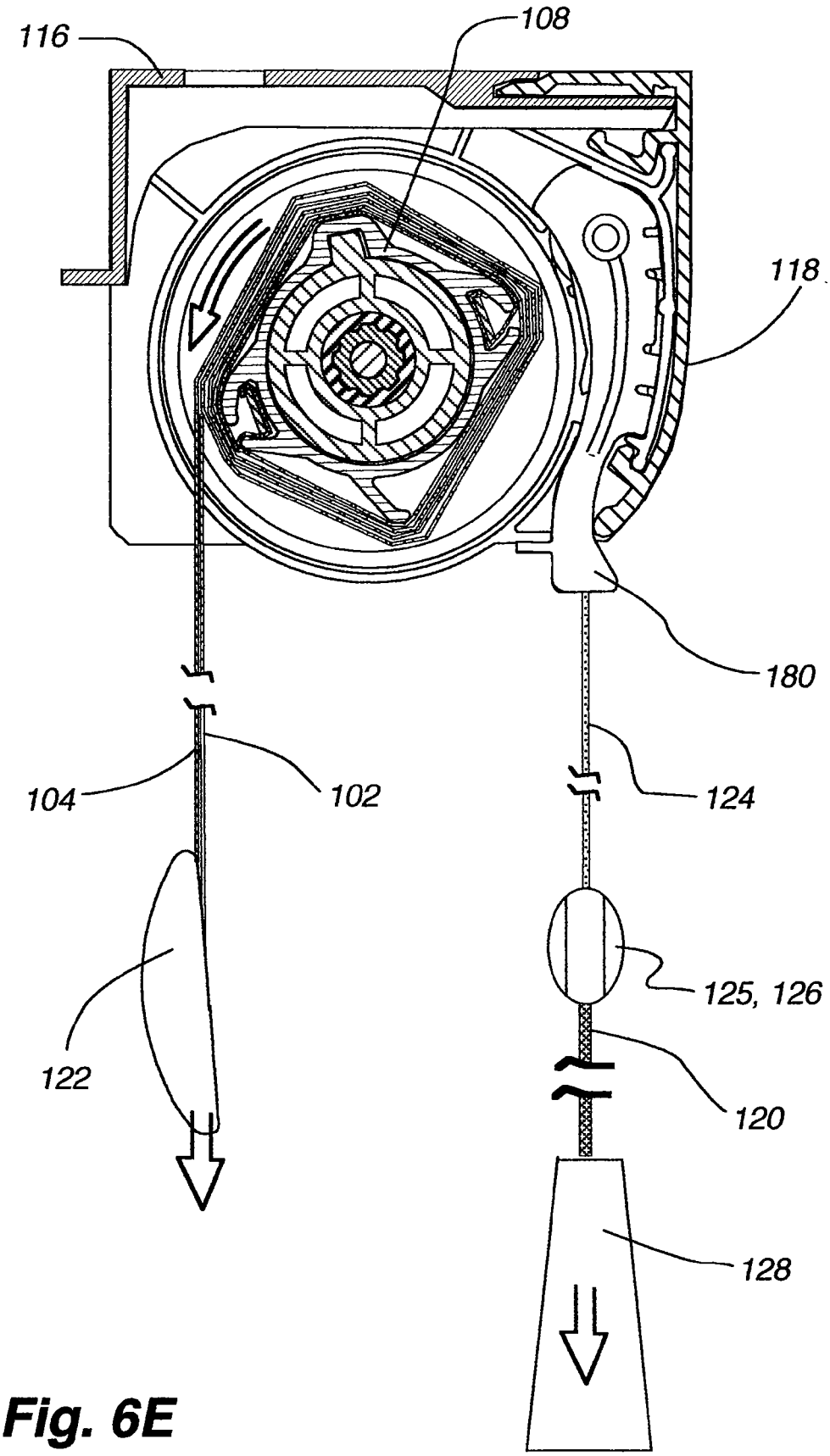
FIG. 6E is a cross-sectional view of the control system depicted in FIG. 6, taken along line 6E—6E illustrating operation of lowering the covering.
Figure 6F:
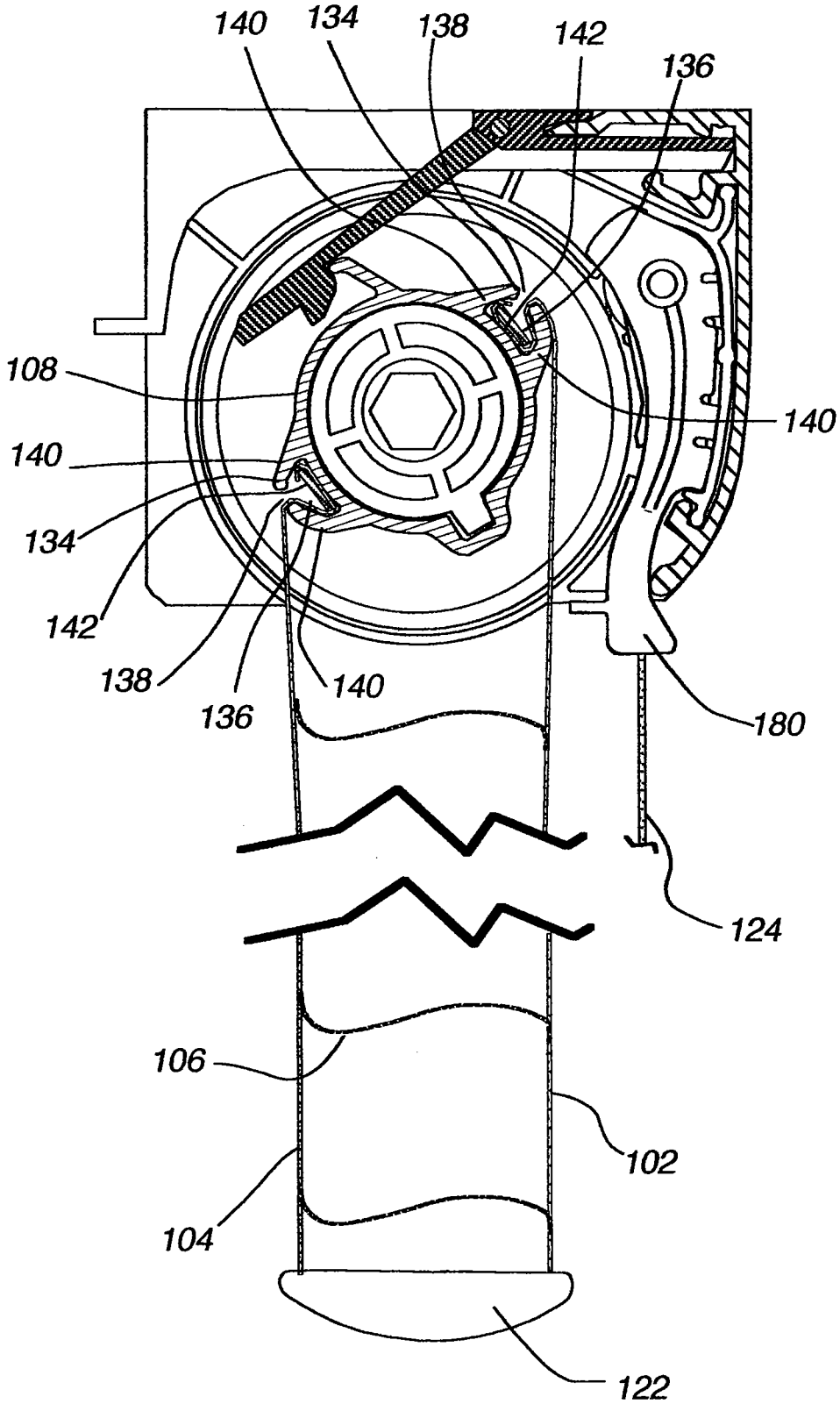
FIG. 6F is a cross-sectional view of the control system depicted in FIG. 6, taken along line 6F—6F showing the covering in a fully extended position.

As shown in FIGS. 5B, 6D, and 7D, two wrap springs 424 of a spring clutch are adapted to receive the second surface 248 of the axle 188. It is to be appreciated that the number of wrap springs used may vary for different embodiments of the present invention. The inside diameters of the wrap springs are slightly smaller than the outside diameter of the second surface of the axle, which provides a frictional engagement between the second surface and the wrap springs. This frictional engagement enables a braking action for the ring gear 356. When the ring gear 356 is mounted on the axle 188, the third sleeve extension 416 surrounds the wrap springs 424 such that wrap spring tangs 426 extend outwardly from the wrap springs 424 near the side walls inside the U-shaped channel 418.

Still referring to FIGS. 5B, 6D, and 7D, a braking response is created by the side walls 420 of the U-shaped channel 418 in the third sleeve extension 416 of the ring gear 356 engaging one or a plurality of wrap spring tangs 426. As such, the rotational force of the side walls against the wrap spring tangs causes the wrap springs to expand, thereby loosening their frictional engagement on the second surface 248 of the axle 188. The reduced frictional engagement allows rotation of the ring gear 356. However, as the force imparted on the wrap spring tangs lessens, the wrap springs contract, thereby tightening their frictional engagement on the second surface of the axle, which provides a braking response. As well as holding the covering in a particular position, engagement of the side walls against the wrap spring tangs also helps to prevent the ring gear from turning too quickly when the user is pulling on the pull cord.

As previously discussed, the diameter of the shoulder 422 of the ring gear 356 is slightly larger than the diameter of the second surface spacer 248 on the axle 188. As such, the wrap spring 424 closest to the spacer is prevented from becoming lodged under the shoulder as the ring gear 356 rotates. This may be an important function when more than two wrap springs are fitted about the second surface of the axle. In addition, an end lip 428 on the interior of the third sleeve extension 416 is adapted to cooperate with a second surface shoulder 430 of the axle 188 when the axle is inserted therethrough, which helps to prevent the wrap springs 424 from moving in a longitudinal direction along the second surface 242 of the axle 188.

Rotator Spool

As shown in FIGS. 5B, 6D, and 7D, the cylindrically-shaped rotator spool 168 includes a brake housing portion 432 having a hollow interior at an open end 434. Radially spaced longitudinal fins 436 are located on the outside of the rotator spool. A first longitudinal fin 170 is adapted to fit within the longitudinal inner groove 154 of the head roller 108, as shown in FIG. 4. A longitudinal boss 438 is adapted to connect with the interior of the brake housing portion 432. Referring back to FIGS. 5B, 6D, and 7D, the brake housing portion 432 of the rotator spool 168 is adapted to be placed over the third sleeve extension 416 of the ring gear 356 so the longitudinal boss 438 fits into the U-shaped channel 418 between the wrap spring tangs 426 near the side walls 420. As such, when the ring gear rotates in either a clockwise or counterclockwise direction, the longitudinal boss of the brake housing portion of the rotator spool engages the side walls of the U-shaped channel. Thus, the rotator spool rotates in the same direction as the ring gear.

As shown in FIGS. 5B, 6, and 7, the rotator spool 168 is secured to the axle 188 by the fastener 256 to maintain a thrust connection between the components of the control system. More particularly, the fastener 256 enters an opening 440 in the rotator spool and passes through the center of the axle 188 and screws into the first end cap shaft 236. When the components of the control system are assembled on the axle and the axle is installed on the first end cap shaft, the second end 250 of the axle 188 extends a slight distance outwardly from the opening 440 of the rotator spool 168. In one embodiment, the axle extends 0.015 inches outwardly from the opening of the rotator spool. As such, when the fastener is screwed into the first end cap shaft, the screw head 442 does not press against the rotator spool 168 to enable the rotator spool to freely rotate.

Overall Summary

The above-described control system 110 assembled on the right end cap 116 of the head rail assembly 112, as shown in FIGS. 6 and 7, allows a user to raise or lower the covering 100 by pulling on the pull cord 120 in either the upward operating pull direction 130 or the downward operating pull direction 132. The control system 110 also allows the user to pull repetitively on the pull cord in the same direction to achieve the desired position of the covering. Once the user releases the pull cord, the control system automatically retracts the operating cord back into the head rail assembly, and the braking system holds the covering in position.

Second Embodiment

Control System Overview

Figure 8:
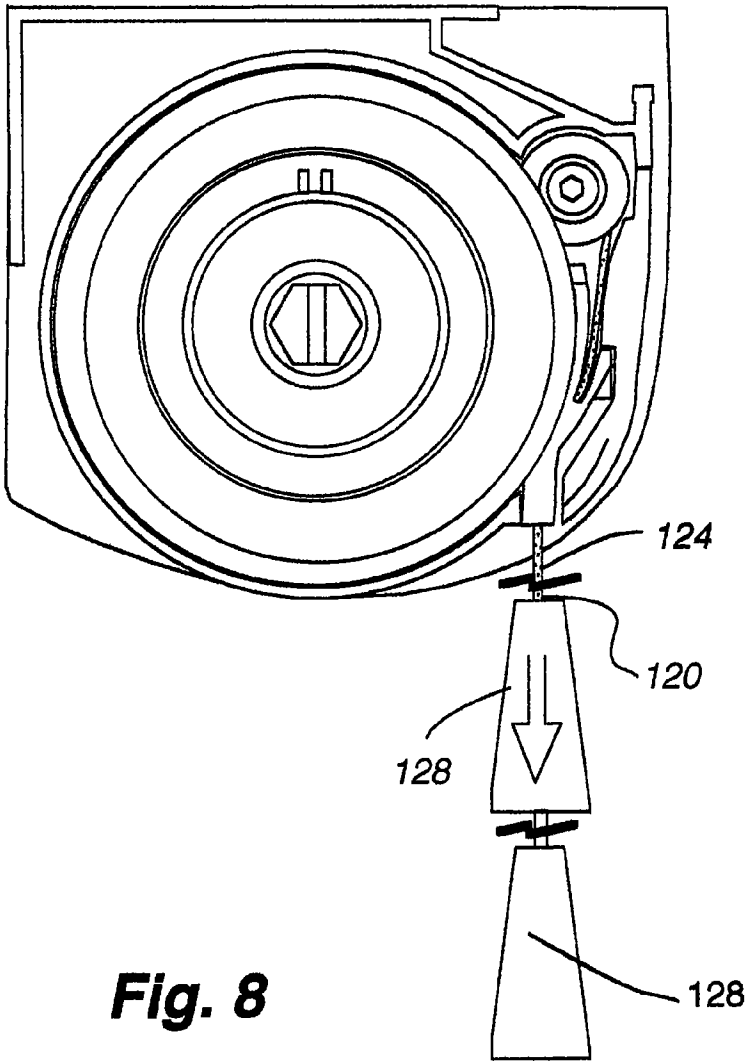
FIG. 8 is a side view of a control system according to a second embodiment of the invention.

A second embodiment of the present invention is illustrated in FIGS. 8–15F2. The second embodiment of the control system 110' provides the same functionality as the first embodiment 110 described above in that the control system 110' allows a user to raise and lower the covering 100 by pulling on the pull cord 120 in either the upward operating pull direction 130 or the downward operating pull direction 132. The operating cord 124 of the second embodiment may also utilize the tassel 128 and stopper or coupler 125 described above. The second embodiment also provides for automatic retraction of the operating cord into the head rail assembly 112' along with the braking system to hold the covering 100 in any selected position.

Similar to the first embodiment described above, the control system 110' of the second embodiment includes an input assembly 174', a transmission 176', and an output assembly 178' cooperatively engaging to convert linear movement of the pull cord 120' imparted by a user into rotational movement of the head roller 108 in the required direction to provide movement of the covering 100 in the desired direction and distance. The input assembly 174' converts linear movement of the pull cord 120 into rotational movement, which is imparted to the transmission 176'. The input assembly also engages the transmission to effect the direction of rotational output from the transmission. The transmission, in turn, imparts rotational movement to the output assembly 178'. The output assembly interfaces with the head roller 108 to rotate the head roller in the direction dictated by the transmission and to provide the braking feature that holds the head roller in position. Although the second embodiment includes the three main elements described above (i.e. the input assembly, the transmission, and the output assembly), the second embodiment utilizes various different components within the three main elements, as described below.

Input Assembly Overview

Figure 9:
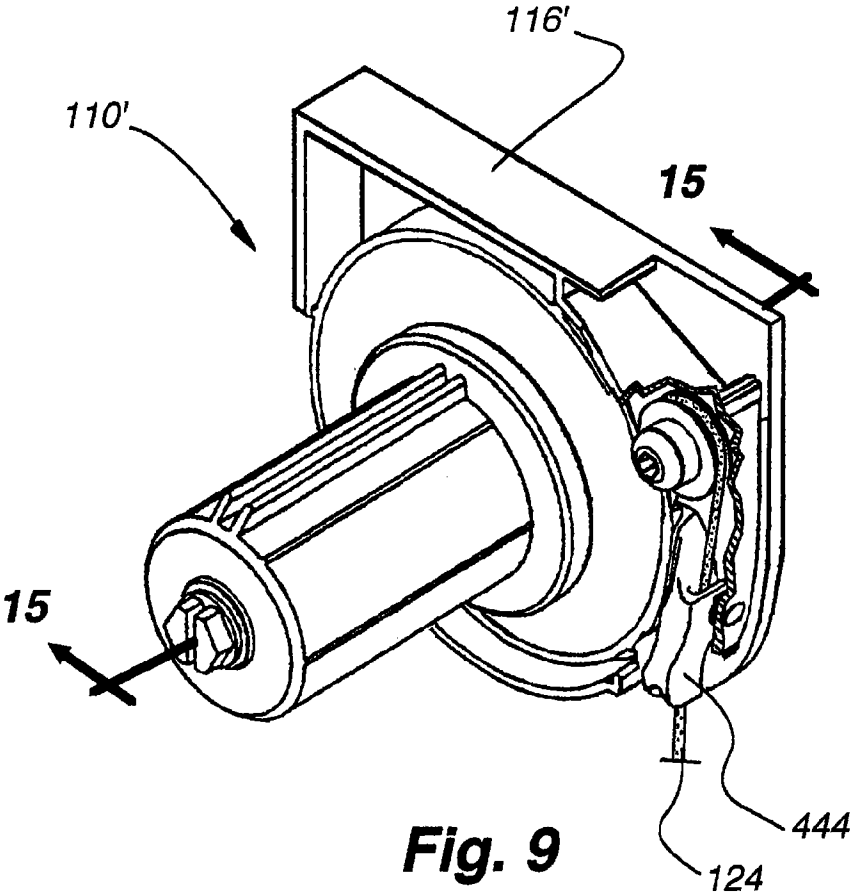
FIG. 9 is an isometric view of a control system according to a second embodiment of the invention.
Figure 10A:
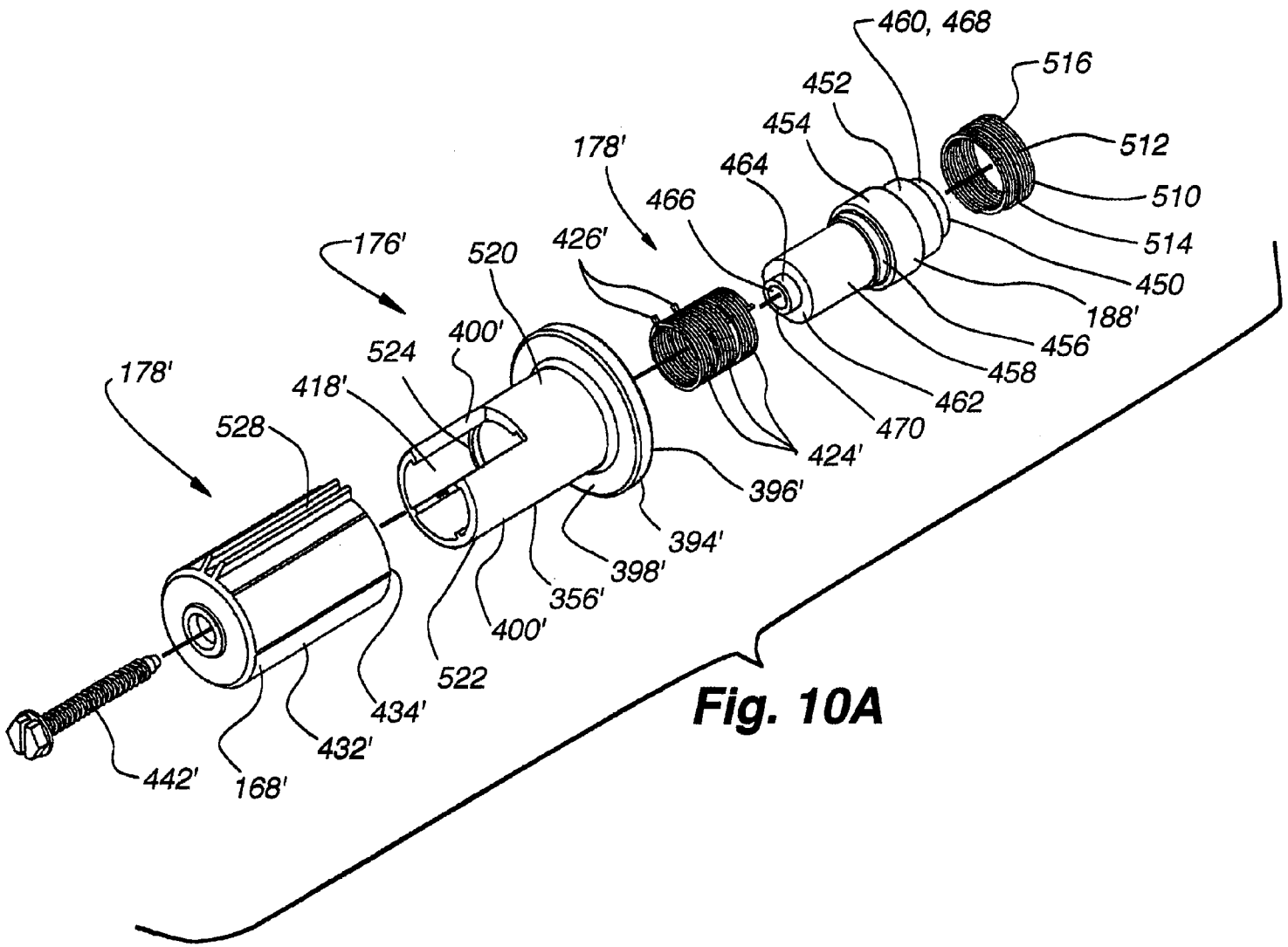
FIGS. 10A–10C are exploded isometric views of the control system according to the second embodiment of the present invention.
Figure 10B:
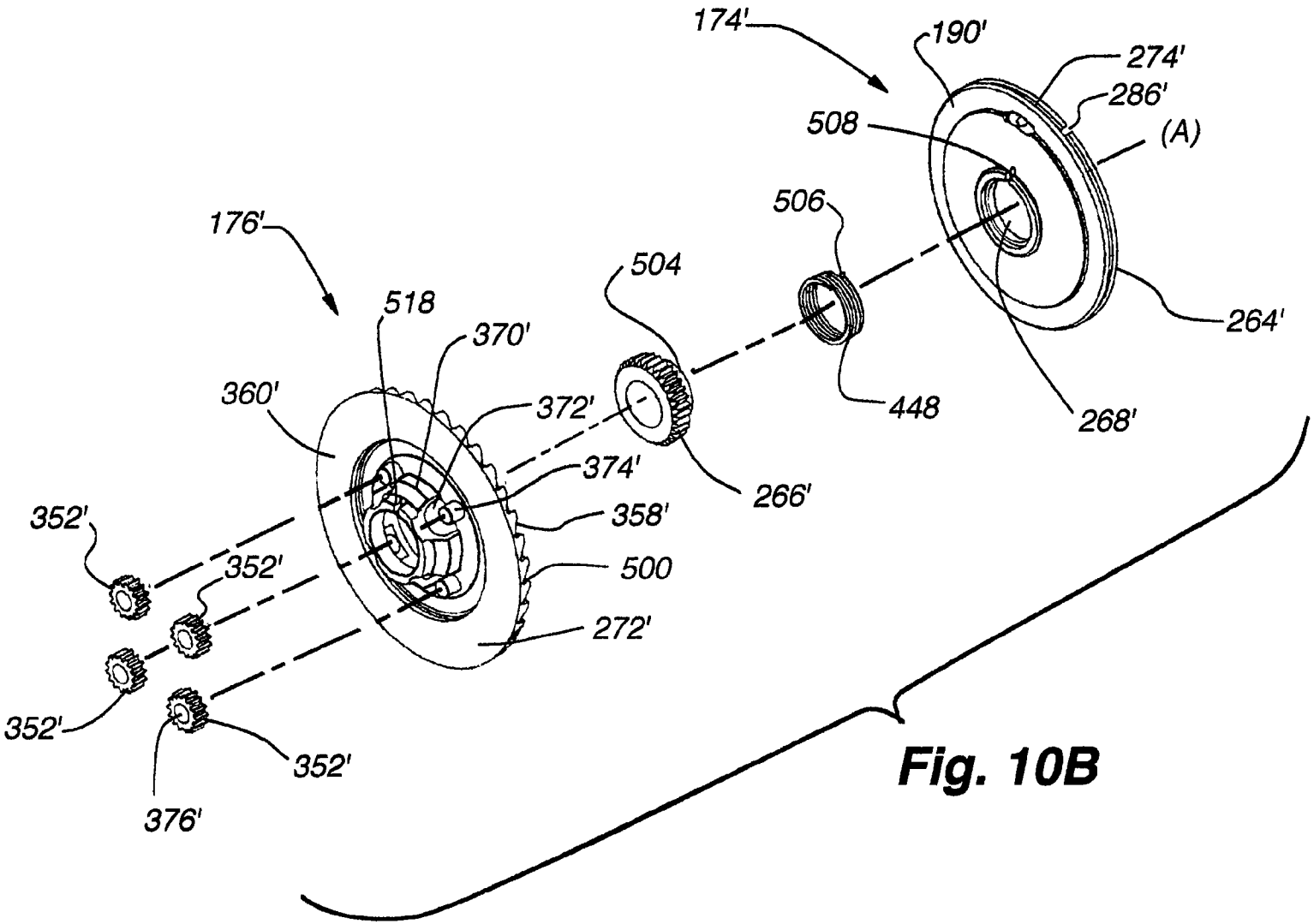
Figure 10C:
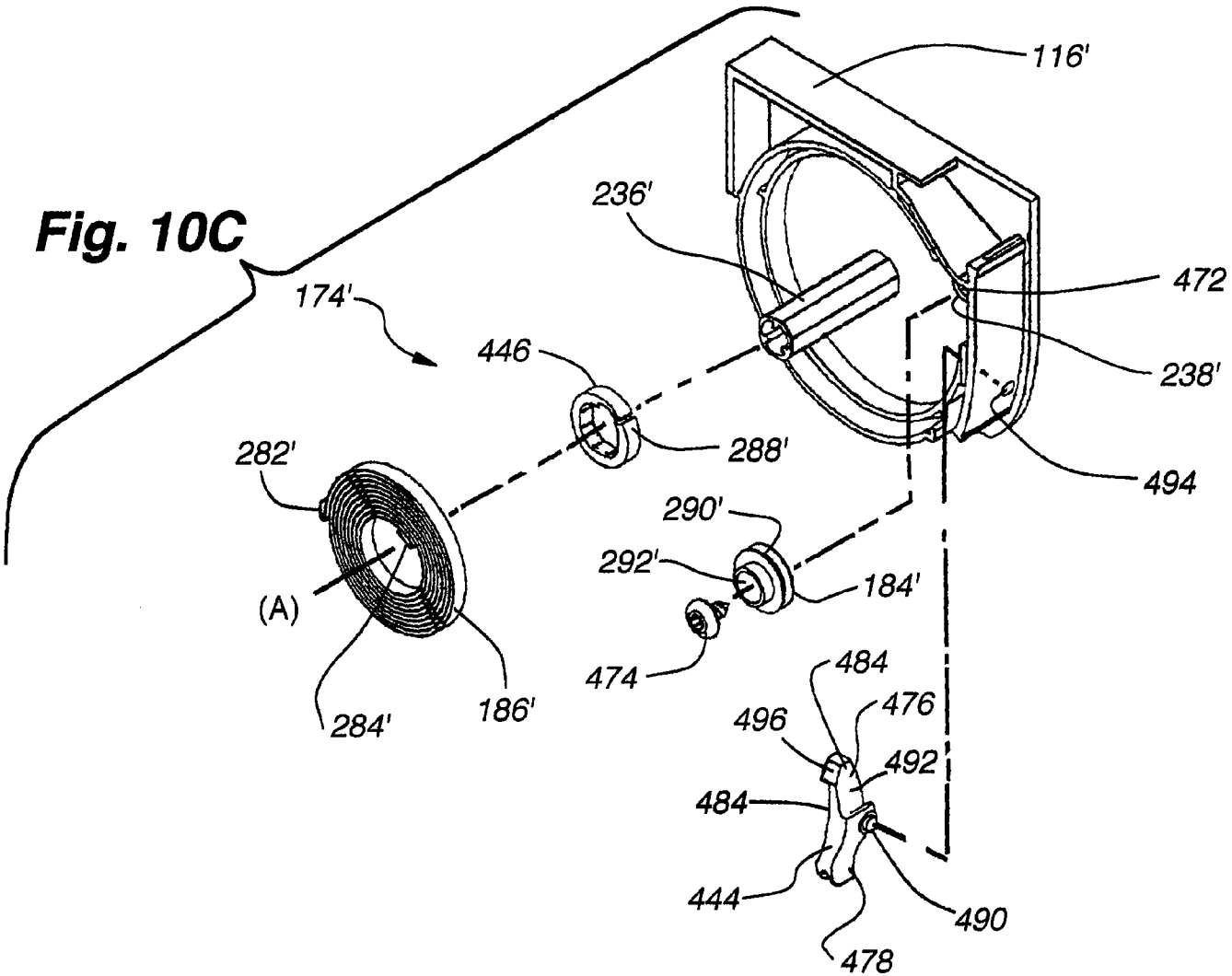
Figure 11A:
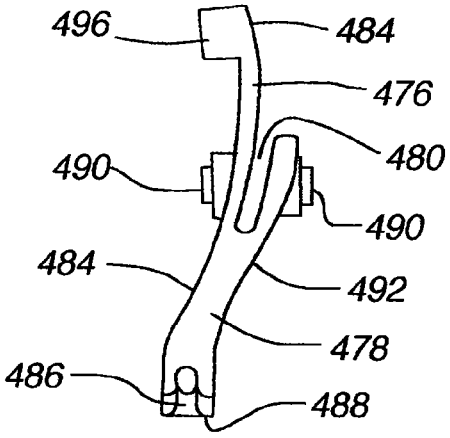
FIG. 11A is a left-side view of a control arm used in the control system depicted in FIG. 10C.
Figure 11B:
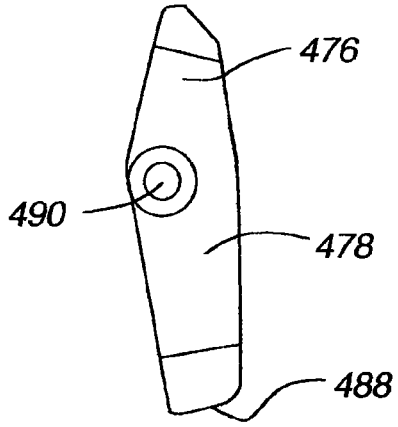
FIG. 11B is a rear-side view of the control arm used in the control system depicted in FIG. 10C.
Figure 11C:
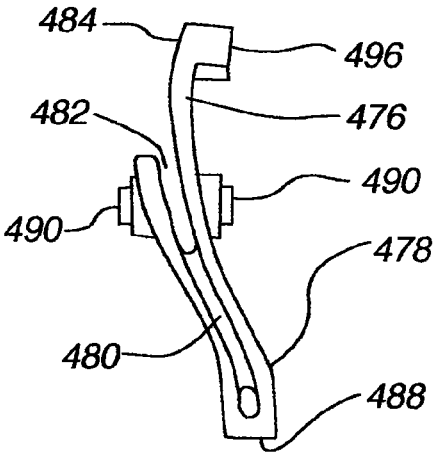
FIG. 11C is a right-side view of the control arm used in the control system depicted in FIG. 10C.
Figure 11D:
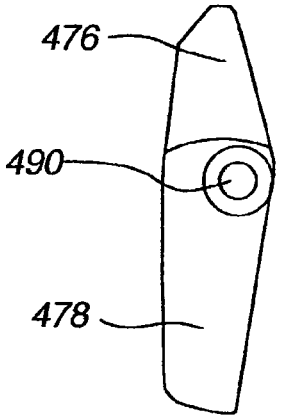
FIG. 11D is a front-side view of the control arm used in the control system depicted in FIG. 10C.
Figure 11E:
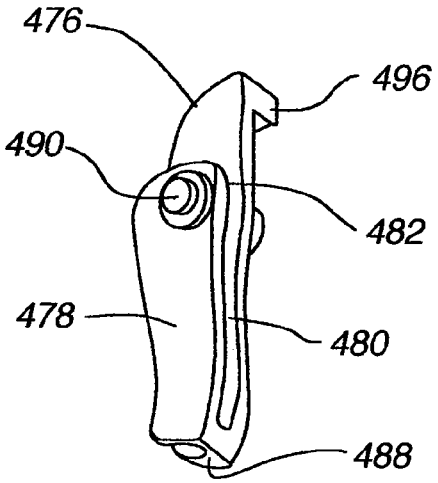
FIG. 11E is a right rear-side isometric view of the control arm used in the control system depicted in FIG. 10C.
Figure 11F:
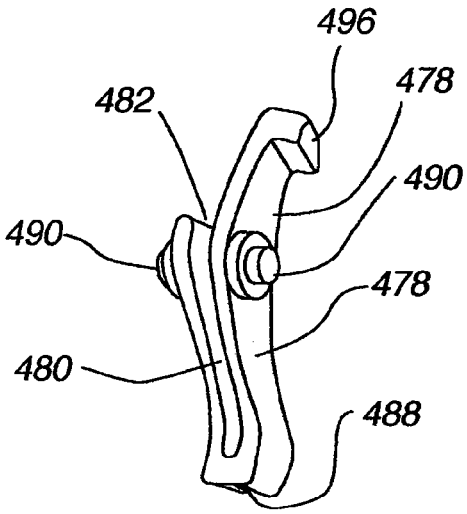
FIG. 11F is a left rear-side view of the control arm used in the control system depicted in FIG. 10C.

As shown in FIGS. 9, 10B, and 10C, the input assembly 174' of the second embodiment includes the pull cord 120 connected with the operating cord 124 through the stopper or coupler 125, a control arm 444, a pulley 184', a clock spring 186', a spring retainer 446, an axle 188', a cord spool 190', and a clutch spring 448, all cooperatively engaging to convert linear movement of the pull cord 120 into a rotational movement of the cord spool 190'. Unlike the first embodiment, where the sun gear is integrally connected with the cord spool, rotational movement of the cord spool 190' in the second embodiment is imparted to a separate sun gear 266' through the clutch spring 448. Also, unlike the first embodiment, the input assembly of the second embodiment does not include the shift arm and cord guide arm. Instead, as discussed in more detail below, the second embodiment utilizes the control arm 444 to perform functions similar to the shift arm and the cord guide arm. As such, the operating cord 124 extends from the stopper or coupler 125 and passes through the control arm 444 and the pulley 184' from where it is wrapped around the cord spool 190'. The direction in which the pull cord is pulled causes the control arm to pivot and engage the transmission 176', which in turn, dictates the direction in which the covering 100 is moved. The input assembly of the second embodiment also provides the function of automatically rewinding the operating cord onto the cord spool after the user releases tension from the pull cord, but the clock spring 186' in the second embodiment is connected in a slightly different configuration than in the first embodiment.

Cord Spool/Input Assembly

Similar to the first embodiment, the various elements of the input assembly are supported by a right end cap 116'. As shown in FIGS. 9 and 10C, the clutch spring 448, the cord spool 190', the clock spring 186', the spring retainer 446, and the axle 188' are supported by a first end cap shaft 236', whereas the pulley 184' is rotatably supported on a second end cap shaft 238'. As discussed below, the control arm 444 is pivotally connected with the right end cap in another location.

As with the first embodiment, the axle 188' interfaces with the input assembly 174', the transmission 176', and the output assembly 178'. As such, additional descriptions of the various functions performed by the axle will be described below separately as part of the detailed descriptions of the input assembly, the transmission, and the output assembly.

As shown in FIG. 10A, the axle 188' of the second embodiment may include a plurality of outer surfaces defined along its length by varying diameters. Each outer surface is directed to a function more particularly described below. The axle 188' shown in FIG. 10A includes a first cylindrical surface 450, a second cylindrical surface 452, a third cylindrical surface 454, a fourth cylindrical surface 456, and a fifth cylindrical surface 458. The axle 188' further includes a first end surface 460 and a second end surface 462, the second surface having a small raised surface 464 extending therefrom. A bevelled hole 466 passes through the center of the axle 188' defining a first opening 468 at the first end surface and a second opening 470 at the small raised surface extending from the second end surface. Similar to the first embodiment, the bevelled surface of the first end cap shaft 226' is adapted to cooperate with a correspondingly shaped bevelled female surface on the inside of the first opening 468. As such, the axle 188' does not rotate relative to the first end cap shaft 236'.

Cord Spool & Clock Spring

The structural and cooperative relationship between the cord spool 190', the spring retainer 446, the clock spring 186', the axle 188', the pulley 184', the control arm 444, and the operating cord 124 of the input assembly 174' will now be described. As shown in FIG. 10B, the cord spool is similar to the cord spool of the first embodiment, except the sun gear 266' is not integrally connected thereto. As previously mentioned, the cord spool engages the sun gear through the clutch spring 448.

As shown in FIG. 10B, the cord spool 190' includes a groove 274' in the outer circumference adapted to receive the operating cord 124' wound thereupon. As shown in FIG. 15A and discussed in more detail below, the operating cord is wound clockwise (as viewed by looking toward the inner side of the right end cap) onto the groove of the cord spool. As such, when the operating cord is unwound from the cord spool (i.e. when a user pulls on the pull cord), the cord spool rotates counterclockwise. The operating cord is connected to the cord spool through a knot 276' tied in the second end 278 of the operating cord 124 located in the circular cavity, as described with reference to the first embodiment.

The clock spring 186' is stored inside a circular cavity 264' of the cord spool 190'. The clock spring functions to automatically retract the operating cord onto the cord spool when tension is released from the pull cord 120', as described with reference to the first embodiment. However, the clock spring 186' is connected with the control system differently in the second embodiment. As shown in FIGS. 10B and 10C, the clock spring 186' includes a first tang 282' located in the outer winding of the clock spring, and a second tang 284' located in the inner winding of the clock spring. The first tang 282' engages a first clock spring recess 286' located on the cord spool 190' to connect the clock spring with the cord spool. The second tang 284' engages a second clock spring recess 288' on the spring retainer 446. The spring retainer 446 is ring-shaped with an inside diameter bevelled to cooperate with the bevelled surface of the first end cap shaft 236'. As such, the spring retainer cannot rotate about the first end cap shaft.

When a user pulls on the pull cord 120, which in turn unwinds the operating cord 124 from the cord spool, the cord spool 190' rotates counterclockwise. Because the clock spring 186' is fixed at the second tang 284' by the spring retainer 446, the clock spring contracts from an expanded state as the cord spool rotates counterclockwise. As such, rotation of cord spool coils the clock spring to the extent of the operating cord is wound thereupon. When tension is released from the pull cord and operating cord, the cord spool is rotated clockwise by the expanding the clock spring to rewind the operating cord back onto the cord spool. As described with reference to the first embodiment, when the control system is assembled with its components, the axle 188' is inserted into the opening of the cord spool 268' and wound slightly to place a pre-load on the clock spring 186'. The pre-load on the clock spring assures that some tension is always maintained on the operating cord when the system is not in use.

Operating Cord Path Spool to Clasp

As shown in FIGS. 10B, 10C, and 15A, the operating cord 124 passes from the cord spool 190' to wrap clockwise partially around a groove 290' in the outer circumference of the pulley 184'. From the pulley, the operating cord exits the head rail assembly 112' through the control arm 444. As previously mentioned, the pulley 184' is supported on the second end cap shaft 238', whereas the control arm 444 is pivotally connected with the right end cap 116'. More particularly, the pulley 184' has a center opening 292' adapted to receive the second end cap shaft 238'. The second end cap shaft includes a center hole 472 adapted to receive a pulley fastener 474 to prevent the pulley 184' from moving longitudinally along the second end cap shaft while at the same time allowing the pulley to freely rotate about the second end cap shaft.

Control Arm

As shown in FIGS. 10C and 11A–11F, the control arm is an elongate member defined by an upper portion 476 and a lower portion 478, and having a channel 480 extending longitudinally from a first opening 482 on a front side 492 of the upper portion 476 to a second opening 486 on a bottom side 488 of the lower portion 478. The control arm also includes control arm axles 490 located between the upper portion and the lower portion and extending from a front side 492 and the rear side 484. The control arm axles 490 are adapted to connect with control arm axle apertures 494 in the right end cap 116'. As such, the control arm is pivotally connected to the right end cap about the control arm axles. When the control arm is connected with the right end cap, the upper portion 476 and channel 480 of the control arm curves from the first opening 482 to the second opening in a direction away from the right end cap. When assembled, the operating cord 124 passes from the pulley 184' to the first opening 482 of the control arm 444, through the channel 480, and exits from the second opening 486 to connect with the stopper or coupler 125. The control arm also includes a hook 496 on a left side 498 of the upper portion 476. As discussed below with reference to the transmission, the hook 496 is adapted to engage gear teeth 500 on the planet carrier 272' (see FIG. 15BB1–15BB3).

Pull Direction Determines Pivot of Control Arm

As the operating cord 124 travels through the channel 480 in the control arm 444, the direction in which the operating cord is pulled determines whether the control arm pivots to be engaged or disengaged with the transmission 176'. If the pull direction is in the upward operating pull direction 130 (see FIG. 2), the operating cord moves along an inner right side 502 of the channel 480 in the control arm 444, as shown in FIG. 15BB3. As such, the force from the operating cord on the right side of the channel causes the control arm to pivot counterclockwise about the control arm axles 490 (as viewed from the front side of the head rail assembly 112'). When the control arm pivots, the hook 496 engages the gear teeth 500 on the planet carrier 272'. Alternatively, if the pull force is in the downward operating pull direction 132 (see FIG. 3), the operating cord moves along the inner left side 498 of the channel 480 in the control arm 444, as shown in FIG. 15BB2. As such, the operating cord does not cause the control arm to pivot, and the hook does not engage the gear teeth on the planet carrier.

Cord Spool, Clutch Spring & Sun Gear Engagement

Figure 12:
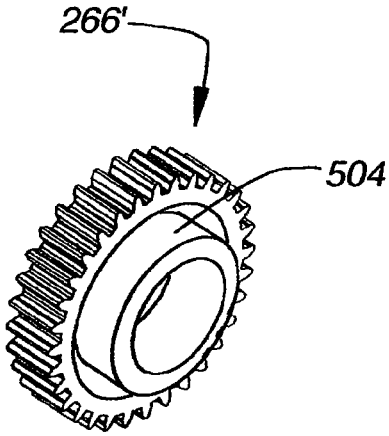
FIG. 12 is a rear right-side isometric view of a sun gear used in the control system depicted in FIG. 10B.

As previously mentioned, rotational movement of the cord spool 190' is imparted to the sun gear 266' through the clutch spring 448. As shown in FIGS. 10B, 10C, and 12, the clutch spring has an inside diameter adapted to be received by an extended portion 504 of the sun gear 266'. The inside diameter of the clutch spring is slightly less than the outside diameter of the extended portion 504. As such, the clutch spring is frictionally engaged with the extended portion of the sun gear. A circular opening 268' in the center of the cord spool 190' is adapted to rotatably support the sun gear 266' on the extended portion 504 of the sun gear 266'. The clutch spring 448 engages the circular opening 268' in the cord spool 190' where a clutch spring tang 506 is received by a notch 508 on the circular opening 268'. Therefore, when the cord spool rotates either clockwise or counterclockwise, the cord spool engages the clutch spring tang to cause the clutch spring to rotate in the same direction.

The clutch spring 448 is arranged and configured on the extended portion 504 of the sun gear 266' such that when force is applied to the clutch spring tang 506 in the counterclockwise direction from the cord spool, the coils of the clutch spring tighten to "grip" the extended surface of the sun gear, causing the sun gear to rotate in the counterclockwise direction as well. Alternatively, when force is applied to the clutch spring tang in the clockwise direction from the cord spool (i.e. when the clock spring recoils the operating cord onto the cord spool), the coils of the clutch spring do not tighten on the extended portion of the sun gear. As such, the force applied to the clutch spring tang are large enough to overcome the frictional forces between the clutch spring and the extended surface, causing the clutch spring to "slip" on the extended surface. Therefore, when the cord spool rotates in the clockwise direction, the sun gear does not turn.

Figure 15:
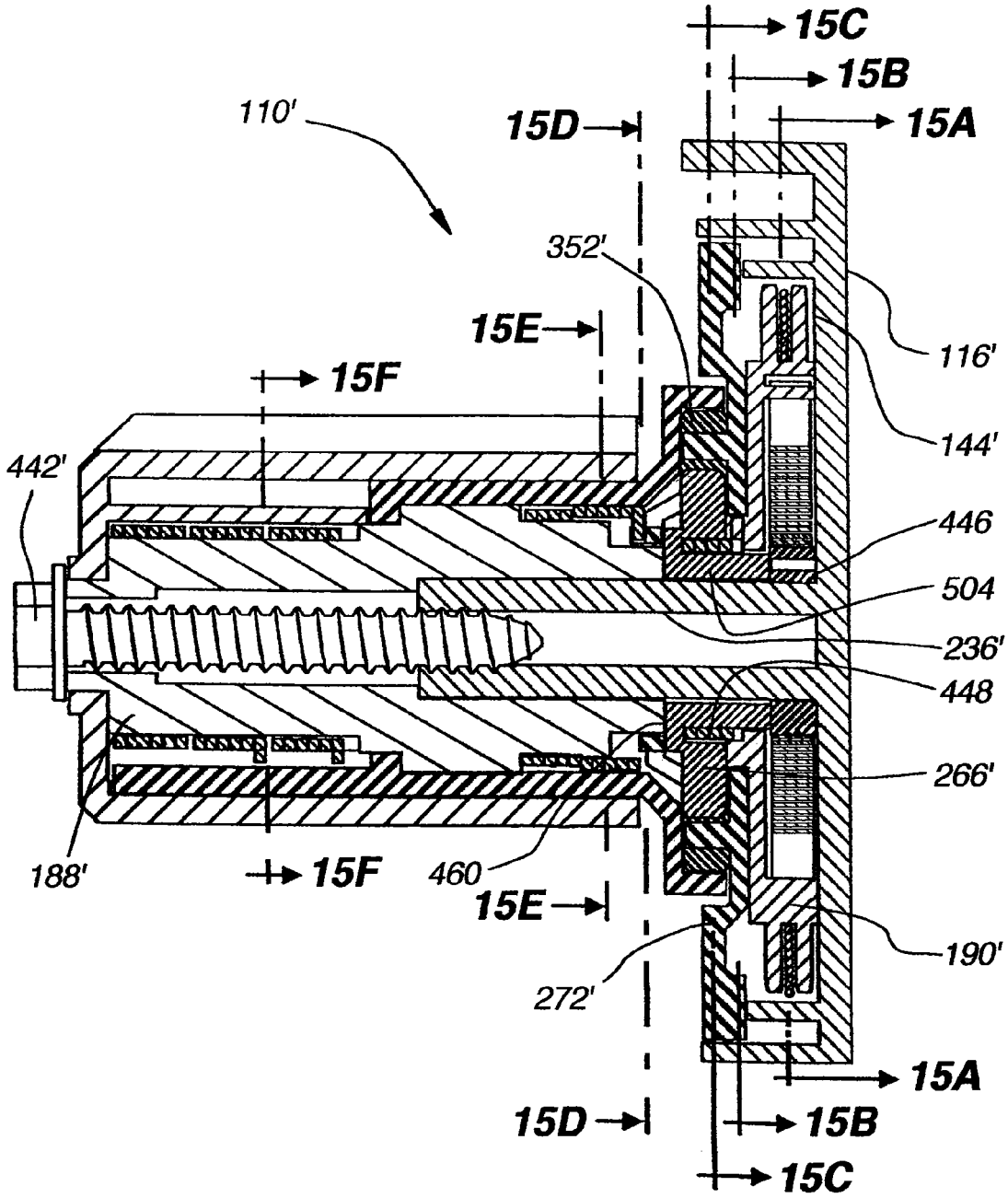
FIG. 15 is a cross-sectional view of the control system depicted in FIG. 9, taken along line 15—15.
Figure 15A:
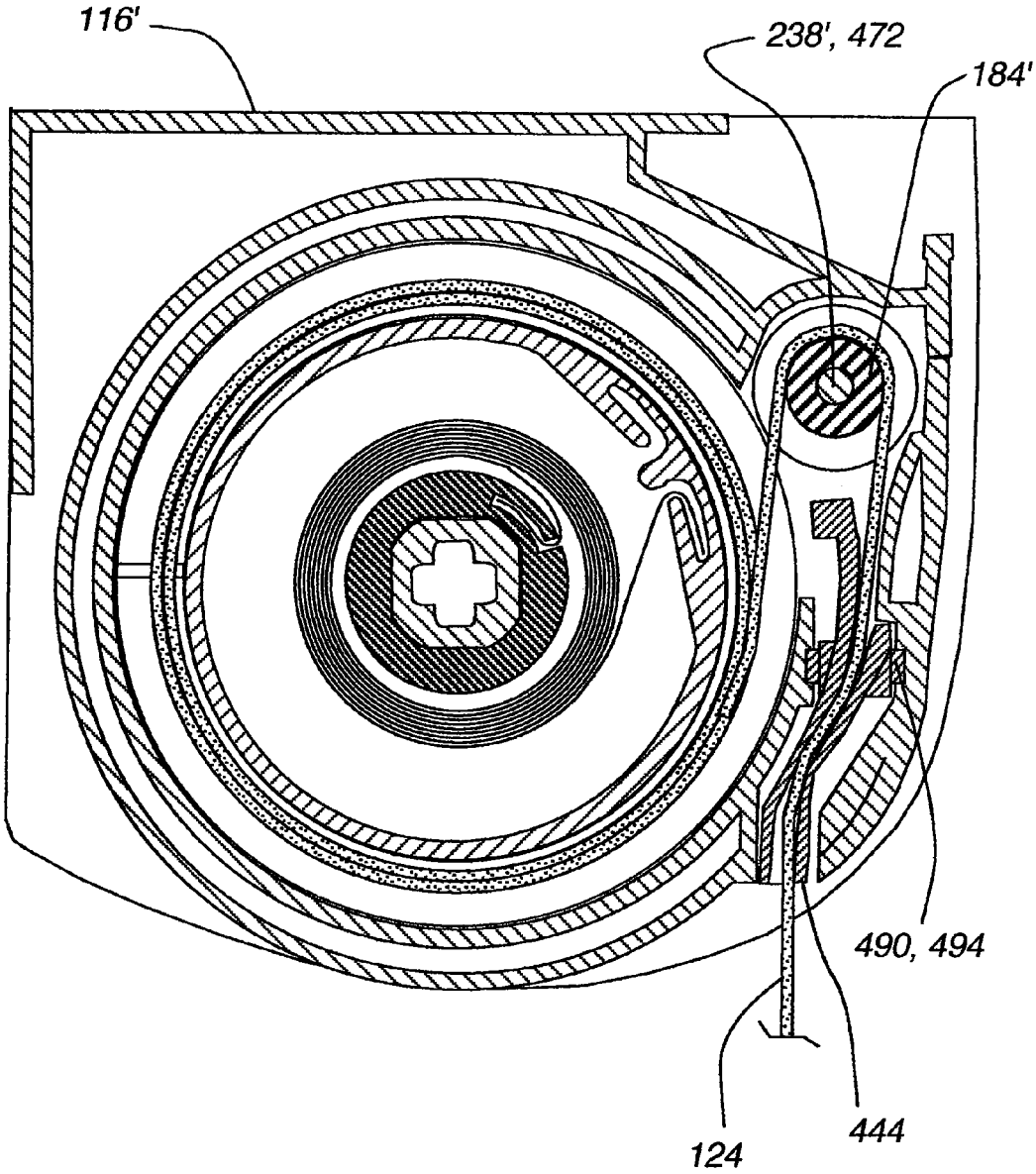
FIG. 15A is a cross-sectional view of the control system depicted in FIG. 15, taken along line 15A—15A.
Figure 15B:
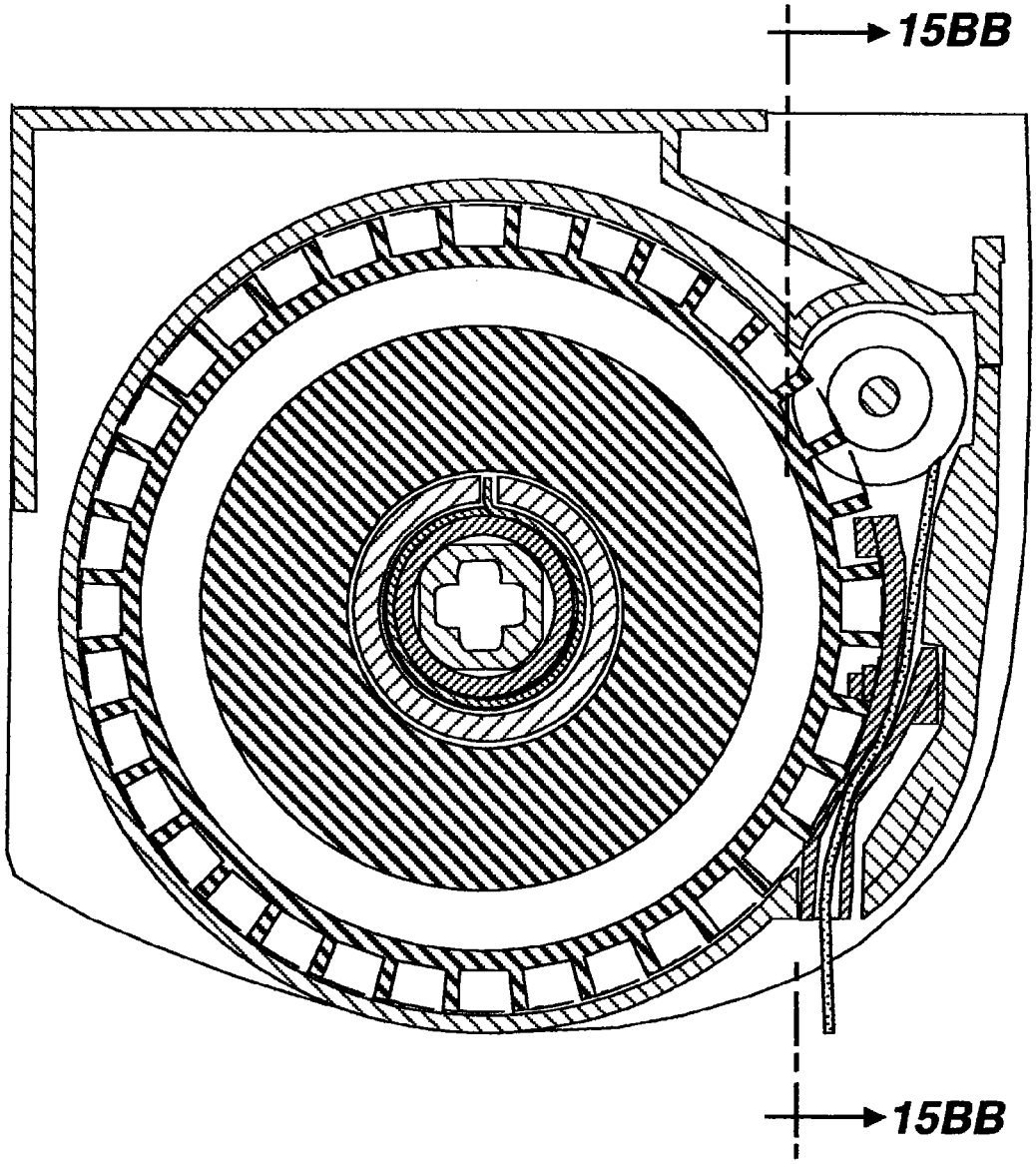
FIG. 15B is a cross-sectional view of the control system depicted in FIG. 15, taken along line 15B—15B.

As shown in FIG. 15, when the control system 110' is assembled, the spring retainer 446 is supported by the first end cap shaft 236' and abuts the inner side 144' of the right end cap 116'. The cord spool 190' is rotatably supported on the extended surface 504 of the sun gear 266' along with the clutch spring 448. The sun gear is located on the first end cap shaft in an abutting relationship between the first end surface 460 of the axle 188' and the spring retainer 446. The sun gear 266', as described below, is rotatably supported by planet gears 352' on the planet carrier 272', which is rotatably supported on the first surface 450 of the axle 188'.

Final Summary of Input Assembly

To summarize the operational description of the input assembly 174' on the second embodiment, as a user pulls on the pull cord 120 to move the covering 100 in the desired direction, the operating cord 124 is unwound from the cord spool 190', causing the cord spool to rotate in a counterclockwise direction. If the user pulls the pull cord in the upward operating direction 130 (see FIG. 2), the operating cord impinging on the channel 480 of the control arm 444 causes the control to pivot such that the hook 496 on the control arm engages the transmission 176', causing the head roller 108 to rotate in a direction to wrap the covering onto the head roller. Alternatively, if the user pulls the pull cord in the downward operating direction 132 (see FIG. 3), the control arm does not pivot to engage the hook with the transmission, causing the head roller to rotate in a direction to unwrap the covering from the head roller. Rotation of the cord spool 190' through the clutch spring 448 operates as an input to the transmission, which imparts rotational movement to the output assembly 178' and the head roller 108. After the user releases tension from the pull cord and operating cord, the clock spring 186' causes the cord spool to rotate in a clockwise direction, automatically winding the operating cord back onto the cord spool. As the cord spool rotates in the clockwise direction, the clutch spring slips on the sun gear 266', imparting no rotational movement to the transmission. The operating cord is automatically retracted until the stopper or coupler 125 engages the second opening on the control arm.

Transmission Overview

The structure and operation of the transmission 176' of the second embodiment will now be discussed in detail. As shown in FIGS. 10A and 10B, the transmission includes the sun gear 266' having its extended surface 504 frictionally engaged with the clutch spring 448, the planet carrier 272', four planet gears 352', a stepped spring 510, and a ring gear 356', all cooperatively engaging to convert rotational movement of the cord spool into rotational movement of the ring gear, which imparts rotational movement to the output assembly 178'. As discussed in more detail below, a user pulling on the pull cord 120 causes the cord spool to rotate counterclockwise (see FIG. 15A). Because the cord spool engages the clutch spring tang 506 and causes the clutch spring to tighten on the extended surface of the sun gear, the sun gear also rotates in a counterclockwise direction. If the user pulls the pull cord in the upward operating direction 130 (see FIG. 2), the control arm 444 pivots until the hook 496 engages gear teeth 500 on the planet carrier 272', which prevents the planet carrier from rotating (see FIG. 15BB3). Counterclockwise rotation of the sun gear 266' causes clockwise rotation of the four planet gears 352' (see FIG. 15C), which in turn, engage the ring gear 356' to turn the ring gear in a clockwise direction. Alternatively, if the user pulls the pull cord in the downward operating direction 132 (see FIG. 3), the control arm does not pivot to engage the hook with the teeth on the planet carrier (see FIG. 15BB2), allowing the planet carrier to rotate. As such, counterclockwise rotation of the sun gear causes clockwise rotation of the four planet gears, which in turn, cause the planet carrier to rotate counterclockwise. As the planet carrier rotates counterclockwise, the planet carrier engages the step spring to turn the step spring in a counterclockwise direction, which in turn, engages the ring gear to turn it in a counterclockwise direction (see FIGS. 15D2 and 15E2).

Sun Gear, Planet Carrier & Planet Gears

Figure 14:
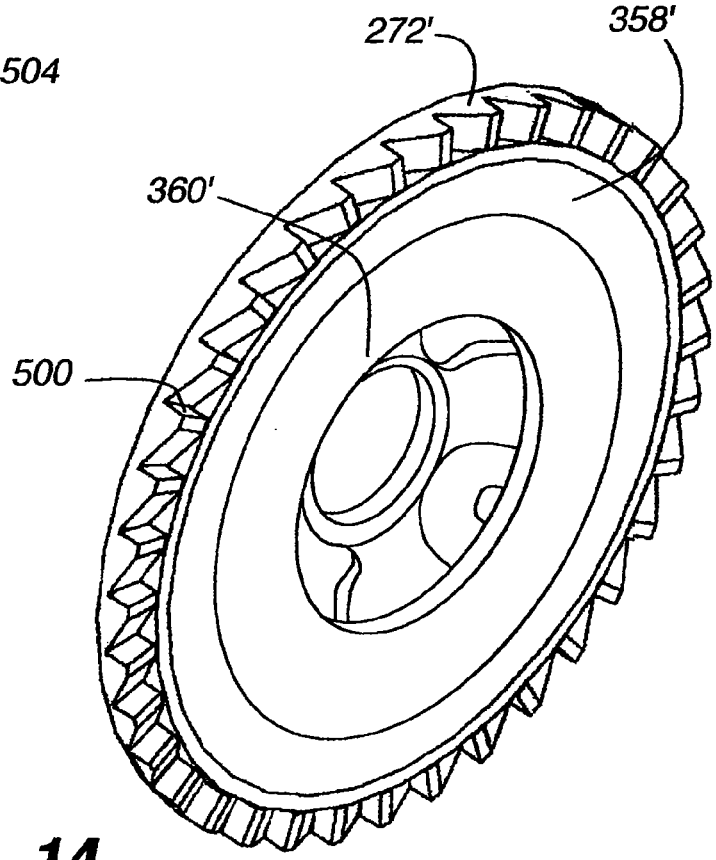
FIG. 14 is a right-side isometric view of a sun gear used in the control system depicted in FIG. 10B.
Figure 15C:
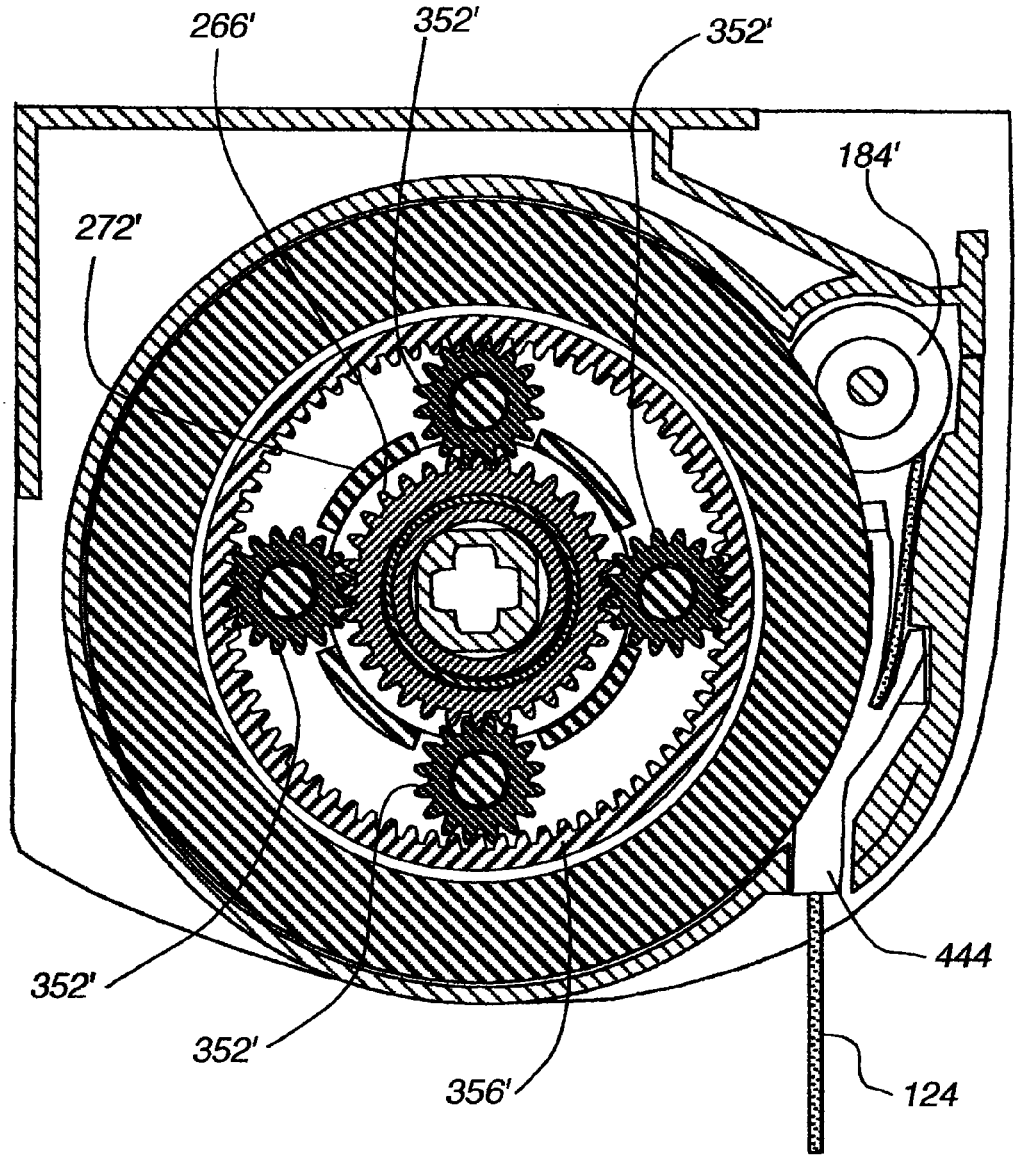
FIG. 15C is a cross-sectional view of the control system depicted in FIG. 15, taken along line 15C—15C.

As shown in FIGS. 10B and 15C, the sun gear 266' is adapted to engage four planet gears 352' on the planet carrier 272'. The planet carrier of the second embodiment is similar to the planet carrier of the first embodiment in that it is disc-shaped and has a first side 358' and a second side 360' with a center circular opening 362' passing therethrough, as shown in FIGS. 10B and 14. The sun gear is adapted to be received in the center circular opening of the planet carrier from the first side. However, the planet carrier of the second embodiment includes a series of gear teeth 500 extending from the periphery of the first side 358' of the planet carrier, which are adapted to engage the hook 496 on the control arm 444.

As shown in FIG. 10B, the second side 360' of the planet carrier 272' of the second embodiment includes a circularly-shaped raised structure 370' adapted to accept the four planet gears 352'. The raised structure has four sun gear openings 372' spaced at ninety degree intervals therearound. Planet gear axles 374' extending from the second side of the planet carrier are radially positioned to correspond with the location of the sun gear openings in the raised structure. The planet gears are configured with center holes 376' adapted to receive the planet gear axles. As such, when the planet gears are positioned on the planet carrier axles, the planet gears project geared surfaces into the sun gear openings. Moreover, upon inserting the sun gear into the center circular opening of the planet carrier, the sun gear engages the planet gears. Therefore, rotation of the cord spool 190', rotates the sun gear 266', which in turn, rotates the four planet gears 352'. In addition, engagement of the planet gears with the sun gear acts to support the planet carrier.

Engagement of Planet Carrier and Step Spring

As shown in FIGS. 10A, 10B, 15D1, and 15D2, the step spring 510 is adapted to receive the second surface 452 of the axle 188'. The step spring is defined by a raised portion 512 integral with a lower portion 514. Various embodiments may utilize varying distances of separation between the raised and lower portions. For example, in one embodiment of the present invention, the raised portion is separated or stepped by a distance of 0.02 inches. The inside diameter of the lower portion 514 is slightly less than the outside diameter of the second surface 452 of the axle 188'. As such, the lower portion of the step spring frictionally engages the second surface. In addition, the raised portion 512 of the step spring 510 engages the planet carrier 272' where a step spring tang 516 is received by a step spring notch 518 on the second side 360' of the planet carrier near the outer periphery of the center circular opening 362'. Therefore, when the planet carrier rotates, the planet carrier engages the step spring tang to cause the step spring to rotate in the same direction.

Although the lower portion 514 of the step spring 510 is frictionally engaged with the second surface 452 of the axle 188', sufficient force applied to the step spring tang in either the clockwise or counterclockwise direction by the planet carrier 272' will cause the step spring to rotate about the second surface of the axle. In addition, the raised portion of the step spring is biased to expand when force is applied to the step spring tang in a counterclockwise direction. As such, when the planet carrier rotates in a counterclockwise direction, imparting a force on the step spring tang 516 in the same direction, the raised portion of the step spring is caused to expand and engage the ring gear 356', which in turn, causes the ring gear to turn in a counterclockwise direction. This is discussed in more detail below.

Ring Gear

Figure 13:
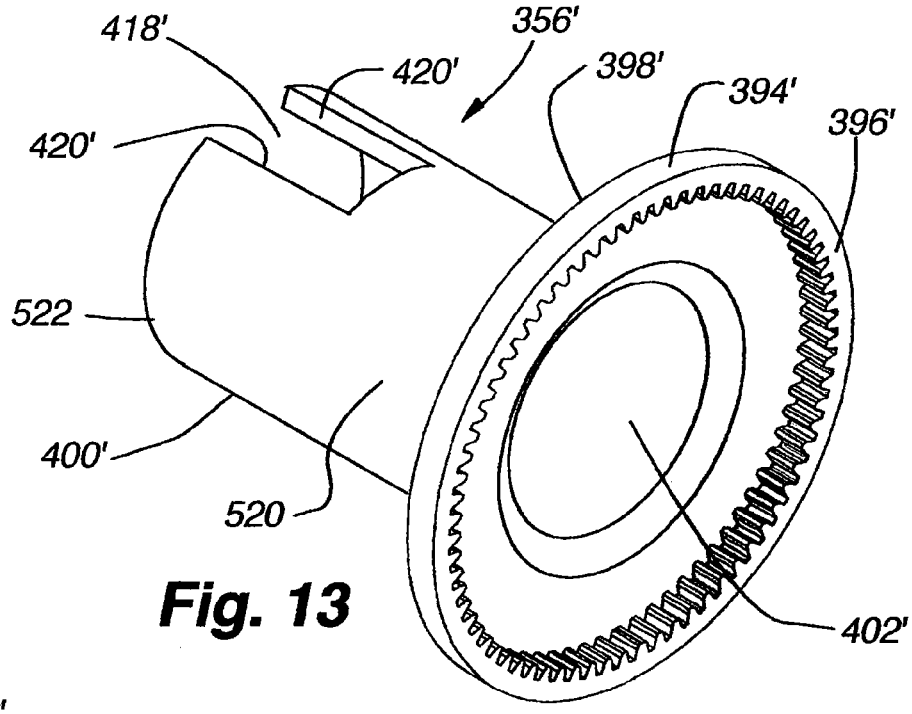
FIG. 13 is a right-side isometric view of a ring gear used in the control system depicted in FIG. 10B.

As previously mentioned, depending upon which direction the user pulls on the pull cord 120, either the four planet gears 352' or the step spring 510 engage the ring gear 356' to rotate the ring gear in either a clockwise direction or a counterclockwise direction, respectively. Similar to the first embodiment and as shown in FIGS. 10A and 13, the ring gear 356' is defined by a flanged portion 394' having a first side 396' and second side 398' with a cylindrical portion 400' extending from the second side. The cylindrical portion is defined by a step spring section 520 and a brake engagement section 522 separated by a lip 524 extending from the interior walls of the cylindrical portion 400'. A cylindrical opening 402' passes through the flanged portion 394' and the cylindrical portion 400'. The inner diameter of the step spring section 520 is adapted to rotatably support the ring gear 356' on the third surface 454 of the axle 188' and the lip 525 is adapted to engage the fourth surface 456 of the axle as well as a ledge 526 defined by the transition from the third surface 454 to the fourth surface 456 on the axle. As shown in FIG. 13, the first side of the flanged portion is largely open ended having a first geared lip 404 adapted to engage the four planet gears on the planet carrier.

Unlike the first embodiment, the ring gear 356' in the second embodiment does not include a second geared lip. As shown in FIG. 13, the interior walls of the cylindrical portion 400' extending from the second side of the flanged portion of the ring gear of the second embodiment are smooth. As previously mentioned, the step spring 510 is biased to expand the raised portion 512 when a counterclockwise force is applied to the step spring tang 516. As such, counterclockwise rotation of the planet carrier 272' expands the raised portion of the step spring to frictionally engage the interior walls in the step section 520 of the cylindrical portion 400' of the ring gear 356'. Engagement of the raised portion of the step spring with the ring gear along with the continued rotation of the planet carrier overcomes the frictional forces between the lower portion 514 of the step spring 510 and the second surface 452 of the axle 188'. As such, the step spring rotates counterclockwise about the second surface of the axle, but the frictional force between the second surface and the lower portion of the step spring allows the raised portion to remain in an expanded state while the planet carrier 272' continues rotating in a counterclockwise direction.

As shown in FIGS. 10A and 13, the brake engagement section 522 of the cylindrical portion 400' of the ring gear 356' includes a U-shaped channel 418' formed therein with two side walls 420' extending from the second side 398' of the flanged portion 394' to the end of the cylindrical portion 400'. Similar to the first embodiment and as discussed below, the two side walls function to cooperate with the braking system.

Summary of the Transmission

To summarize the operational description of the transmission of the second embodiment, as a user pulls on the pull cord 120 to move the covering 100 in the desired direction, the operating cord 124 is unwound from the cord spool 190', causing the cord spool and the clutch spring 448 to rotate in a counterclockwise direction. Engagement of the clutch spring on the extended surface 504 of the sun gear 266' causes the sun gear to rotate in a counterclockwise direction. If the user pulls the pull cord in the upward operating direction 130 (see FIGS. 2 and 15BB3), the control arm 444 is allowed to pivot such that the hook 496 on the control arm engages the gear teeth 500 on the planet carrier 272', which prevents the planet carrier from rotating. As such, the counterclockwise rotation of the sun gear causes the four planet gears 352 to rotate in a clockwise rotation, which in turn, engage the first geared lip 404' of the ring gear 356' to cause the ring gear to rotate in a clockwise direction. Rotation of the ring gear, which engages the output assembly 178' (see FIG. 15F2) in the clockwise direction causes the head roller 108 to rotate in a clockwise direction to wrap the covering onto the head roller.

Alternatively, if the user pulls the pull cord in the downward operating direction (see FIGS. 3 and 15BB2), the control arm is prevented from pivoting to engage the hook with the gear teeth on the planet carrier, which allows the planet carrier to rotate freely about the first surface of the axle. As such, the counterclockwise rotation of the sun gear causes the four planet gears to rotate in a clockwise rotation about their respective planet carrier axles, which in turn, engage the first geared lip of the ring gear to cause the planet carrier to rotate in a counterclockwise direction. As the planet carrier 272' rotates in the counterclockwise direction, a force is applied to the step spring tang 516 in the counterclockwise direction, which causes the raised portion 512 of the step spring 510 to expand. The raised portion of the step spring expands to frictionally engage the inner walls of the cylindrical portion 512 of the ring gear 356', causing the ring gear to rotate in a counterclockwise direction along with the planet carrier. Rotation of the ring gear, which engages the output assembly in the counterclockwise direction causes the head roller to rotate in a counterclockwise direction to unwrap the covering from the head roller (see FIG. 15F3).

Once the user releases tension from the pull cord, the clock spring 186' recoils the operating cord onto the cord spool in a clockwise direction. As the cord spool recoils, the clutch spring 448 disengages from the extended surface 504 of the sun gear 266'. As such the planet gears and the planet carrier do not rotate. As a result, the disengagement clutch spring from the sun gear causes the rotation of the ring gear to cease.

Output Assembly Overview

The structure and operation of the output assembly for the second embodiment will now be discussed in detail. As shown in FIG. 10A, the output assembly includes a fastener 442', three wrap springs 424' rotatably supported on the fifth surface 458 of the axle, and a rotator spool 168' supported by the cylindrical portion 400' of the ring gear 356', all cooperatively engaging to convert rotational movement of the ring gear into rotational movement of the head roller 108. As discussed in more detail below, a user pulling on the pull cord in the upward operating direction 130 (see FIGS. 2 and 15BB3), causes the ring gear to rotate in a clockwise direction, which causes the rotator spool and the head roller to rotate in a clockwise direction. Alternatively, a user pulling the pull cord in the downward operating direction 132 (see FIGS. 3 and 15BB2), causes the ring gear to rotate in a counterclockwise direction, which causes the rotator spool and the head roller to rotate in a counterclockwise direction.

As shown in FIG. 10A, the three wrap springs 424' are adapted to receive the fifth surface 458 of the axle 188'. It is to be appreciated that the number of wrap springs used may vary for different embodiments of the present invention. As described above with reference to the first embodiment, the wrap springs frictionally engage the fifth surface of the axle, which provides a braking action for the ring gear 356'. When the ring gear is mounted on the axle, the brake engagement section 522 of the cylindrical portion 400' surrounds the wrap springs such that the wrap spring tangs 426' extend outwardly from the wrap springs near the side walls inside the U-shaped channel 418'.

Similarly to the first embodiment described above, a braking response is created by the side walls 420' of the U-shaped channel 418' engaging one or a plurality of wrap spring tangs 426'. As well as holding the covering 100 in a particular position, engagement of the side walls against the wrap spring tangs also help prevent the ring gear from turning too quickly when the user is pulling on the pull cord.

Rotator Spool

As shown in FIGS. 10A, 15F1–15F3, a cylindrically-shaped rotator spool 168' includes a brake housing portion 432' having a hollow interior at an open end 434'. Two longitudinal fins 528 are located on the outside of the rotator spool, which are adapted to fit with the longitudinal inner groove 154 of the head roller 108, as shown in FIG. 4. As shown in FIGS. 15F1–15F3, a longitudinal boss 438' extending along the interior wall of the rotator spool 168' is adapted to fit into the U-shaped channel 418' between the wrap spring tangs 426' near the side walls 420'. As such, when the ring gear 356' rotates in either a clockwise or counterclockwise direction, the longitudinal boss 438' of the brake housing portion 432' of the rotator spool 168' engages the side walls of the U-shaped channel. Thus, the rotator spool rotates in the same direction as the ring gear.

As shown in FIGS. 10A and 15, the rotator spool 168' is secured to the axle 188' by the fastener 442' to maintain a thrust connection between the components of the control system. More particularly, the fastener enters the channel 440' of the rotator spool and passes through the center of the axle 188' and screws into the first end cap shaft 236'. When the components of the control system are assembled on the axle and the axle is installed on the first end cap shaft, the raised surface 464 of the axle 188' extends a slight distance outwardly from the opening of the rotator spool. As such, when the fastener is screwed into the first end cap shaft, the screw head does not press against the rotator spool so as to enable rotator spool to rotate freely.

Summary

The above-described second embodiment of the control system 110' assembled on the right end cap 116' of the head rail assembly 112' allows a user to raise or lower the covering 100 by pulling on the pull cord 120 in either the upward operating pull direction 130 or the downward operating pull direction 132. The control system also allows the user to pull repetitively on the pull cord in the same direction to achieve the desired position of the covering. Once the user releases the pull cord, the control system automatically retracts the operating cord back into the head rail assembly, and the braking system holds the covering in position.

Third Embodiment

Control System Overview

A third embodiment of the present invention is illustrated in FIGS. 16–21. The third embodiment of the control system 110" provides the same functionality as the first and second embodiments described above in that the control system allows a user to raise and lower the covering 100 by repeatedly pulling downwardly on the pull cord 120. Unlike the first and second embodiments, a user of the third embodiment cannot change the direction in which the head roller 108 rotates by altering the direction in which the pull cord 120 is pulled. Instead, the user of the third embodiment manually actuates a trigger 530 on a control arm 532 to change the direction in which the head roller 108 rotates. The operating cord of the third embodiment may also utilize the tassel 128 and stopper or coupler 125 described above. The third embodiment also provides for automatic retraction of the operating cord into the head rail assembly 112" along with the braking system to hold the covering in any selected position. FIGS. 17A and 177B depict the third embodiment of the invention utilizing a spring clutch 536 to couple a cord spool 190" to an input ring gear 608. FIGS. 18A and 18B depict the third embodiment of the invention utilizing a rocker ring clutch assembly 678 to couple the cord spool 190" to the input ring gear 608. The third embodiment depicted in FIGS. 18A and 188B also utilize a spring ring to connect one tang of the clock spring 186". Other than these differences, the embodiments depicted in FIGS. 17A–17B and 18A–18B function in the same way.

Similar to the first and second embodiments described above, the control system 110" of the third embodiment includes an input assembly 174", a transmission 176", and an output assembly 178" cooperatively engaging to convert linear movement of the pull cord 120 imparted by a user into rotational movement of the head roller 108 in the required direction to provide movement of the covering in the desired direction and distance. The input assembly converts linear movement of the pull cord into rotational movement, which is imparted to the transmission. The input assembly also engages the transmission to effect the direction of rotational output from the transmission. The transmission, in turn, imparts rotational movement to the output assembly. The output assembly interfaces with the head roller to rotate the head roller in the direction dictated by the transmission and to provide the braking feature as described above with reference to the first and second embodiments. Although the third embodiment includes the three main elements described above (i.e. the input assembly, the transmission, and the output assembly), the third embodiment utilizes various different components within the three main elements, as described below.

Input Assembly Overview

Figure 16:
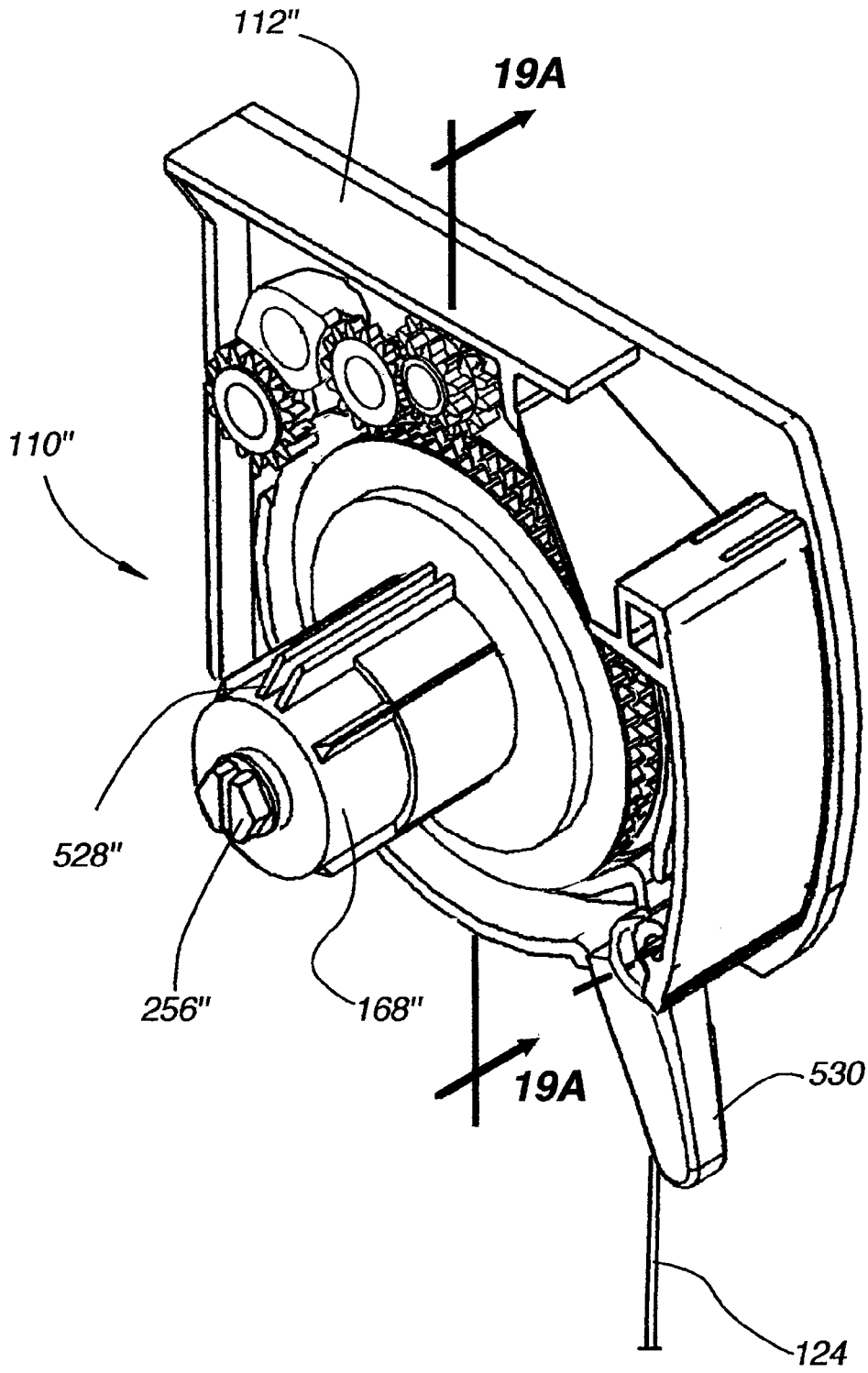
FIG. 16 is an isometric view of a control system according to a third embodiment of the invention.
Figure 17A:
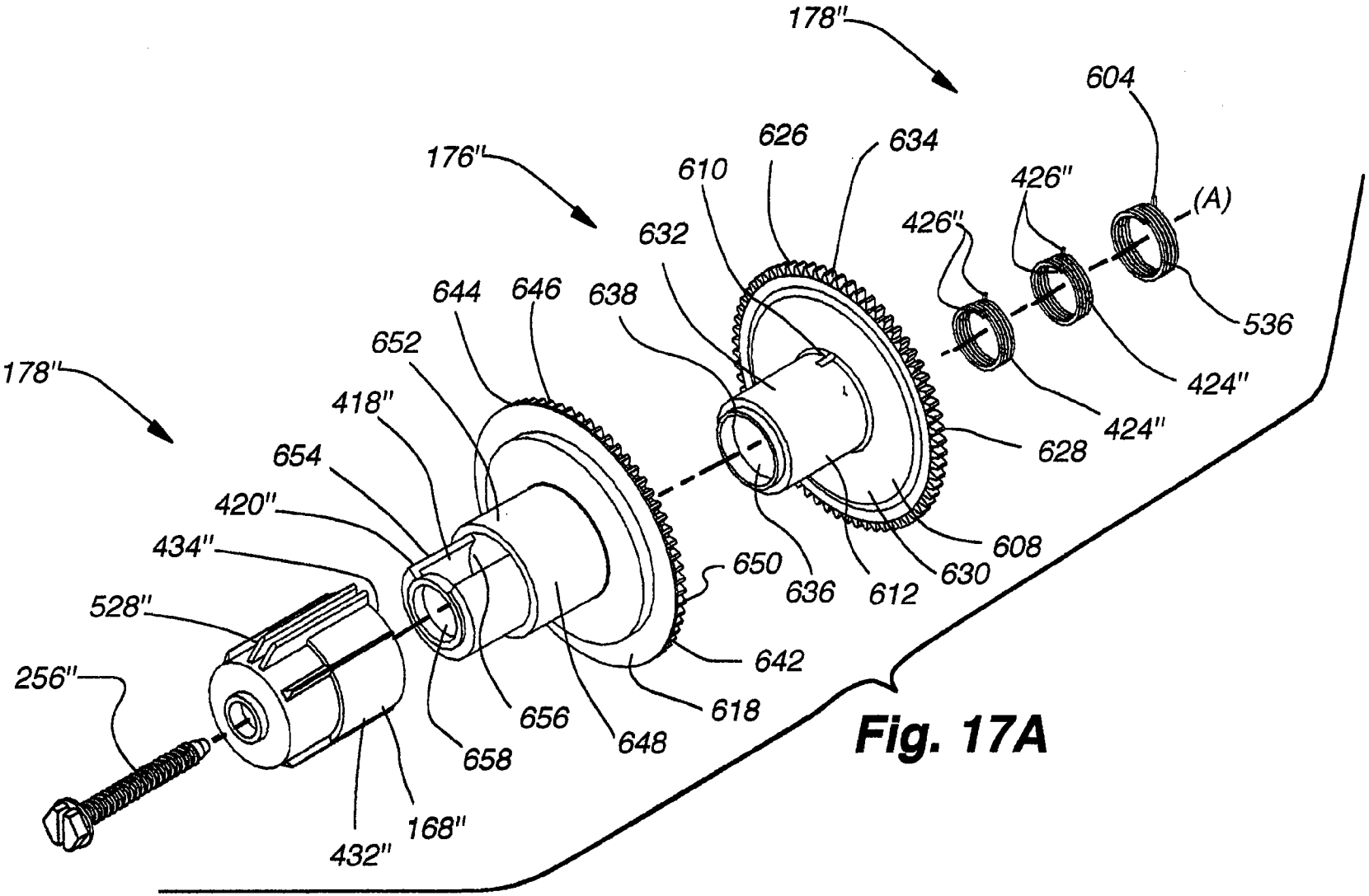
FIGS. 17A and 17B are exploded isometric views of the control system according to the third embodiment of the present invention utilizing a clutch spring to couple a cord spool to a ring gear.
Figure 18A:
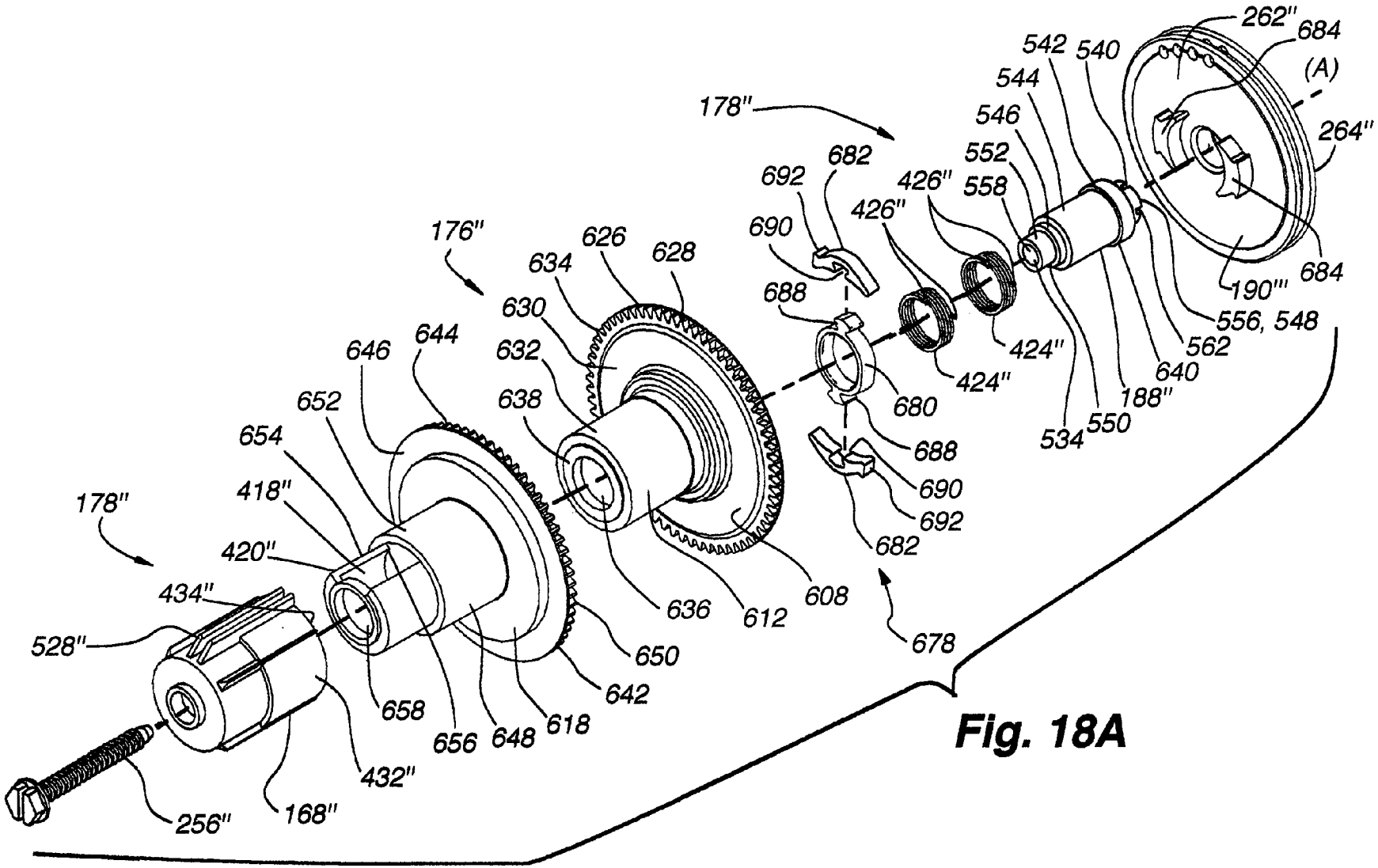
FIGS. 18A and 18B are exploded isometric views of the control system according to the third embodiment of the present invention utilizing a rocker ring clutch assembly to couple the cord spool to the ring gear and a spring ring to secure one tang of a clock spring.
Figure 18B:
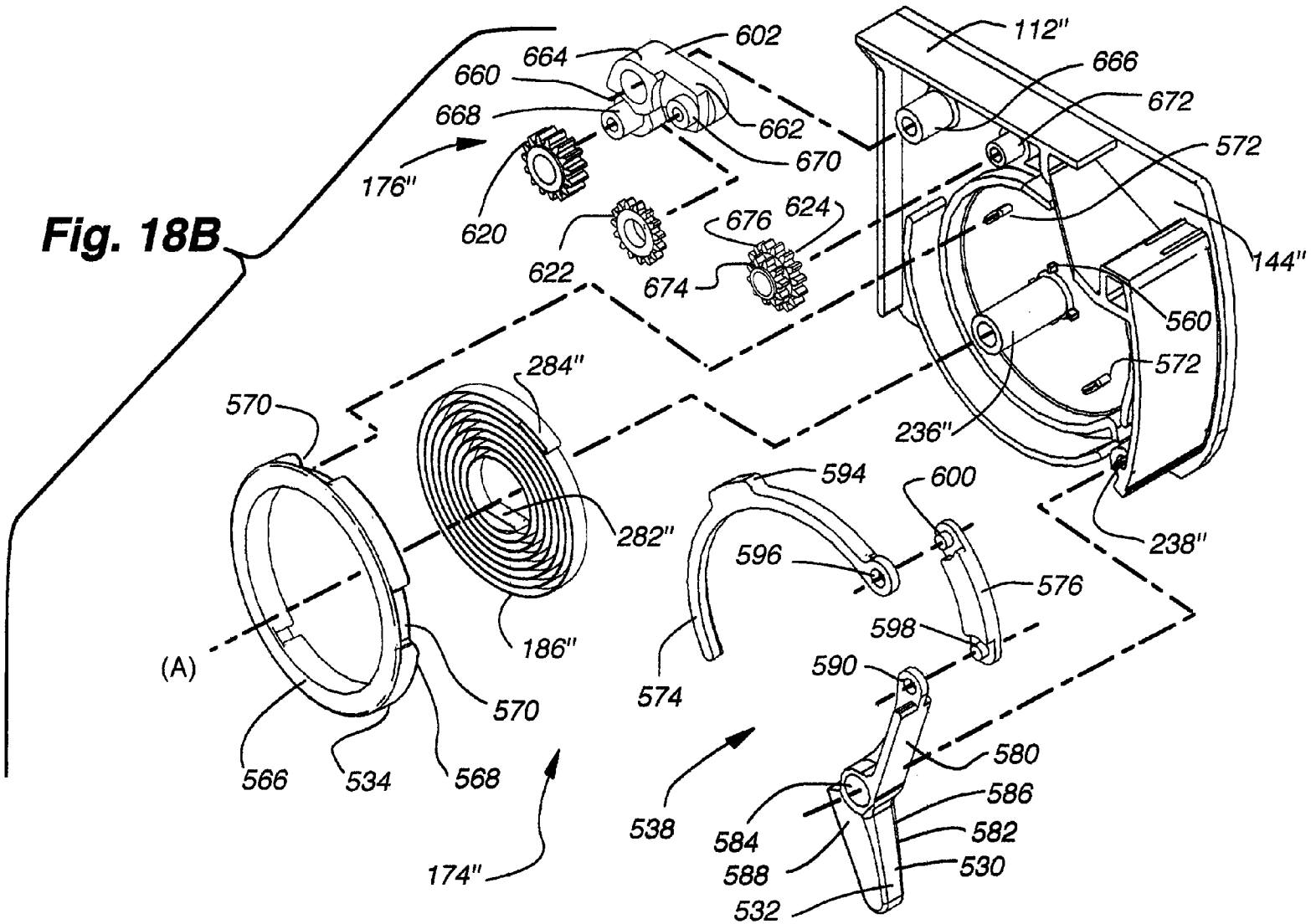

As shown in FIGS. 16, 17A, and 177B, the input assembly 174" of the third embodiment includes the pull cord 120 connected with the operating cord 124 through the stopper or coupler 125, a clock spring 186", an axle 188", a cord spool 190", and a clutch spring 536, all cooperatively engaging to convert linear movement of the pull cord into a rotational movement of the cord spool. As discussed below in more detail and as shown in FIGS. 16, 18A, and 18B, the input assembly may also be configured to include a spring ring 534 for attachment of the clock spring. Rotational movement of the cord spool in the third embodiment may be imparted to the transmission 176" through the clutch spring 536. As discussed in more detail below and as shown in FIGS. 18A and 188B, the input assembly may also be configured such that rotational movement of the cord spool is imparted to the transmission through a rocker ring clutch assembly 678, as opposed to the clutch spring 536. The third embodiment also utilizes a shift arm assembly 538 to engage the transmission to change the rotational direction of the head roller 108, but unlike the first and second embodiments, the shift arm assembly in the third embodiment is pivotally mounted to the right end cap 116" and is actuated by the trigger 530, as opposed to the pull direction of the pull cord. The operating cord 124 extends from the stopper or coupler 125 and passes directly into the head rail assembly 112" where it is wrapped around the cord spool 190". The position of the trigger 530 on the shift arm assembly 538 relative to the head rail assembly 112" dictates the direction in which the covering 100 is moved. The input assembly of the third embodiment also provides the function of automatically rewinding the operating cord onto the spool after the user releases tension from the pull cord, but the clock spring in the third embodiment is connected in a slightly different configuration than in the first and second embodiments.

Cord Spool/Input Assembly

Similar to the first and second embodiments, the various elements of the input assembly are supported by the right end cap 116". As shown in FIGS. 17A–17B and 18A–18B, the clutch spring 536 (or rocker ring clutch assembly 538), the cord spool 190", the clock spring 186", and the axle 188" are supported by the first end cap shaft 236", whereas the shift arm assembly 538 is rotatably supported on the second end cap shaft 238".

As with the first and second embodiments, the axle 188" interfaces with the input assembly 174", the transmission 176", and the output assembly 178". As such, additional descriptions of the various functions performed by the axle will be described below separately as part of the detailed descriptions of the input assembly, the transmission, and the output assembly.

Figure 17B:
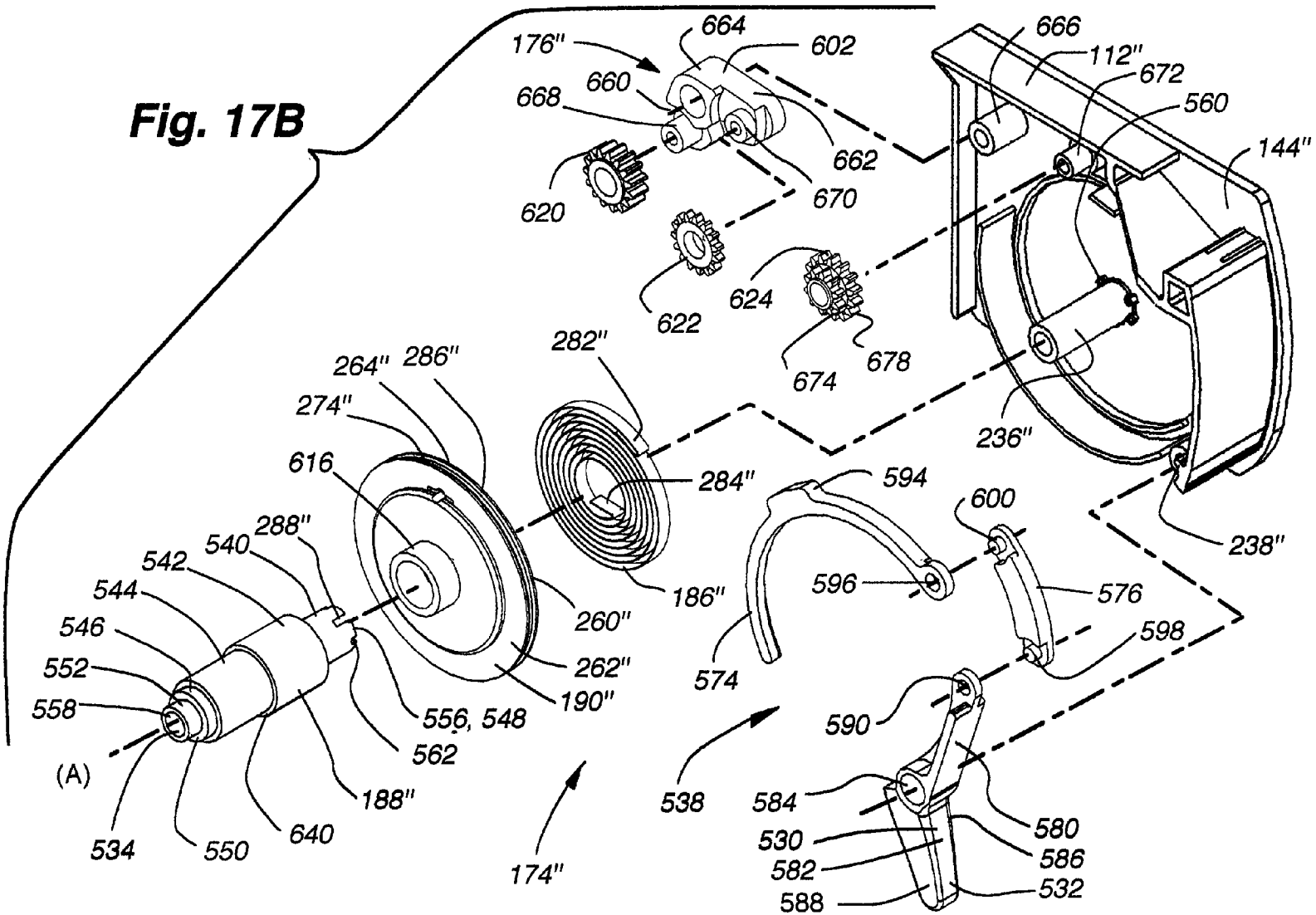

As shown in FIGS. 17B and 18A, the axle 188" of the third embodiment may include a plurality of outer surfaces defined along its length by varying diameters. Each outer surface is directed to a function more particularly described below. The axle shown in FIGS. 17B and 18A includes a first cylindrical surface 540, a second cylindrical surface 542, a third cylindrical surface 544, and a fourth cylindrical surface 546. The axle further includes a first end surface 548 and a second end surface 550, the second end surface 550 having a small raised surface 552 extending therefrom. A hole 534 adapted to receive the first end cap shaft 236" passes through the center of the axle defining a first opening 556 at the first end surface 548 and a second opening 558 at the small raised surface 552 extending from the second end surface. Four equally spaced square protrusions 560 extend radially from where the first end cap shaft connects with the inner side 144" of the right end cap 116". Four correspondingly shaped female notches 562 on the inside of the first opening of the axle are adapted to engage the four square protrusions on the first end cap shaft. As such, the axle does not rotate relative to the first end cap shaft.

Cord Spool & Clock Spring

The structural and cooperative relationship between the cord spool 190", the clock spring 186", the axle 188", the shift arm assembly 538, and the operating cord 124 of the input assembly 174" will now be described. As shown in FIG. 17B, the cord spool, which is rotatably supported on the first surface 540 of the axle 188", is disk shaped with a first side 260" and a second side 262" having a cord spool sleeve 564 extending therefrom. Similar to the first and second embodiments, the operating cord is wound clockwise (as viewed by looking toward the inner side of the right end cap) onto the groove 274" of the cord spool 190". As such, when the operating cord is unwound from the cord spool (i.e. when a user pulls on the pull cord), the cord spool rotates clockwise. The operating cord is connected to the cord spool through a knot 276" tied in a second end 278 of the operating cord 124 located in a circular cavity 264", as described with reference to the first embodiment.

As shown in FIGS. 17B, 18A, 19A, and 20A, the clock spring 186" is stored inside the circular cavity 264" of the cord spool. The clock spring functions to automatically retract the operating cord onto the spool when tension is released from the pull cord, as described with reference to the first and second embodiments. As shown in FIG. 17B, the clock spring may be connected with the spool and the axle in the same manner as described with reference to first embodiment. As such, the clock spring 186" includes a first tang 282" located in the outer winding of the clock spring, and a second tang 284" located in the inner winding of the clock spring. The first tang 282" engages a first clock spring recess 286" located on the cord spool 190" to connect the clock spring with the cord spool. The second tang 284" engages a second clock spring recess 288" on the axle 188".

It is to be appreciated that the clock spring 186" may be connected in a different way, such as by utilizing the spring ring 534, as shown in FIGS. 18A, 18B, 19A, and 20A. The clock spring 186" includes a first tang 282" located in the inner winding of the clock spring, and a second tang 284" located in the outer winding of the clock spring. The first tang 282" engages a first clock spring recess 535 located on a flange 537 extending from the first side of the cord spool 190" to connect the clock spring with the cord spool. The second tang 284" engages a second clock spring recess 288" on the spring ring 534. As shown in FIG. 18B, the spring ring 534 is circularly shaped and has a smooth first side 566 and a second side 568 with four grooves 570 adapted to cooperate with four raised projections 572 arranged in a circle about the inner side 144" of the right end cap 116". When the grooves mesh with the four raised projections, the spring ring is held in a fixed position relative to the right end cap.

When a user pulls on the pull cord 120, which in turn unwinds the operating cord 124 from the cord spool 190", the cord spool rotates in a clockwise direction. Because the clock spring is fixed at the second tang 284" by the axle 188" or the spring ring 534, the clock spring contracts from an expanded state as the cord spool rotates clockwise. As such, rotation of the cord spool coils the clock spring to the extent the operating cord is wound thereupon. When tension is released from the pull cord and operating cord, the cord spool is rotated counterclockwise by the expanding clock spring to rewind the operating cord back onto the cord spool. As described with reference to the first embodiment, when the control system is assembled with its components, the axle is inserted into the opening of the cord spool and wound slightly to place a pre-load on the clock spring. The pre-load on the clock spring assures that some tension is always maintained on the operating cord when the system is not in use.

Control Arm

Figure 19A:
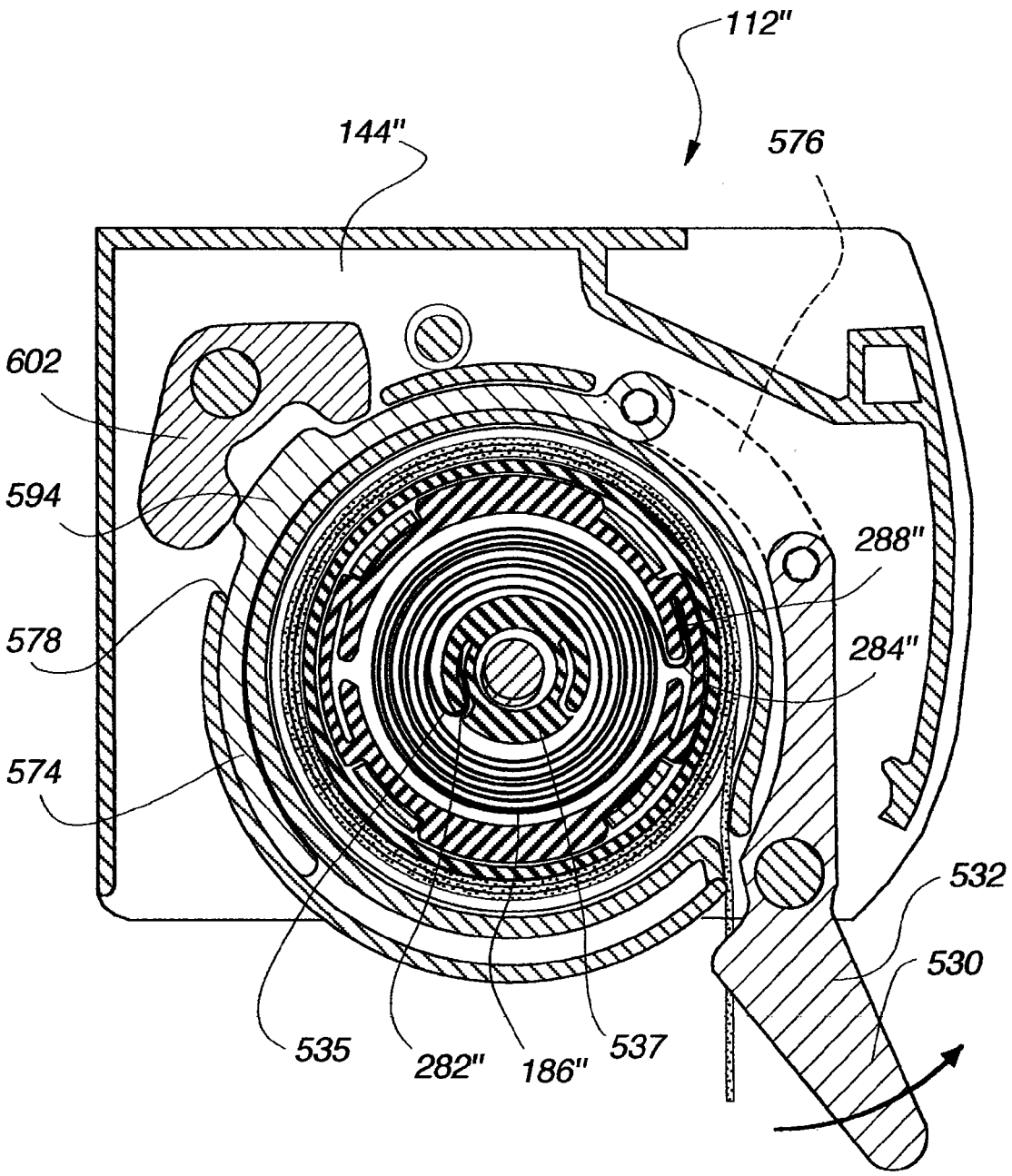
FIG. 19A is a cross-sectional view of the control system depicted in FIG. 16 showing a trigger pulled in a forward position, taken across a shift arm assembly.

As shown in FIGS. 17B, 18B, and 19A, the shift arm assembly 538 includes the control arm 532 connected with a shift arm 574 through a shift arm link 576. When the control system is assembled, the shift arm assembly is received in a circular recess 578 located on the inner side 144" of the right end cap 116".

As shown in FIGS. 17B and 18B, the control arm 532 is an elongate member defined by an upper portion 580 and a lower portion 582, and having a hole 584 passing from a first side 586 to a second side 588 located between the upper portion and lower portion. The lower portion defines the trigger 530, and a first link axle hole 590 is located in the upper end of the upper portion. The hole 584 in the control arm 532 is adapted to receive the second end cap shaft 238" extending from the inner side 144" of the right end cap 116". The second end cap shaft serves as both a mounting point and a bearing surface for the control arm. The second end cap shaft also includes an opening capable of receiving a shift arm fastener (not shown) to fixedly attach the control arm to the second end cap shaft while at the same time allowing the shift arm to pivot freely about the second end cap shaft.

As shown in FIGS. 17B and 18B, the shift arm 574 is an arcuate member including a locking ridge 594 and a second link axle hole 596. The shift arm link 576 is a curved member and includes a first link axle 598 and a second link axle 600 located at opposing ends. The upper portion 580 of the control arm 532 is rotatably connected to the shift arm link 576 where the first link axle 598 is received by the first link axle hole 590, and the shift arm 574 is rotatably connected with the shift arm link 576 where the second link axle 600 is received by the second link axle hole 596. As discussed in more detail below, a user pivots the control arm either clockwise or counterclockwise about the second end cap shaft by applying force to the trigger. Pivoting the control arm results in angular movement of the locking ridge on the shift arm, which in turn, engages a rocker arm 602 on the transmission to change the direction in which the transmission rotates the output assembly.

Cord Spool, Clutch Spring, & Input Ring Gear Engagement

As previously mentioned, rotational movement of the cord spool 190" is imparted to the transmission 176" through the clutch spring 536. As shown in FIGS. 17A and 17B, the clutch spring is helically coiled and includes a clutch spring tang 604. The clutch spring tang is adapted to engage an input ring gear 608 at a first clutch spring notch 610 located on the inside wall of a first ring gear sleeve 612. The clutch spring 536 is adapted to receive a cord spool sleeve 616, and is adapted to be received within the input ring gear sleeve. When the cord spool rotates in a clockwise direction (i.e. when a user pulls on the pull cord), the cord spool engages the clutch spring, which causes the coils of the clutch spring to contract on the cord spool sleeve. Contraction of the clutch spring results in a frictional engagement between the clutch spring and the cord spool sleeve, which in turn, causes the input ring gear to turn in the clockwise direction. In contrast, when the user releases the pull cord and the clock spring causes the cord spool to rotate in a counterclockwise direction, the clutch spring expands and releases its frictional engagement with the cord spool sleeve. Therefore, when the cord spool rotates in the counterclockwise direction, the input ring gear does not turn.

Alternative Cord Spool & Input Ring Gear Engagement

As previously mentioned, the cord spool 190" may impart rotational movement to the input ring gear 608 through the rocker ring clutch assembly 678 shown in FIG. 18A. The rocker ring clutch assembly allows the cord spool to rotate the input ring gear in the clockwise direction, but not the counterclockwise direction. As shown in FIG. 18A, the rocker ring clutch assembly 608 includes a rocker ring 680 and two rocker pawls 682 held in position relative to the cord spool 190" by two rocker ring actuator tabs 684 extending from the second side 262" of the cord spool 190". The rocker ring includes two opposing tabs 688 extending from its outer periphery. The two rocker pawls include tab notches 690 adapted to receive the two opposing tabs 688 on the rocker ring 680. The tab notches 690 and the opposing tabs 688 are configured to allow the rocker pawls to "rock" or pivot about the opposing tabs 688.

Figure 19B:
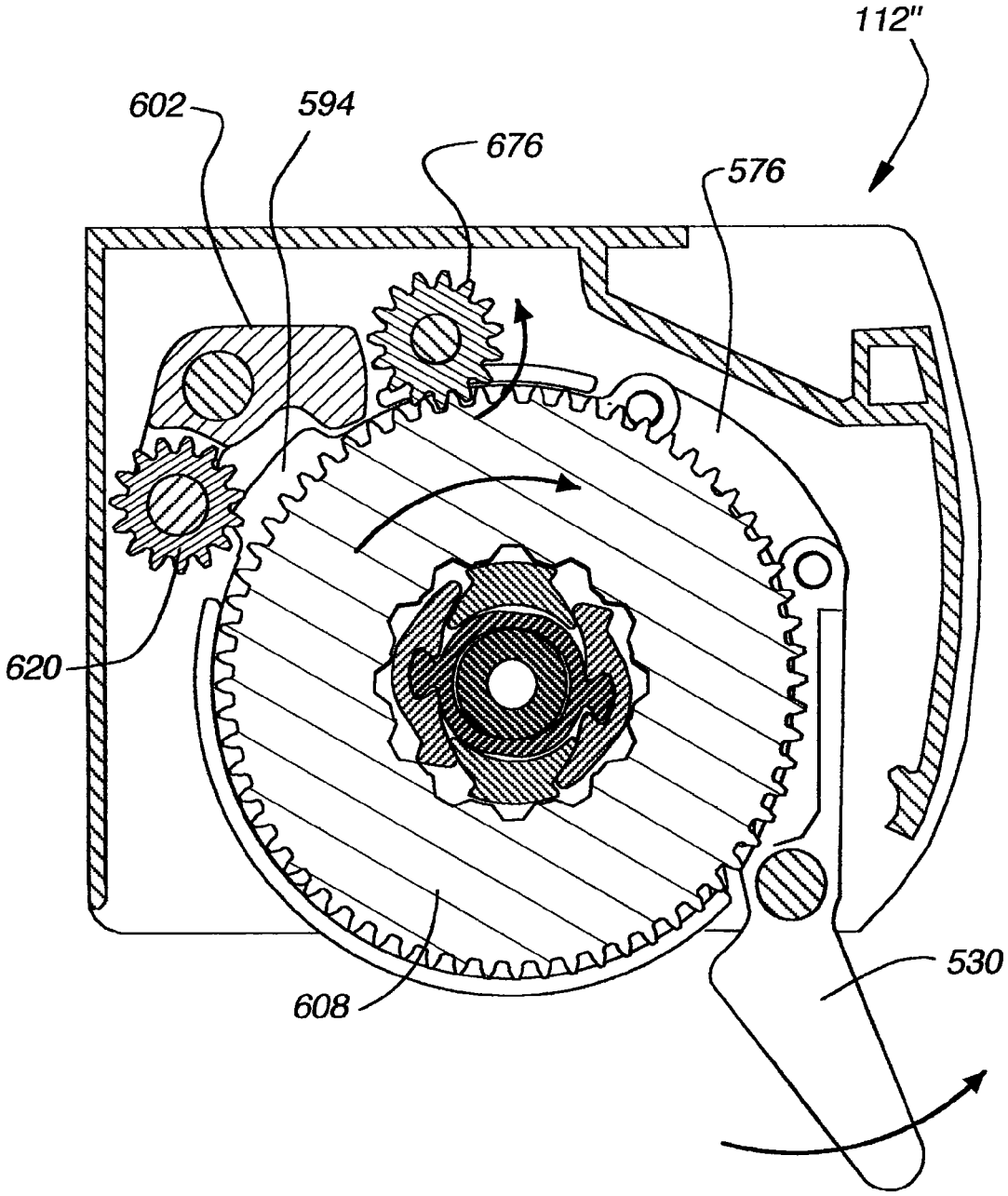
FIG. 19B is a cross-sectional view of the control system depicted in FIG. 16 showing a trigger pulled in a forward position, taken across an input ring gear.
Figure 21:
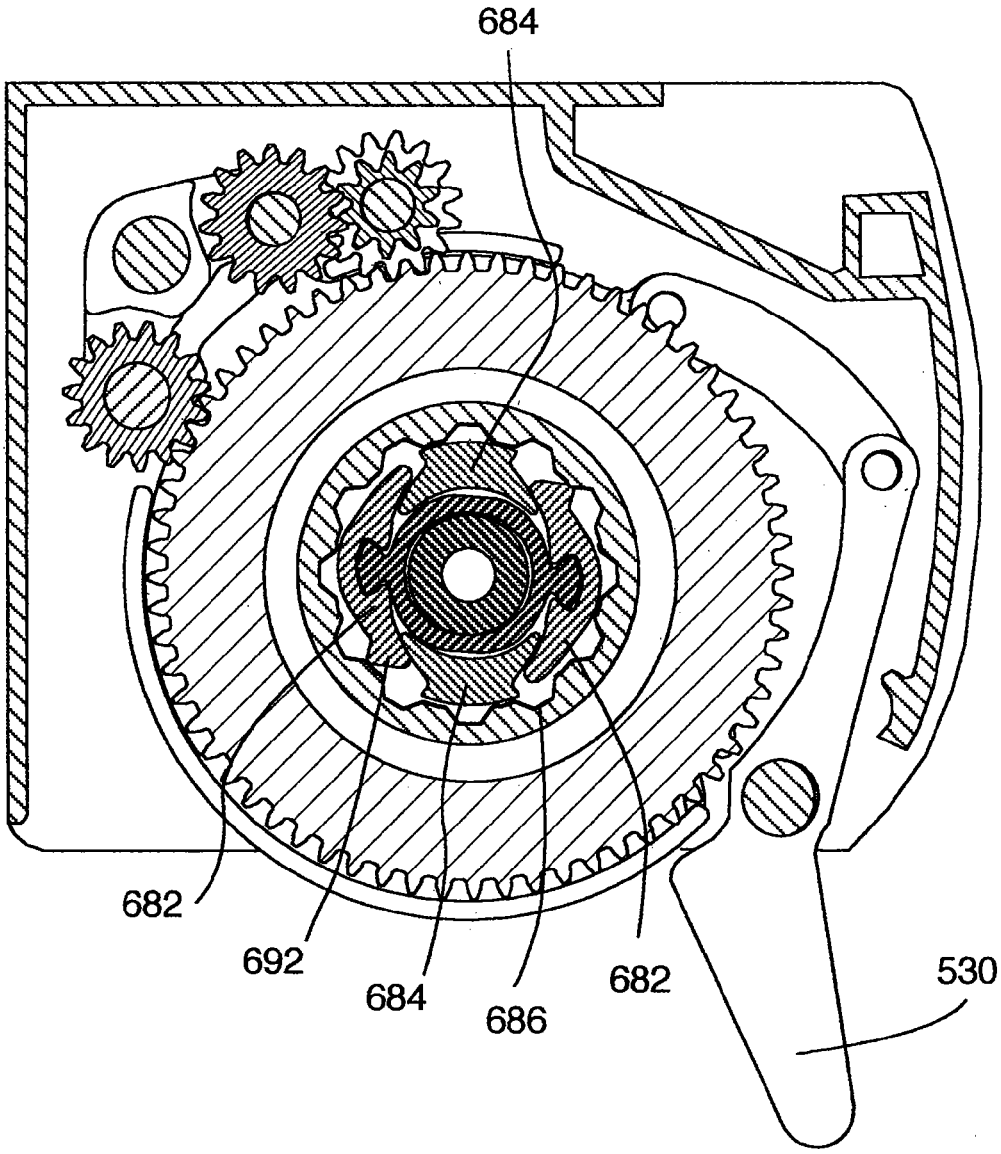
FIG. 21 is a cross-sectional view of the control system depicted in FIG. 16 showing the a rocker ring clutch assembly disengage from the input ring gear, taken across the output ring gear.

As shown in FIGS. 18A and 21, rocker wedges 692 are located at the one end of each rocker pawl 682 and are adapted to engage a notched lip 686 on the first side 628 of the flanged portion 626 of the input ring gear 608. In operation, as shown in FIG. 19B, when the cord spool 190" rotates in the clockwise direction, the rocker ring actuator tabs are moved into engagement between the rocker ring and the rocker pawls, causing the rocker pawls to pivot clockwise about the opposing tabs to engage the rocker wedges with the notched lip on the input ring gear, causing the input ring gear to rotate in a clockwise direction. Alternatively, as shown in FIG. 21, when the cord spool rotates in the counterclockwise direction, the rocker ring actuator tabs are moved into engagement between the rocker ring and the rocker pawls, causing the rocker pawls to pivot counterclockwise about the opposing tabs to disengage the rocker wedges from the notched lip on the input ring gear, allowing the cord spool to rotate without causing the input ring gear to rotate.

Final Summary of Input Assembly

To summarize the operational description of the input assembly on the third embodiment, as a user pulls on the pull cord 120 to move the covering 100 in the desired direction, the operating cord 124 is unwound from the cord spool 190", causing the cord spool to rotate in a clockwise direction. The user applies force to the trigger 530 to pivot the control arm 532 either clockwise or counterclockwise about the second end cap shaft 238". Pivoting the control arm moves the locking ridge 594 on the shift arm 574 to engage the rocker arm 602 on the transmission 176", which in turn, dictates the direction in which the transmission rotates the output assembly 178". Rotation of the cord spool through the clutch spring 536 or the rocker ring clutch assembly 678 operates as an input to the transmission, which imparts rotational movement to the output assembly and the head roller 108. After the user releases tension from the pull cord and operating cord, the clock spring causes the cord spool to rotate in a counterclockwise direction, automatically winding the operating cord back onto the cord spool. As the cord spool rotates in the counterclockwise direction, the clutch spring or the rocker ring clutch assembly imparts no rotational movement to the transmission. The operating cord is automatically retracted until the stopper or coupler 125 engages the head rail assembly.

Transmission Overview

The structure and operation of the transmission 178" of the third embodiment will now be discussed in detail. As shown in FIGS. 17A and 18B, the transmission includes the input ring 608 gear, an output ring gear 618, the rocker arm 602, a first transfer gear 620, a second transfer gear 622, and a third transfer gear 624, all cooperatively engaging to convert rotational movement of the cord spool 190" into rotational movement of the output ring gear 618, which imparts rotational movement to the output assembly 178". As discussed in more detail below, a user pulling on the pull cord causes cord spool to rotate clockwise (see FIGS. 19B and 20B). Because the cord spool engages the clutch spring or the rocker ring clutch assembly, the input ring gear also rotates in a clockwise direction.

Figure 19C:
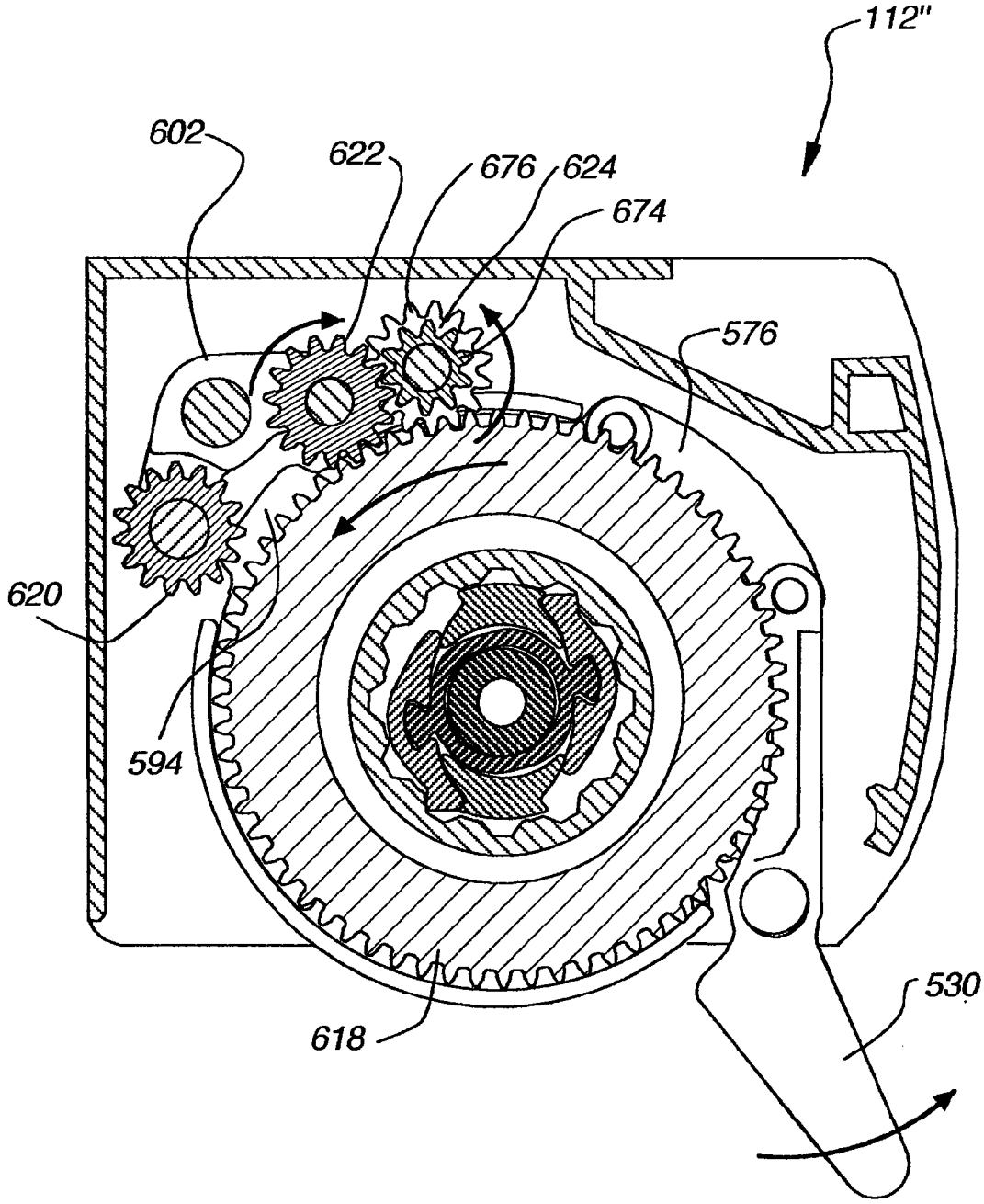
FIG. 19C is a cross-sectional view of the control system depicted in FIG. 16 showing a trigger in pulled a forward position, taken across an output ring gear.
Figure 20A:
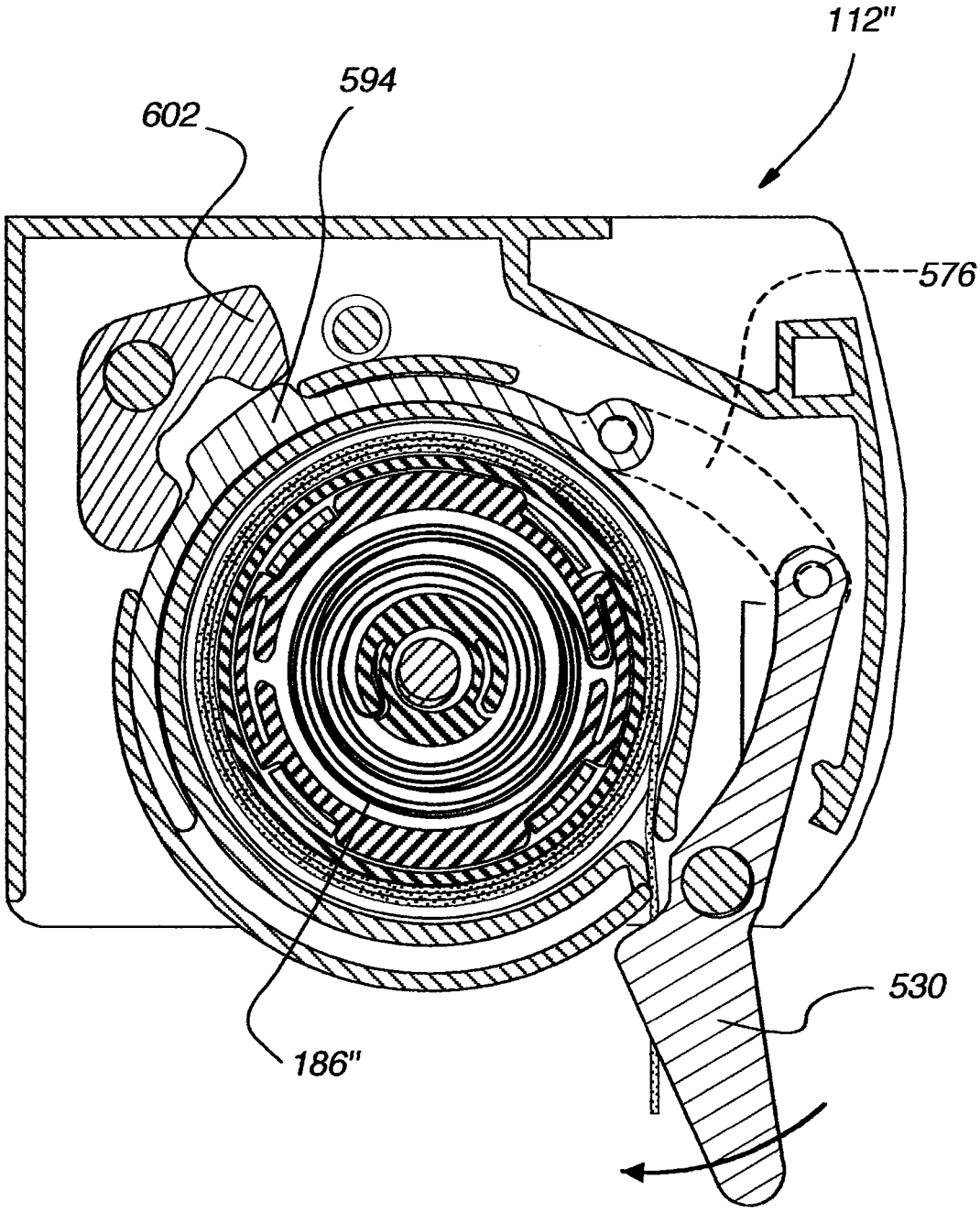
FIG. 20A is a cross-sectional view of the control system depicted in FIG. 16 showing a trigger pushed in a rearward position, taken across the shift arm assembly.
Figure 20B:
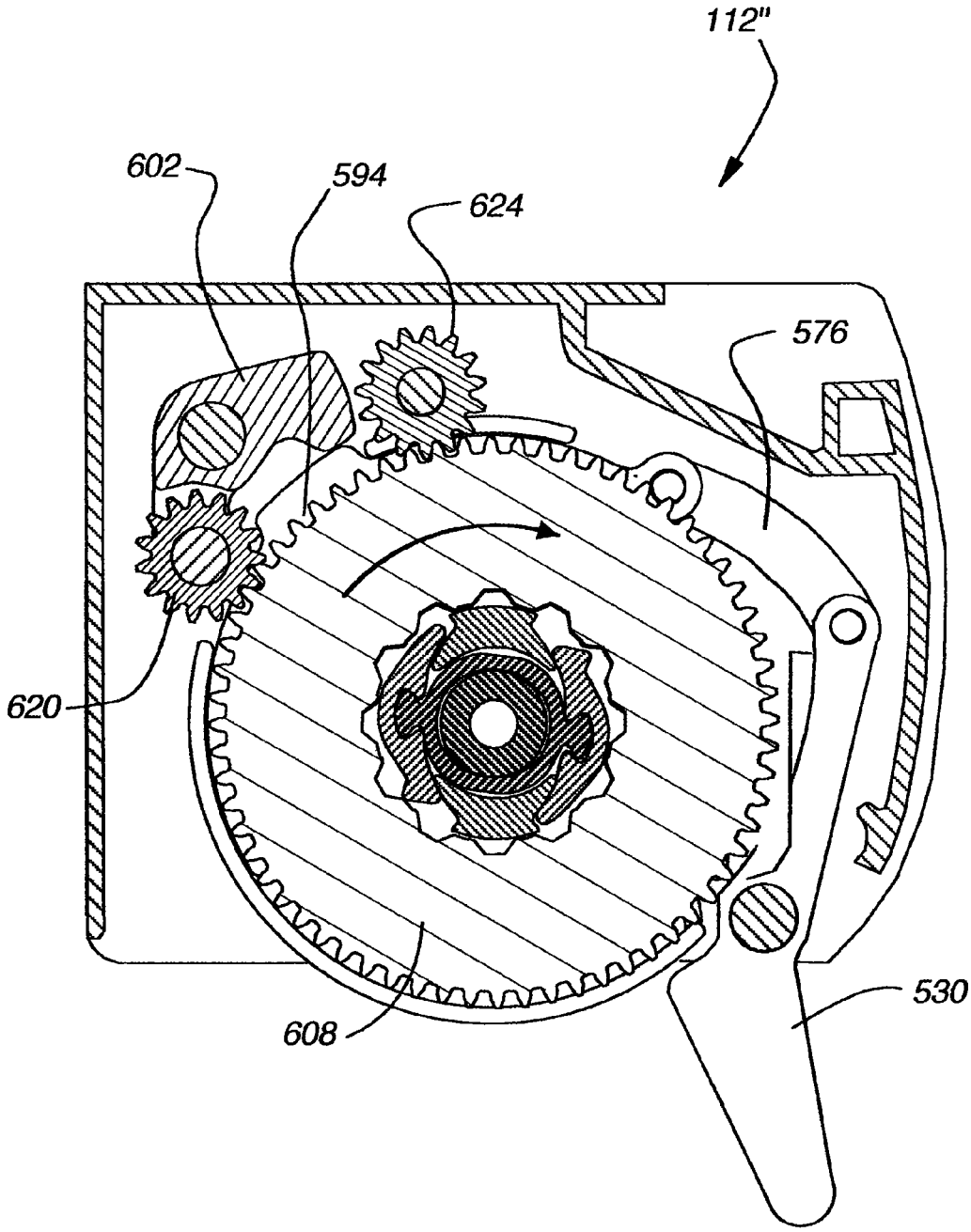
FIG. 20B is a cross-sectional view of the control system depicted in FIG. 16 showing a trigger pushed in a rearward position, taken across the input ring gear.
Figure 20C:
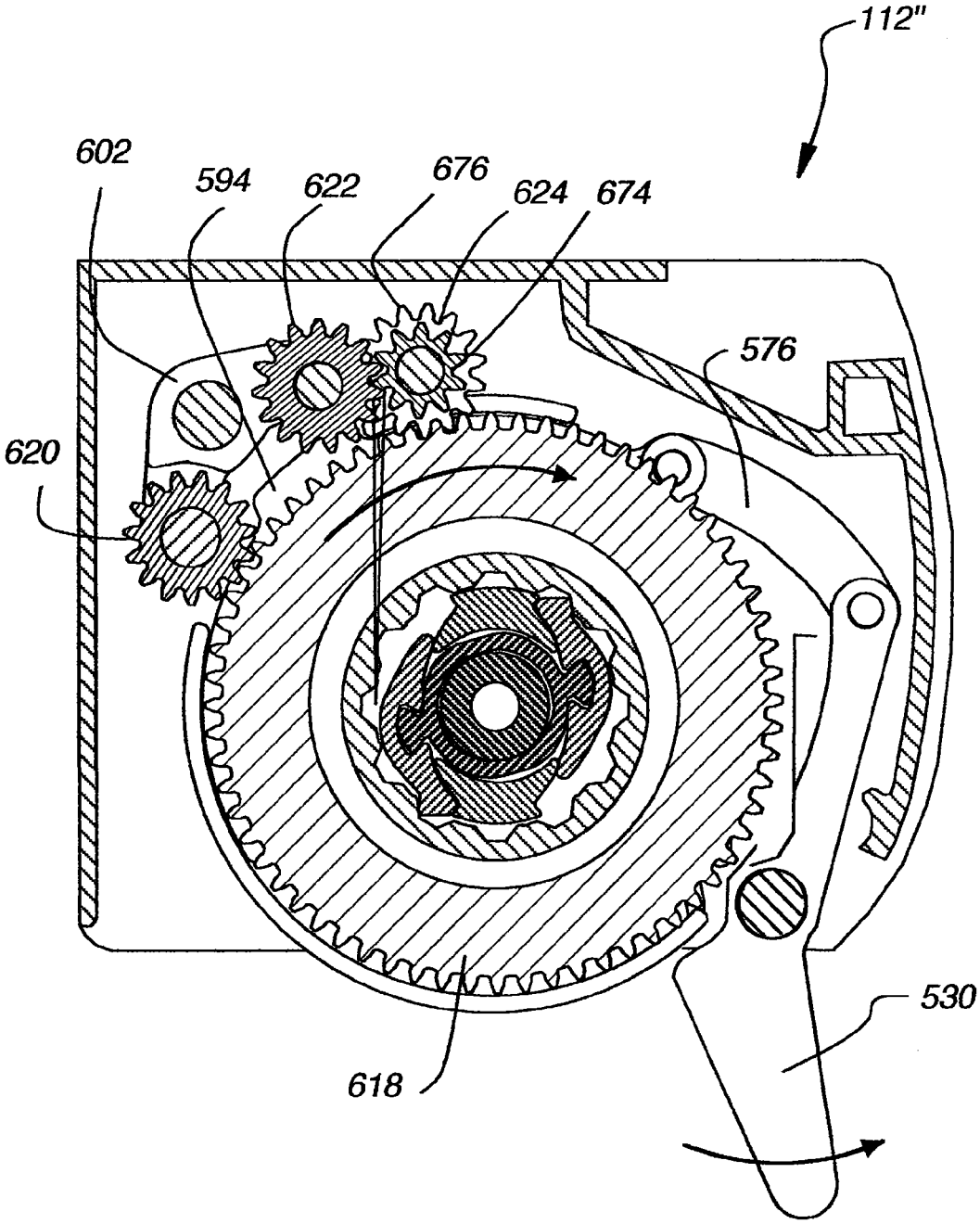
FIG. 20C is a cross-sectional view of the control system depicted in FIG. 16 showing a trigger in pushed in a rearward position, taken across the output ring gear.

As shown in FIGS. 20A–20C, if the user pushes the trigger 530 rearwardly with respect to the head rail assembly 112", the first transfer gear 620 engages the input ring gear 608 and the output ring gear 618. In this configuration, clockwise rotation of the input ring gear 608 rotates the first transfer gear 620 in counterclockwise direction, which in turn, causes the output ring gear 618 to rotate in a clockwise direction. Alternatively, as shown in FIGS. 19A–19C, if the user pulls the trigger 530 forwardly with respect to the head rail 112" assembly, the second transfer gear 622 engages the output ring gear 618 and the third transfer gear 624, which is engaged with the input ring gear 608. In this configuration, clockwise rotation of the input ring gear 608 rotates the third transfer gear 624 in a counterclockwise direction, which in turn, causes the second transfer gear 622 to rotate in a clockwise direction. Rotation of the second transfer gear 622 in a clockwise direction causes the output transfer gear 618 to rotate in a counterclockwise direction.

Input Ring Gear

As shown in FIGS. 17A and 18A, the input ring gear 608 is defined by an input flanged portion 626 having a first side 628 and a second side 630 with an input ring gear sleeve 632 extending from the second side. A geared surface 634 adapted to engage the transfer gears extends along the periphery of the input flanged portion 626. A cylindrical opening passes 636 through the flanged portion 626 and the input ring gear sleeve 632. The inner diameter of the input ring gear sleeve is adapted to rotatably support the input ring gear on the second surface 542 of the axle 188". When the input ring gear is installed on the axle, a lip 638 extending inwardly from the inner walls of the end of the input gear sleeve engages a ledge 640 on the axle formed by the transition of the second surface 542 to the third surface 544.

Output Ring Gear

As shown in FIGS. 17A and 18A, the output ring gear 618 is defined by an output flanged portion 642 having a first side 644 and a second side 646 with an output ring gear sleeve 648 extending from the second side. A geared surface 650 adapted to engage the transfer gears extends along the periphery of the output flanged portion. The output ring gear sleeve 648 is adapted to receive the input ring gear sleeve 632. The output ring gear sleeve is defined by a bearing section 652 and a brake engagement section 654 separated by a lip 656 formed by the transition of the bearing section to the brake engagement section extending from the interior walls of the output ring gear sleeve. A cylindrical opening 658 passes through the flanged portion 642 and the output ring gear sleeve portion 648. The inner diameter of the bearing section 652 is adapted to receive the input gear ring sleeve 632. As such, the output ring gear 618 is rotatably supported by the input ring gear sleeve 632. The brake engagement section 654 of the output ring gear sleeve 648 is adapted to receive the third surface 544 of the axle 188" and the lip is adapted to engage the fourth surface of the axle as well as a ledge defined by the transition from the third surface to the fourth surface on the axle.

As shown in FIGS. 17A and 18A, the brake engagement section 654 of the output ring gear sleeve 648 includes a U-shaped channel 418" formed therein with two side walls 420" extending from the second side 646 of the flanged portion 642 to the end of the output ring gear sleeve 648. Similarly to the first and second embodiments and as discussed below, the two side walls function to cooperate with the braking system.

Rocker Arm & First, Second, & Third Transfer Gears

As shown in FIGS. 17B and 18B, the rocker arm 602 is a U-shaped member defined by a first leg portion 660, a second leg portion 662, and a base portion 664. The rocker arm is rotatably supported at the base portion 664 by a rocker arm shaft 666 extending from the inner side 144" of the right end cap 116". A first transfer gear axle 668 adapted to rotatably support the first transfer gear 620 is located near the end of the first leg portion 660. A second transfer gear axle 670 adapted to rotatably support the second transfer gear 622 is located near the end of the second leg portion 662. As explained in more detail below, the first transfer gear 620 is adapted to engage the geared surfaces on the outer periphery of the input gear ring 608 and the output gear ring 618 at the same time. The second transfer gear 622 is not as wide as the first transfer gear 620, and as such, the second transfer gear 622 is adapted to only engage the geared surface on the outer periphery of the output ring gear 618. The third transfer gear 624 is rotatably supported on a transfer gear shaft 672 extending from the inner side 144" of the right end cap 116". The third transfer gear 624 is defined by a small transfer gear portion 674 integral with a large transfer gear portion 676. When the control system 110" is assembled, the large transfer gear portion 676 of the third transfer gear 624 is always engaged with the geared surface on the outer periphery of the input ring gear 608. As such, the small transfer gear portion 674 of the third transfer gear 624 is positioned axially in the same plane as the geared surface on the outer periphery of the output ring gear 618. However, the small transfer gear portion of the third transfer gear does not directly engage the ring gear.

As shown in FIGS. 19A–20C, when the control system is assembled, the locking ridge 594 on the shift arm 574 is received between the first leg portion 660 and the second leg portion 662 of the rocker arm 602. As such, when the shift arm 574 moves angularly in a clockwise direction (i.e. when the user pushes the trigger 530 rearwardly, see FIGS. 20A–20C), the locking ridge 594 engages the second leg portion 662 on the rocker arm 602, which in turn, causes the rocker arm to pivot about the rocker arm shaft 666 in a counterclockwise direction. When the rocker arm rotates counterclockwise, the first transfer gear 620 engages the input ring gear 608 and the output ring gear 618. Conversely, when the shift arm 574 moves angularly in a counterclockwise direction (i.e. when the user pulls the trigger 530 forwardly, see FIGS. 19–19C), the locking ridge 594 engages the first leg portion 660 on the rocker arm 602, which in turn, causes the rocker arm to pivot about the rocker arm shaft 666 in a clockwise direction. When the rocker arm rotates clockwise, the first transfer gear 620 disengages from the input ring gear 608 and the output ring gear 618, while at the same time, the second transfer gear 622 engages the output ring gear 618 and the third transfer gear 624.

Summary of the Transmission

As the user pulls the pull cord 620, the operating cord 624 is unwound from the cord spool 190", which causes the cord spool to rotate in a clockwise direction. The cord spool engages the input ring gear 608 through the clutch spring 536 or the rocker ring clutch assembly 678 to rotate the input ring gear in the clockwise direction. The direction in which the output ring gear rotates the output assembly is dictated by the position of the trigger 530 (i.e. rearwardly or forwardly) on the control arm 532 relative to the head rail assembly 112".

As shown in FIGS. 20–20C, if the user pushes the trigger 530 rearwardly with respect to the head rail assembly 112", the control arm 532 pivots in a clockwise direction around the second end cap shaft 238", which causes the shift arm 574 to move angularly in a clockwise direction. As the shift arm moves in the clockwise direction, the locking ridge 594 engages the rocker arm 602, which pivots the rocker arm in a counterclockwise direction, which in turn, causes the second transfer gear 622 to disengage from the output ring gear 618, and causes the first transfer gear 620 to engage the input ring gear 608 and the output ring gear. In this configuration, clockwise rotation of the input ring gear rotates the first transfer gear in the counterclockwise direction, which in turn, causes the output ring gear to rotate in a clockwise direction. Rotation of the output ring gear in the clockwise direction causes the head roller 108 to rotate in a clockwise direction to wrap the covering 100 onto the head roller.

Alternatively, as shown in FIGS. 19–19C, if the user pulls the trigger 530 forwardly with respect to the head rail assembly 112", the control arm 532 pivots in a counterclockwise direction around the second end cap shaft 238", which causes the shift arm 574 to move angularly in a counterclockwise direction. As the shift arm moves in the counterclockwise direction, the locking ridge 594 engages the rocker arm 602, which pivots in a clockwise direction, which in turn, causes the first transfer gear 620 to disengage from the input ring gear 608 and the output ring gear 618, and causes the second transfer gear 622 to engage the output ring gear and the small transfer gear portion 674 of the third transfer gear 624. The small transfer gear portion 674 of the third transfer gear 624 is integrally connected with the large transfer gear portion 676 of the third transfer gear 624, which is always engaged with the input ring gear 608. In this configuration, clockwise rotation of the input ring gear rotates the third transfer gear in the counterclockwise direction, which in turn, causes the second transfer gear to rotate in a clockwise direction. Rotation of the second transfer gear in a clockwise direction causes the output transfer gear to rotate in a counterclockwise direction. Rotation of the output ring gear in a counterclockwise direction causes the head roller 108 to rotate in a counterclockwise direction to unwrap the covering 100 from the head roller.

Output Assembly Overview

The structure and operation of the output assembly 178" for the third embodiment will now be discussed in detail. As shown in FIGS. 16, 17A, and 18A, the output assembly includes a fastener 256", two wrap springs 424" rotatably supported on the third surface 544 of the axle 188", and a rotator spool 168" supported by the output ring gear sleeve 648 of the output ring gear 618, all cooperatively engaging to convert rotational movement of the output ring gear into rotational movement of the head roller 108.

As shown in FIGS. 17A and 18A, the two wrap springs 424" are adapted to receive the third surface 544 of the axle 188". It is to be appreciated that the number of wrap springs used may vary for different embodiments of the present invention. As described above with reference to the first embodiment, the wrap springs frictionally engage the third surface of the axle, which provides a braking action for the output ring gear. When the output ring gear 618 is mounted on the axle, the brake engagement-section of the output ring gear sleeve 648 surrounds the wrap springs such that the wrap spring tangs 426" extend outwardly from the wrap springs 424" near the side walls 420" inside the U-shaped channel 418".

Similarly to the first embodiment described above, a braking response is created by the side walls 420" of the U-shaped channel 418" engaging one or a plurality of wrap spring tangs 426". As well as holding the covering in a particular position, engagement of the side walls against the wrap spring tangs also helps prevent the output ring gear from turning too quickly when the user is pulling on the pull cord.

Rotator Spool

As shown in FIGS. 17A and 18A, the cylindrically-shaped rotator spool 168" includes a brake housing portion 432" having a hollow interior at an open end 434". Two longitudinal fins 528" are located on the outside of the rotator spool, which are adapted to fit within the longitudinal inner groove 154 of the head roller 108. A longitudinal boss 438" extending along the interior wall of the rotator spool 168" is adapted to fit into the U-shaped channel 418" between the wrap spring tangs 426" near the side walls 420". As such, when the output ring gear 356" rotates in either a clockwise or counterclockwise direction, the longitudinal boss 438" of the brake housing portion 432" of the rotator spool 168" engages the side walls of the U-shaped channel. Thus, the rotator spool rotates in the same direction as the ring gear.

As shown in FIGS. 16, 17A, and 18A, the rotator spool 168" is secured to the axle 188" by the fastener 442" to maintain a thrust connection between the components of the control system. More particularly, the fastener enters the channel 440" of the rotator spool and passes through the center of the axle 188" and screws into the first end cap shaft 236". When the components of the control system are assembled on the axle and the axle is installed on the first end cap shaft, the raised surface 552 of the axle extends a slight distance outwardly from the opening of the rotator spool. As such, when the fastener is screwed into the first end cap shaft, the screw head does not press against the rotator spool allowing the rotator spool to rotate freely.

Summary

The above-described third embodiment of the control system 110" assembled on the right end cap 116" of the head rail assembly 112" allows a user to raise or lower the covering by pulling downwardly on the pull cord. The position of the trigger 530 (i.e. forwardly or rearwardly) with respect to the head rail assembly 112" dictates whether the covering 100 is raised or lowered in response to pulling on the pull cord 120. The control system also allows the user to pull repetitively on the pull cord to achieve the desired position of the covering. Once the user releases the pull cord, the control system automatically retracts the operating cord back into the head rail assembly, and the braking system holds the covering in position.

It will be appreciated from the above noted description of various arrangements and embodiments of the present invention that a control system for a covering for an architectural opening has been described which includes an input assembly, a transmission, and an output assembly. The control system can be formed in various ways and operated in various manners depending upon whether covering, and vanes if utilized, are horizontally or vertically oriented. It will be appreciated that the features described in connection with each arrangement and embodiment of the invention are interchangeable to some degree so that many variations beyond those specifically described are possible. For example, the control system can be assembled and supported by various portions of the head rail assembly, such as an end cap, or the control system can be disengaged from the head rail assembly.

Although various embodiments of this invention have been described above with a certain degree of particularity or with reference to one or more individual embodiments, those skilled in the art could make numerous alterations to those disclosed embodiments without departing from the spirit or scope of this invention. It is intended that all matter contained in the above description and shown in the accompanying drawings shall be interpreted as illustrative only of particular embodiments, and not limiting. Changes in detail or structure may be made without departing from the basic elements of the invention as defined in the following claims.

What is claimed is:

1. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to drivingly rotate said head roller in said first direction and said second direction, said control system comprising:

an input assembly including a single operating element operative to convert linear motion of said operating element into reversible driven rotational motion of a first motion transfer element;

a transmission operative to translate reversible rotation of said first motion transfer element into reversible rotation of a second motion transfer element;

an output assembly operatively engaged with said second motion transfer element to reversibly drivingly rotate said head roller; and wherein a pull force applied in a first pull direction imparted on said single operating element causes said head roller to drivingly rotate in said first direction, and said pull force applied in a second pull direction imparted on said single operating element causes said head roller to drivingly rotate in said second direction.

2. The covering of claim 1, wherein said first motion transfer element is a first gear, and said second motion transfer element is a second gear.

3. The covering of claim 1, the wherein said single operating element is defined by an operating cord connected with a pull cord through a coupler; wherein said coupler is defined by a first coupler portion connected with said operating cord, and a second coupler portion connected with said pull cord; wherein said first coupler portion is releasably connected with said second coupler portion; and wherein said coupler is configured to allow separation of said first coupler portion from said second coupler portion at a predetermined tension applied to said single operating element.

4. The covering of claim 2, said transmission further comprising: a clutch selectively rotatably connecting said first gear with said second gear; and at least one third gear rotatably connecting said first gear with said second gear.

5. The covering of claim 4, wherein said pull force applied in said first pull direction to said single operating element causes said first gear to rotate in said first direction, and wherein said first gear engages said at least one third gear to cause rotation of said second gear in said second direction; and wherein said pull force applied in said second pull direction to said single operating element causes said first gear to rotate in said first direction, and wherein said first gear engages said at least one third gear to activate said clutch to cause rotation of said second gear in said first direction.

6. The covering of claim 5, wherein said clutch is configured to allow rotation of said second gear in said first direction and second direction when said clutch is deactivated.

7. The covering of claim 5, wherein said clutch comprises: a clutch body having an open center adapted to receive an axle to rotatably support said clutch; at least one leg connected with said clutch body; and wherein said at least one third gear is adapted to engage said at least one leg to activate said clutch when said at least one third gear rotates in said first direction; and wherein said at least one third gear is adapted to disengage from said at least one leg to activate said clutch when said at least one third gear rotates in said second direction.

8. The covering of claim 7, wherein a first frictional force between said clutch body and said axle prevents rotation of said body relative to said axle until said at least one third gear engages said at least one leg to activate said clutch, and wherein said first frictional force overcomes a second frictional force between said at least one third gear and said at least one leg to allow disengagement of said at least one third gear from said at least one leg.

9. The covering of claim 4, wherein said clutch is constructed from a thermoplastic polyester elastomer material.

10. The covering of claim 7, wherein said axle is constructed from a Teflon-filled polycarbonate.

11. The covering of claim 4, wherein said clutch is a step spring.

12. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to drivingly rotate said head roller in said first direction and said second direction, said control system comprising:

an input assembly including a single operating element operative to convert linear motion of said operating element into reversible driven rotational motion of a first motion transfer element, a transmission operative to translate reversible rotation of said first motion transfer element in said first direction into reversible rotation of a second motion transfer element through at least one planet gear rotatably connected with a planet carrier, wherein said input assembly includes a braking element adapted to brake said planet carrier to cause driven rotation of said second motion transfer element in said second direction, and wherein said input assembly is adapted to release said planet carrier to cause driven rotation of said second motion transfer element in said first direction;

an output assembly operatively engaged with said second motion transfer element to reversibly drivingly rotate said head roller.

13. The covering of claim 12, wherein said first motion transfer element is a first gear, and said second motion transfer element is a second gear.

14. The covering of claim 13, said transmission further comprising: a clutch selectively rotatably connecting said first gear with said second gear.

15. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to drivingly rotate said head roller in said first direction and said second direction, said control system comprising:

an input assembly including a single operating element operative to convert linear motion of said operating element into reversible driven rotational motion of a first motion transfer element;

a transmission operative to translate reversible rotation of said first motion transfer element in said first direction into reversible rotation of a second motion transfer element though a planetary gear set configured to selectively operate in a first configuration and a second configuration;

an output assembly operatively engaged with said second motion transfer element to reversibly drivingly rotate said head roller;

wherein said first configuration provides a first mechanical advantage and causes said second motion transfer element to reversibly rotate at a first speed; and wherein said second configuration provides a second mechanical advantage and causes said second motion transfer element to reversibly rotate at a second speed.

16. The covering of claim 15, wherein said first motion transfer element is a first gear, and said second motion transfer element is a second gear.

17. The covering of claim 16, said transmission further comprising: a clutch selectively rotatably connecting said first gear with said second gear.

18. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to drivingly rotate said head roller in said first direction and said second direction, said control system comprising:

an input assembly including a single operating element operative to convert linear motion of said operating element into reversible driven rotational motion of a first motion transfer element;

a transmission operative to translate reversible rotation of said first motion transfer element into reversible rotation of a second motion transfer element through a clutch and at least one third gear;

an output assembly operatively engaged with said second motion transfer element to reversibly drivingly rotate said head roller;

wherein rotation of said first motion transfer element in said first direction engages said at least one third gear to activate said clutch to cause rotation of said second motion transfer element in said first direction; and wherein said clutch is configured to allow driven rotation of said second motion transfer element in said first direction and second direction when said clutch is deactivated.

19. The covering of claim 18, wherein said first motion transfer element is a first gear, and said second motion transfer element is a second gear.

20. The covering according to claim 18 or 19, wherein said clutch comprises: a clutch body having an open center adapted to receive an axle to rotatably support said clutch; at least one leg connected with said clutch body; and wherein said at least one third gear is adapted to engage said at least one leg to activate said clutch when said at least one third gear rotates in said first direction; and wherein said at least one third gear is adapted to disengage from said at least one leg to activate said clutch when said at least one third gear rotates in said second direction.

21. The covering of claim 20, wherein a first frictional force between said clutch body and said axle prevents rotation of said body relative to said axle until said at least one third gear engages said at least one leg to activate said clutch, and wherein said first frictional force overcomes a second frictional force between said at least one third gear and said at least one leg to allow disengagement of said at least one third gear from said at least one leg.

22. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to drivingly rotate said head roller in said first direction and said second direction, said control system comprising:

an input assembly including a single operating element operative to convert linear motion of said operating element into reversible driven rotational motion of a first motion transfer element;

a transmission operative to translate rotation of said first motion transfer element into reversible rotation of a second motion transfer element;

an output assembly operatively engaged with said second motion transfer element to reversibly drivingly rotate said head roller; and wherein said input assembly is configured to engage said transmission to cause said head roller to drivingly rotate in said first direction when said operating element travels in a first path through said input assembly; and wherein said input assembly is configured to engage said transmission to cause said head roller to drivingly rotate in a second direction when said operating element travels in a second path through said input assembly.

23. The covering of claim 22, wherein said first motion transfer element is a first gear, and said second motion transfer element is a second gear.

24. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to drivingly rotate said head roller in said first direction and said second direction, said control system comprising:

an input assembly including a single operating element operative to convert linear motion of said operating element into reversible driven rotational motion of a first motion transfer element;

a transmission operative to translate reversible rotation of said first motion transfer element into reversible rotation of a second motion transfer element;

an output assembly operatively engaged with said second motion transfer element to reversibly drivingly rotate said head roller;

wherein a pull force applied in a first pull direction imparted on said single operating element causes said head roller to drivingly rotate in said first direction; and wherein said input assembly is operative to allow a change in direction of said pull force on said single operating element while said head roller is rotating in said first direction without reversing rotation of said head roller.

25. The covering of claim 24, wherein said first motion transfer element is a first gear, and said second motion transfer element is a second gear.

26. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly operative to convert linear motion of an operating element into rotational motion of a first motion transfer element;

a transmission operative to translate rotation of said first motion transfer element into rotation of a second motion transfer element through at least one third gear rotatably connected with a planet carrier;

an output assembly operatively engaged with said second motion transfer element to rotate said head roller; wherein said input assembly includes a shift arm having a pawl adapted to engage ratchet teeth on said planet carder when a pull force in a first pull direction is imparted on said single operating element; and wherein said input assembly is configured to automatically retract said single operating element into said head rail assembly and disengage said pawl from said ratchet teeth when no pull force is applied to said single operating element.

27. The covering of claim 26, wherein said first motion transfer element is a first gear, and said second motion transfer element is a second gear.

28. The covering according to claim 26 or 27, wherein said input assembly further comprises: a spool; a pulley; a guide control arm; and wherein said single operating element extends from said spool, partially around said pulley, across said shift arm, and exits said head rail assembly through said guide control arm.

29. The covering of claim 28, wherein said pulley is rotatably supported by said shift arm; and wherein friction between said pulley and said shift arm causes said shift arm to pivot when said pull force is applied to said single operating element.

30. The covering of claim 29, wherein said shift arm includes a first leg portion and a second leg portion; wherein said first leg portion is adapted to engage said transmission to control a rotational direction of said head roller; and wherein said second leg portion is adapted to operatively engage said single operating element such that while said pull force is being applied to said single operating element and while said head roller is rotating said first direction, changing direction of said pull force from said first pull direction to a second pull direction does not cause said head roller to rotate in said second direction.

31. The covering claim 27, wherein said input assembly further comprises: a spool; a guide control arm; wherein said shift arm is pivotally connected with said head rail assembly: wherein said single operating element extends from said spool, across said shift arm, and exits said head rail assembly through said guide control arm; and wherein a pull force imparted on said single operating element in a first pull direction causes said shift arm to pivot and engage said transmission, causing said head roller to rotate in said first direction.

32. The covering of claim 31, said input assembly further comprising a spring operatively connected with said spool to automatically wind said single operating element onto said spool.

33. The covering of claim 27, said transmission further comprising: a clutch selectively rotatably connecting said first gear with said second gear.

34. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element, said input assembly further comprising a spool, a pulley, a shift arm, a guide control arm, and wherein said single operating element extends from said spool, partially around said pulley, across said shift arm, and exits said head rail assembly through said guide control arm;

a transmission operative to translate rotation of said first motion transfer element into rotation of a second motion transfer element, an output assembly operatively engaged with said second motion transfer element to rotate said head roller; and wherein a pull force applied in a first pull direction imparted on said single operating element causes said head roller to rotate in said first direction, and said pull force applied in a second pull direction imparted on said single operating element causes said head roller to drivingly rotate in said second direction.

35. The covering according to claim 34 wherein the first motion transfer element is a first gear and the second motion transfer element is a second gear.

36. The covering of claim 34 or 35, wherein said pulley is rotatably supported by said shift arm; and wherein friction between said pulley and said shift arm causes said shift arm to pivot when said pull force is applied to said single operating element.

37. The covering of claim 36, wherein said shift arm includes a first leg portion and a second leg portion; wherein said first leg portion is adapted to engage said transmission to control a rotational direction of said head roller; and wherein said second leg portion is adapted to operatively engage said single operating element such that while said pull force is being applied to said single operating element, changing direction of said pull force from said first pull direction to said second pull direction does not cause said head roller to rotate in said second direction.

38. The covering of claim 37, wherein a pawl extends from said first leg portion to engage said transmission.

39. The covering of claim 38, wherein a boss extends from said second leg portion to operatively engage said single operating element.

40. The covering claim 35, wherein said input assembly further comprises: a spool; a shift arm; a guide control arm; and wherein said single operating element extends from said spool, across said shift arm, and exits said head rail assembly through said guide control arm.

41. The covering of claim 40, wherein said shift arm is pivotally connected with said head rail assembly; and wherein said pull force imparted on said single operating element in said first pull direction causes said shift arm to pivot and engage said transmission, causing said head roller to rotate in said first direction.

42. The covering of claim 40, said input assembly further comprising a spring operatively connected with said spool to automatically wind said single operating element onto said spool.

43. The covering of claim 42, the wherein said single operating element is defined by an operating cord connected with a pull cord through a coupler; wherein said operating cord extends from said spool, across said shift arm, and exits said head rail assembly through an opening on guide control arm; and wherein said coupler is adapted to engage said opening on said guide control to prevent said pull cord from entering said opening.

44. The covering of claim 43, wherein said opening on said guide control arm is configured to engage said coupler to place said operating cord in a first position relative to said shift arm; wherein said first position of said operating cord relative to said shift arm allows placement of said operating cord in a first cord path across said shift arm when said pull force in said first direction is imparted on said single operating element in said first pull direction; and wherein said first position of said operating cord relative to said shift arm allows placement of said operating cord in a second cord path across said shift arm when said pull force in said second direction is imparted on said single operating element in said second pull direction.

45. The covering of claim 44 wherein said operating cord engages said shift arm to allow said shift arm to engage said transmission to control a rotational direction of said second gear when said operating cord is placed in said first cord path across said shift arm.

46. The covering of claim 44, wherein said operating cord engages said shift arm to prevent said shift arm from engaging said transmission to control a rotational direction of said second gear when said operating cord is placed in said first cord path across said shift arm.

47. The covering of claim 43, wherein said coupler is defined by a first coupler portion connected with said operating cord, and a second coupler portion connected with said pull cord; wherein said first coupler portion is releasably connected with said second coupler portion; and wherein said coupler is configured to allow separation of said first coupler portion from said second coupler portion at a predetermined tension applied to said single operating element.

48. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element;

a transmission operative to translate rotation of said first motion transfer element into rotation of a second motion transfer element; said first motion transfer element being a first gear and said second transfer motion element being a second gear, a clutch selectively rotatably connecting said first gear with said second gear; and at least one third gear rotatably connecting said first gear with said second gear;

an output assembly operatively engaged with said second motion transfer element to rotate said head roller;

wherein a pull force applied in a first pull direction imparted on said single operating element causes said head roller to rotate in said first direction, and said pull force applied in a second pull direction imparted on said single operating element causes said head roller to rotate in said second direction;

wherein said at least one third gear comprises at least one planet gear adapted to engage said first gear and said second gear;

wherein said planet gear is rotatably supported by a planet carrier to allow said planet gear to orbit about said axis;

wherein said input assembly is adapted to engage said planet carrier to prevent rotation of said planet carrier when said pull force is applied to said single operating element in said first pull direction; and wherein said input assembly is adapted to not engage said planet carrier to allow rotation of said planet carrier when said pull force is applied to said single operating element in said second pull direction.

49. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first transfer element; said input assembly further comprising a spool, a pulley, a shift arm, a guide control arm, and wherein said single operating element extends from said spool, partially around said pulley, across said shift arm, and exits said head rail assembly through said guide control arm;

a transmission operative to translate rotation of said first motion transfer element in said first direction into rotation of a second motion transfer element through at least one planet gear rotatably connected with a planet carrier;

an output assembly operatively engaged with said second motion transfer element to rotate said head roller; and wherein said input assembly includes a braking element adapted to brake said planet carrier to cause rotation of said second motion transfer element in said second direction, and wherein said input assembly is adapted to release said planet carrier to cause rotation of said second motion transfer element in said first direction.

50. The covering according to claim 49 wherein said first motion transfer element is a first gear, and said second motion transfer element is a second gear.

51. The covering of claim 49 or 50, wherein said pulley is rotatably supported by said shift arm; and wherein friction between said pulley and said shift arm causes said shift arm to pivot when said pull force is applied to said single operating element.

52. The covering of claim 51, wherein said shift arm includes a first leg portion and a second leg portion; wherein said first leg portion is adapted to engage said transmission to control a rotational direction of said head roller; and wherein said second leg portion is adapted to operatively engage said single operating element such that while a pull force is being applied to said single operating element and while said heed roller is rotating said first direction, changing direction of said pull force from a first pull direction to a second pull direction does not cause said head roller to rotate in said second direction.

53. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first transfer element; said input assembly further comprising a spool, a shift arm pivotally connected with said head rail assembly, a guide control arm, wherein said single operating element extends from said spool, across said shift arm, and exits said head rail assembly through said guide control arm; and wherein a pull force imparted on said single operating element in a first pull direction causes said shift arm to pivot and engage said transmission, causing said head roller to rotate in said first direction;

a transmission operative to translate rotation of said first motion transfer element in said first direction into rotation of a second motion transfer element through at least one planet gear rotatably connected with a planet carrier; said first motion transfer element being a first gear and said second motion transfer element being a second gear;

an output assembly operatively engaged with said second motion transfer element to rotate said head roller; and wherein said input assembly includes a braking element adapted to brake said planet carrier to cause rotation of said second motion transfer element in said second direction, arid wherein said input assembly is adapted to release said planet carrier to cause rotation of said second motion transfer element in said first direction.

54. The covering of claim 53, said input assembly further comprising a spring operatively connected with said spool to automatically wind said single operating element onto said spool.

55. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element, said input assembly further comprising a spool; a pulley; a shift arm, a guide control arm; and wherein said single operating element extends from said spool, partially around said pulley, across said shift arm, and exits said head rail assembly through said guide control arm;

a transmission operative to translate reversible rotation of said first motion transfer element in said first direction into reversible rotation of a second motion transfer element though a planetary gear set configured to selectively operate in a first configuration and a second configuration;

an output assembly operatively engaged with said second motion transfer element to rotate said head roller;

wherein said first configuration provides a first mechanical advantage and causes said second motion transfer element to rotate at a first speed; and wherein said second configuration provides a second mechanical advantage and causes said second motion transfer element to rotate at a second speed.

56. The covering according to claim 55 wherein said first motion transfer element is a first gear and said second motion transfer element is a second gear.

57. The covering of claim 55 or 56, wherein said pulley is rotatably supported by said shift arm; and wherein friction between said pulley and said shift arm causes said shift arm to pivot when said pull force is applied to said single operating element.

58. The covering of claim 57, wherein said shift arm includes a first leg portion and a second leg portion; wherein said first leg portion is adapted to engage said transmission to control a rotational direction of said head roller; and wherein said second leg portion is adapted to operatively engage said single operating element such that while a pull force is being applied to said single operating element and while said head roller is rotating said first direction, changing direction of said pull force from a first pull direction to a second pull direction does not cause said head roller to rotate in said second direction.

59. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element, said input assembly further comprising a spool, a pulley, a shift arm, a guide control arm, and wherein said single operating element extends from said spool, partially around said pulley, across said shift arm, and exits said head rail assembly through said guide control arm;

a transmission operative to translate rotation of said first motion transfer element in said first direction into rotation of a second motion transfer element though a planetary gear set configured to selectively operate in a first configuration and a second configuration, said first motion transfer element being a first gear, and said second motion transfer element being a second gear an output assembly operatively engaged with said second motion transfer element to rotate said head roller;

wherein said first configuration provides a first mechanical advantage and causes said second motion transfer element to rotate at a first speed; and wherein said second configuration provides a second mechanical advantage and causes said second motion transfer element to rotate at a second speed.

60. The covering of claim 59, said input assembly further comprising a spring operatively connected with said spool to automatically wind said single operating element onto said spool.

61. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element;

a transmission operative to translate rotation of said first motion transfer element in said first direction into rotation of a second motion transfer element though a planetary gear set configured to selectively operate in a first configuration and a second configuration;

an output assembly operatively engaged with said second motion transfer element to rotate said head roller;

wherein said first configuration provides a first mechanical advantage and causes said second motion transfer element to rotate at a first speed; and wherein said second configuration provides a second mechanical advantage and causes said second motion transfer element to rotate at a second speed, said first mechanical advantage being greater than said second mechanical advantage, and wherein said first speed is less than said second speed.

62. The covering according to claim 61 wherein said first motion transfer element is a first gear and said second motion transfer element is a second gear.

63. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element, said input assembly further comprising a spool, a pulley, a shift arm, a guide control arm, and wherein said single operating element extends from said spool, partially around said pulley, across said shift arm, and exits said head rail assembly through said guide control arm;

a transmission operative to translate rotation of said first motion transfer element into rotation of a second motion transfer element through a clutch and at least one third gear;

an output assembly operatively engaged with said second motion transfer element to rotate said head roller;

wherein rotation of said first motion transfer element in said first direction engages said at least one third gear to activate said clutch to cause rotation of said second motion transfer element in said first direction; and wherein said clutch is configured to allow rotation of said second motion transfer element in said first direction and second direction when said clutch is deactivated.

64. The covering of claim 63 wherein said motion transfer element is a first gear and said second motion transfer element is a second gear.

65. The covering of claim 63 or 64, wherein said pulley is rotatably supported by said shift arm; and wherein friction between said pulley and said shift arm causes said shift arm to pivot when said pull force is applied to said single operating element.

66. The covering of claim 65, wherein said shift arm includes a first leg portion and a second leg portion; wherein said first leg portion is adapted to engage said transmission to control a rotational direction of said head roller; and wherein said second leg portion is adapted to operatively engage said single operating element such that while a pull force is being applied to said single operating element and while said head roller is rotating said first direction, changing direction of said pull force from a first pull direction to a second pull direction does not cause said head roller to rotate in said second direction.

67. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element, said input assembly further comprising a spool, a shift arm pivotally connected with said head rail assembly, a guide control arm, wherein said single operating element extends from said spool, across said shift arm, and exits said head rail assembly through said guide control arm, and wherein a pull force imparted on said single operating element in a first pull direction causes said shift arm to pivot and engage said transmission, causing said head roller to rotate in said first direction;

a transmission operative to translate rotation of said first motion transfer element into rotation of a second motion transfer element through a clutch and at least one third gear; said first motion transfer element is a first gear, and said second motion transfer element being a second gear;

an output assembly operatively engaged with said second motion transfer element to rotate said head roller;

wherein rotation of said first motion transfer element in said first direction engages said at least one third gear to activate said clutch to cause rotation of said second motion transfer element in said first direction; and wherein said clutch is configured to allow rotation of said second motion transfer element in said first direction and second direction when said clutch is deactivated.

68. The covering of claim 67, said input assembly further comprising a spring operatively connected with said spool to automatically wind said single operating element onto said spool.

69. A covering for an architectural opening comprising;

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element, said input assembly further comprising a spool, a pulley, a shift arm, a guide control arm, and wherein said single operating element extends from said spool, partially around said pulley, across said shift arm, and exits said head rail assembly through said guide control arm;

a transmission operative to translate rotation of said first motion transfer element into rotation of a second motion transfer element;

an output assembly operatively engaged with said second motion transfer element to rotate said head roller;

wherein said input assembly is configured to engage said transmission to cause said head roller to rotate in said first direction when said operating element travels in a first path through said input assembly; and wherein said input assembly is configured to engage said transmission to cause said head roller to rotate in a second direction when said operating element travels in a second path through said input assembly.

70. The covering according to claim 69 wherein said first motion transfer element is a first gear and said second motion transfer element is a second gear.

71. The covering of claim 69 or 70, wherein said pulley is rotatably supported by said shift arm; and wherein friction between said pulley and said shift arm causes said shift arm to pivot when said pull force is applied to said single operating element.

72. The covering of claim 71, wherein said shift arm includes a first leg portion and a second leg portion; wherein said first leg portion is adapted to engage said transmission to control a rotational direction of said head roller; and wherein said second leg portion is adapted to operatively engage said single operating element such that while a pull force is being applied to said single operating element and while said head roller is rotating said first direction, changing direction of said pull force from a first pull direction to a second pull direction does not cause said head roller to rotate in said second direction.

73. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element, said input assembly further comprising a spool, a shift arm pivotally connected with said head rail assembly, a guide control arm, wherein said single operating element extends from said spool, across said shift arm, and exits said head rail assembly through said guide control arm; and wherein a pull force imparted on said single operating element in a first pull direction causes said shift arm to pivot and engage said transmission, causing said head roller to rotate in said first direction;

a transmission operative to translate rotation of said first motion transfer element into rotation of a second motion transfer element, said first motion transfer element being a first gear and said second motion transfer element being a second gear;

an output assembly operatively engaged with said second motion transfer element to rotate said head roller;

wherein said input assembly is configured to engage said transmission to cause said head roller to rotate in said first direction when said operating element travels in a first path through said input assembly; and wherein said input assembly is configured to engage said transmission to cause said head roller to rotate in a second direction when said operating element travels in a second path through said input assembly.

74. The covering of claim 73, said input assembly further comprising a spring operatively connected with said spool to automatically wind said single operating element onto said spool.

75. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element;

a transmission operative to translate rotation of said first motion transfer element into rotation of a second motion transfer element, said first motion transfer element being a first gear and said second transfer element being a second gear, said transmission further comprising a clutch selectively rotatably connecting said first gear with said second gear; and at least one third gear rotatably connecting said first gear with said second gear;

an output assembly operatively engaged with said second motion transfer element to rotate said head roller;

wherein said input assembly is configured to engage said transmission to cause said head roller to rotate in said first direction when said operating element travels in a first path through said input assembly; and wherein said input assembly is configured to engage said transmission to cause said head roller to rotate in a second direction when said operating element travels in a second path through said input assembly.

76. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element, said input assembly further comprising a spool, a pulley, a shift arm, a guide control arm, and wherein said single operating element extends from said spool, partially around said pulley, across said shift arm, and exits said head rail assembly through said guide control arm;

a transmission operative to translate rotation of said first motion transfer element into rotation of a second motion transfer element;

an output assembly operatively engaged with said second motion transfer element to rotate said head roller;

wherein a pull force applied in a first pull direction imparted on said single operating element causes said head roller to rotate in said first direction; and wherein said input assembly is operative to allow a change in direction of said pull force on said single operating element while said head roller is rotating in said first direction without reversing rotation of said head roller.

77. The covering according to claim 76 wherein said first motion transfer element is a first gear and said second motion transfer element is a second gear.

78. The covering of claim 76 or 77, wherein said pulley is rotatably supported by said shift arm; and wherein friction between said pulley and said shift arm causes said shift arm to pivot when said pull force is applied to said single operating element.

79. The covering of claim 78, wherein said shift arm includes a first leg portion and a second leg portion; wherein said first leg portion is adapted to engage said transmission to control a rotational direction of said head roller; and wherein said second leg portion is adapted to operatively engage said single operating element such that while said pull force is being applied to said single operating element and while said head roller is rotating said first direction, changing direction of said pull force from said first pull direction to a second pull direction does not cause said head roller to rotate in said second direction.

80. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element, said input assembly further comprising a spool, a shift arm pivotally connected with said head rail assembly, a guide control arm, wherein said single operating element extends from said spool, across said shift arm, and exits said head rail assembly through said guide control arm, and wherein said pull force imparted on said single operating element in said first pull direction causes said shift arm to pivot and engage said transmission;

a transmission operative to translate rotation of said first motion transfer element into rotation of a second motion transfer element, said first motion transfer element being a first gear and said second motion transfer element being a second gear;

an output assembly operatively engaged with said second motion transfer element to rotate said head roller;

wherein a pull force applied in a first pull direction imparted on said single operating element causes said head roller to rotate in said first direction; and wherein said input assembly is operative to allow a change in direction of said pull force on said single operating element while said head roller is rotating in said first direction without reversing rotation of said head roller.

81. The covering of claim 80, said input assembly further comprising a spring operatively connected with said spool to automatically wind said single operating element onto said spool.

82. A covering for an architectural opening comprising:

a head rail assembly;

at least one sheet of fabric;

a head roller rotatably supported by said head rail assembly and adapted to extend or retract said at least one sheet upon rotation of said head roller in a first direction or a second direction;

a control system connected with said head rail assembly and adapted to rotate said head roller in said first direction and said second direction, said control system comprising:

an input assembly including a single operating element operative to convert linear motion of said operating element into rotational motion of a first motion transfer element;

a transmission operative to translate rotation of said first motion transfer element into rotation of a second motion transfer element, said first motion transfer element being a first gear and said second motion transfer element being a second gear, said transmission further comprising a clutch selectively rotatably connecting said first gear with said second gear and at least one third gear rotatably connecting said first gear with said second gear;

an output assembly operatively engaged with said second motion transfer element to rotate said head roller;

wherein a pull force applied in a first pull direction imparted on said single operating element causes said head roller to rotate in said first direction; and wherein said input assembly is operative to allow a change in direction of said pull force on said single operating element while said head roller is rotating in said first direction without reversing rotation of said head roller.

* * * * *

UNITED STATES PATENT AND TRADEMARK OFFICE

CERTIFICATE OF CORRECTION

PATENT NO. : 7,128,126 B2
APPLICATION NO. : 10/791645
DATED : October 31, 2006
INVENTOR(S) : Stephen P. Smith et al.

It is certified that error appears in the above-identified patent and that said Letters Patent is hereby corrected as shown below:

Column 45, line 39, delete “carder” and insert --carrier--.

Column 49, line 26, delete “heed” and insert --head--.

Signed and Sealed this

Ninth Day of January, 2007

JON W. DUDAS
*Director of the United States Patent and Trademark Office*